US012709365B2

(12) United States Patent
MacKarvich

(10) Patent No.: US 12,709,365 B2
(45) Date of Patent: Aug. 18, 2026

(54) BOAT LIFT

(71) Applicant: Charles J. MacKarvich, Atlanta, GA (US)

(72) Inventor: Charles J. MacKarvich, Atlanta, GA (US)

( * ) Notice: Subject to any disclaimer, the term of this patent is extended or adjusted under 35 U.S.C. 154(b) by 0 days.

(21) Appl. No.: 19/410,787

(22) Filed: Dec. 5, 2025

(65) Prior Publication Data

US 2026/0159206 A1 Jun. 11, 2026

Related U.S. Application Data

(60) Provisional application No. 63/729,188, filed on Dec. 6, 2024.

(51) Int. Cl.
*B63C 3/06* (2006.01)
*B63C 3/14* (2006.01)

(52) U.S. Cl.
CPC . *B63C 3/06* (2013.01); *B63C 3/14* (2013.01)

(58) Field of Classification Search
CPC ..... B63C 3/06; B63C 3/12; B63C 3/08
See application file for complete search history.

(56) References Cited

U.S. PATENT DOCUMENTS 3,150,389 A * 9/1964 Woodworth ..... B63C 3/06 114/374
5,919,000 A * 7/1999 Unkle ..... B63C 3/06 114/44
9,926,053 B1 * 3/2018 Ascencio ..... B63C 3/14
12,617,507 B1 5/2026 Deboer et al.
2005/0035259 A1 * 2/2005 Maffett ..... B63C 15/00 248/346.06
2006/0147269 A1 * 7/2006 Spratt ..... B63C 3/06 405/3
2007/0045984 A1 * 3/2007 Remedios ..... B60P 3/1066 280/414.1
2010/0189502 A1 * 7/2010 Basta ..... B63C 3/06 403/334
2010/0239371 A1 * 9/2010 Brown ..... B63C 3/06 405/3
2021/0354794 A1 * 11/2021 Hey ..... B63C 3/06
2022/0097803 A1 * 3/2022 Floe ..... B63C 3/12
2024/0359781 A1 * 10/2024 Golden ..... B63C 3/06
2024/0383587 A1 * 11/2024 Flower ..... B63C 3/12

* cited by examiner

*Primary Examiner* — Benjamin F Fiorello
(74) *Attorney, Agent, or Firm* — Buchalter LLP

(57) ABSTRACT

A boat lift includes a base frame portion for supporting a boat; an upright frame portion extending substantially upright from the base frame portion, the upright frame portion comprising a swing arm, the swing arm comprising: a shock absorption assembly comprising a resilient shock absorber; an arm body slidably coupled to the shock absorption assembly proximate a first swing arm end of the swing arm; and a swing pivot proximate the first swing arm end; and a dock mounting assembly configured to mount the boat lift frame to a dock, the swing arm pivotably coupled to the dock mounting assembly by the swing pivot.

27 Claims, 40 Drawing Sheets

BOAT LIFT

CROSS-REFERENCE TO RELATED APPLICATIONS

The present application claims the benefit of U.S. Provisional Application No. 63/729,188, filed Dec. 6, 2024, which is hereby specifically incorporated by reference herein in its entirety.

TECHNICAL FIELD

This disclosure relates to boating equipment. More specifically, this disclosure relates to a boat lift for elevating and lowering a boat.

BACKGROUND

Boat lifts are commonly used to lift a boat out of the water for access, storage, and/or maintenance and for lowering the boat into the water for use. Often, boat lifts are capable of lifting and lowering a boat in a vertical direction only.

SUMMARY

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts of the disclosure as an introduction to the following complete and extensive detailed description.

Disclosed is a boat lift frame comprising a base frame portion for supporting a boat; an upright frame portion; and a torsion assembly resiliently coupling the upright frame portion to the base frame portion.

Also disclosed is a boat lift comprising a lift float; a lift frame coupled to the lift float, the lift frame comprising; a base portion for supporting a boat; an upright portion; and a torsion assembly resiliently coupling the upright portion to the base portion; and a lift assembly comprising a lift guide and a slide plate configured to slide vertically within the lift guide, the lift frame pivotably coupled to the slide plate.

Further disclosed is a boat lift comprising a base frame portion for supporting a boat; an upright frame portion extending substantially upright from the base frame portion, the upright frame portion comprising a swing arm, the swing arm comprising: a shock absorption assembly comprising a resilient shock absorber; an arm body slidably coupled to the shock absorption assembly proximate a first swing arm end of the swing arm; and a swing pivot proximate the first swing arm end; and a dock mounting assembly configured to mount the boat lift frame to a dock, the swing arm pivotably coupled to the dock mounting assembly by the swing pivot.

Additionally, disclosed is a boat lift comprising a base frame portion for supporting a boat, the base frame portion comprising a boat support member extending laterally between a first lift side of the boat and a second lift side of the boat lift; an upright frame portion extending substantially upright from the base frame portion, the upright frame portion comprising a swing rail at the first lift side; and a torsion assembly pivotably coupling the swing rail to the boat support member, the torsion assembly comprising: a main axle extending laterally through an interior of the boat support member and rotatably relative to the boat support member; and a torsion tube fixedly coupled to each of the swing rail and the main axle.

Also disclosed is a boat lift comprising a base frame portion for supporting a boat, the base frame portion comprising a boat support member extending laterally between a first lift side of the boat and a second lift side of the boat lift, the boat support member defining a longitudinal slot formed in a top wall of the boat support member and extending along a length of the boat support member; an upright frame portion extending substantially upright from the base frame portion; and a bunk bracket slidably mounted to the boat support member by a bracket fastener, wherein the bracket fastener engages and slides within the longitudinal slot to reposition the bunk bracket along the length of the boat support member.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Figure 1:
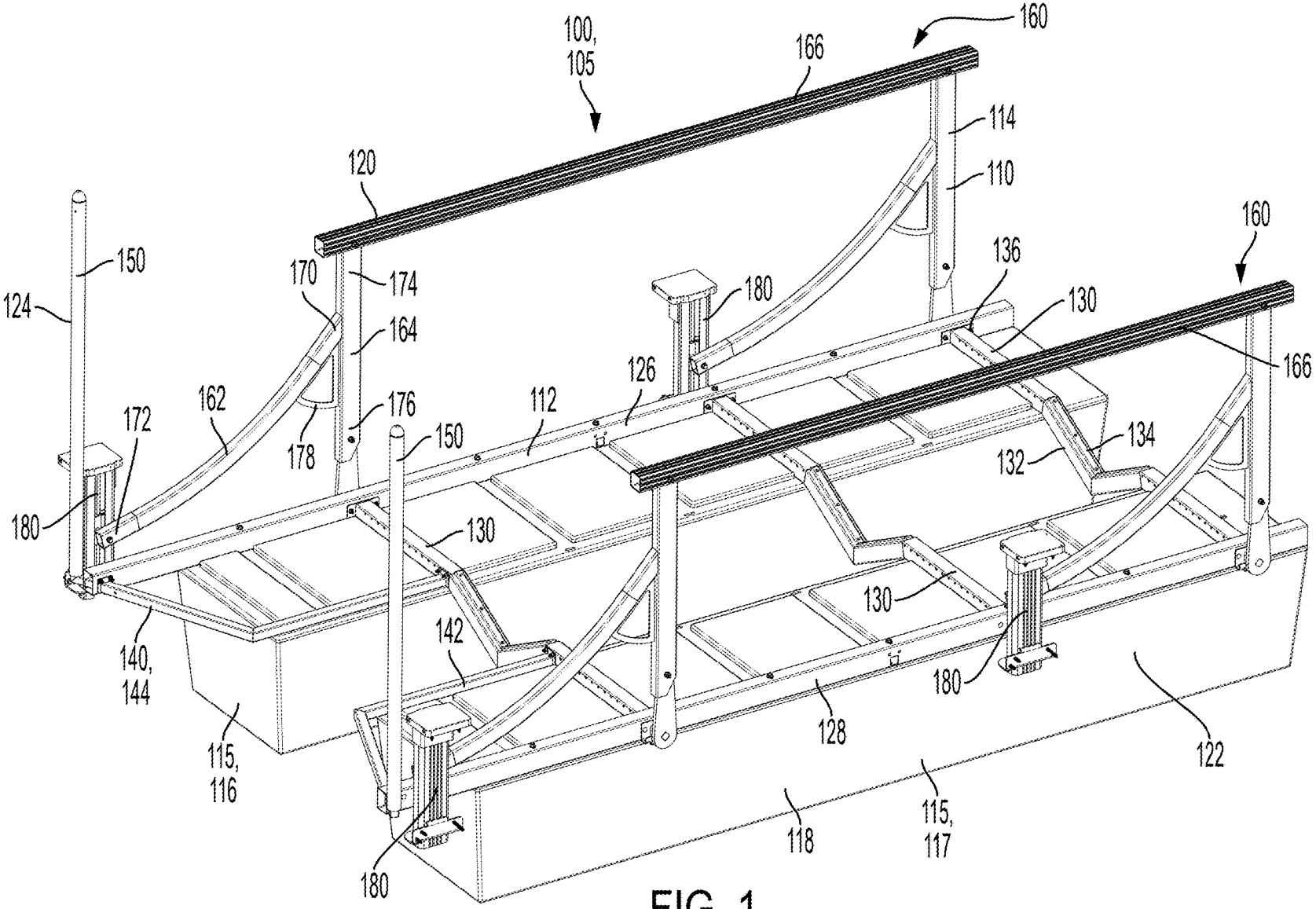
FIG. 1 is a perspective view of a boat lift, in accordance with one aspect of the present disclosure.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutations of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed is a boat lift and associated methods, systems, devices, and various apparatus. Example aspects of the boat lift can comprise a lift frame. The lift frame can comprise a base portion and an upright portion resiliently coupled to the base portion by a torsion assembly. It would be understood by one of skill in the art that the boat lift is described in but a few exemplary embodiments among many. No particular terminology or description should be considered limiting on the disclosure or the scope of any claims issuing therefrom.

Figure 2:
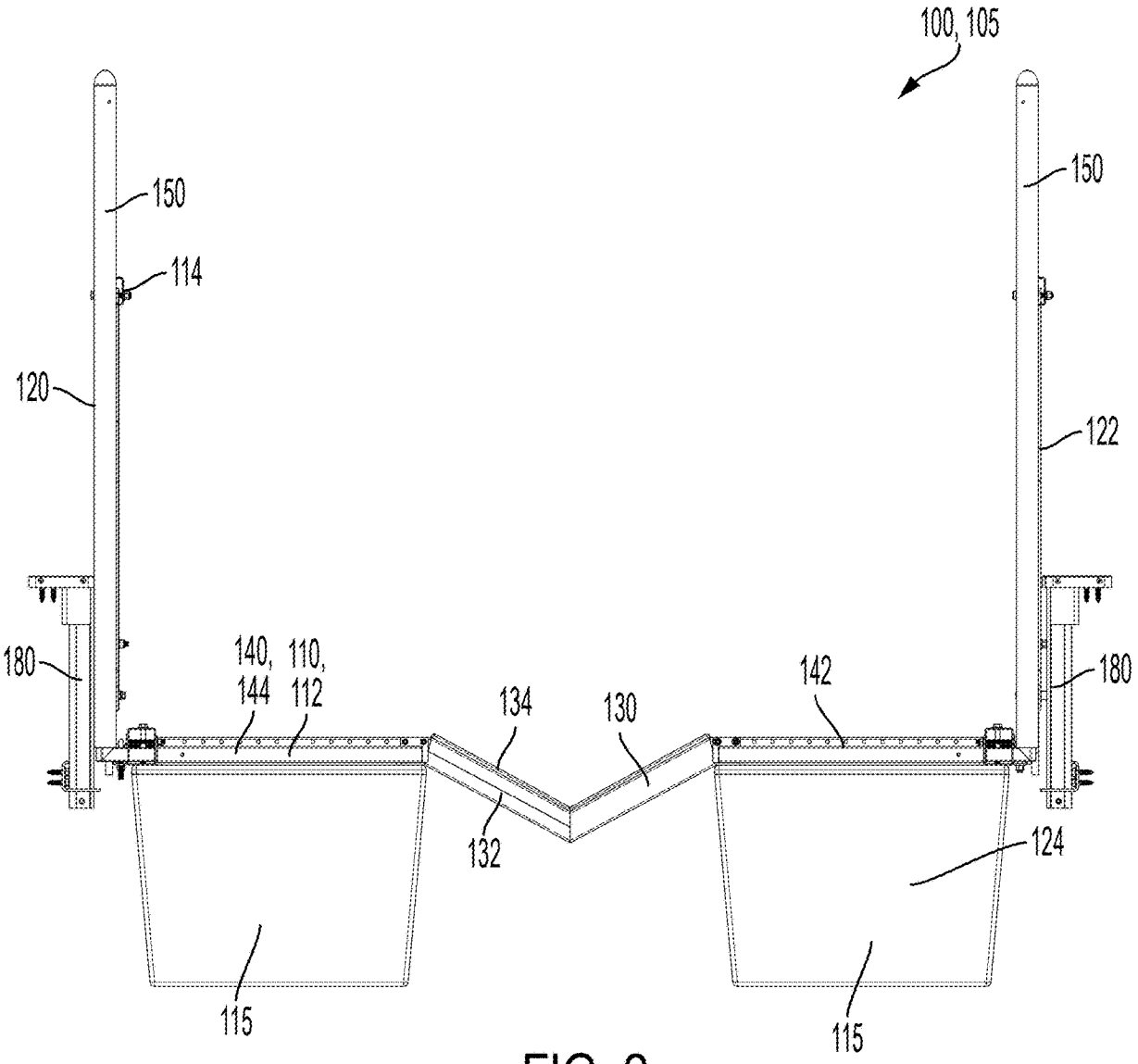
FIG. 2 is a front view of the boat lift of FIG. 1.
Figure 3:
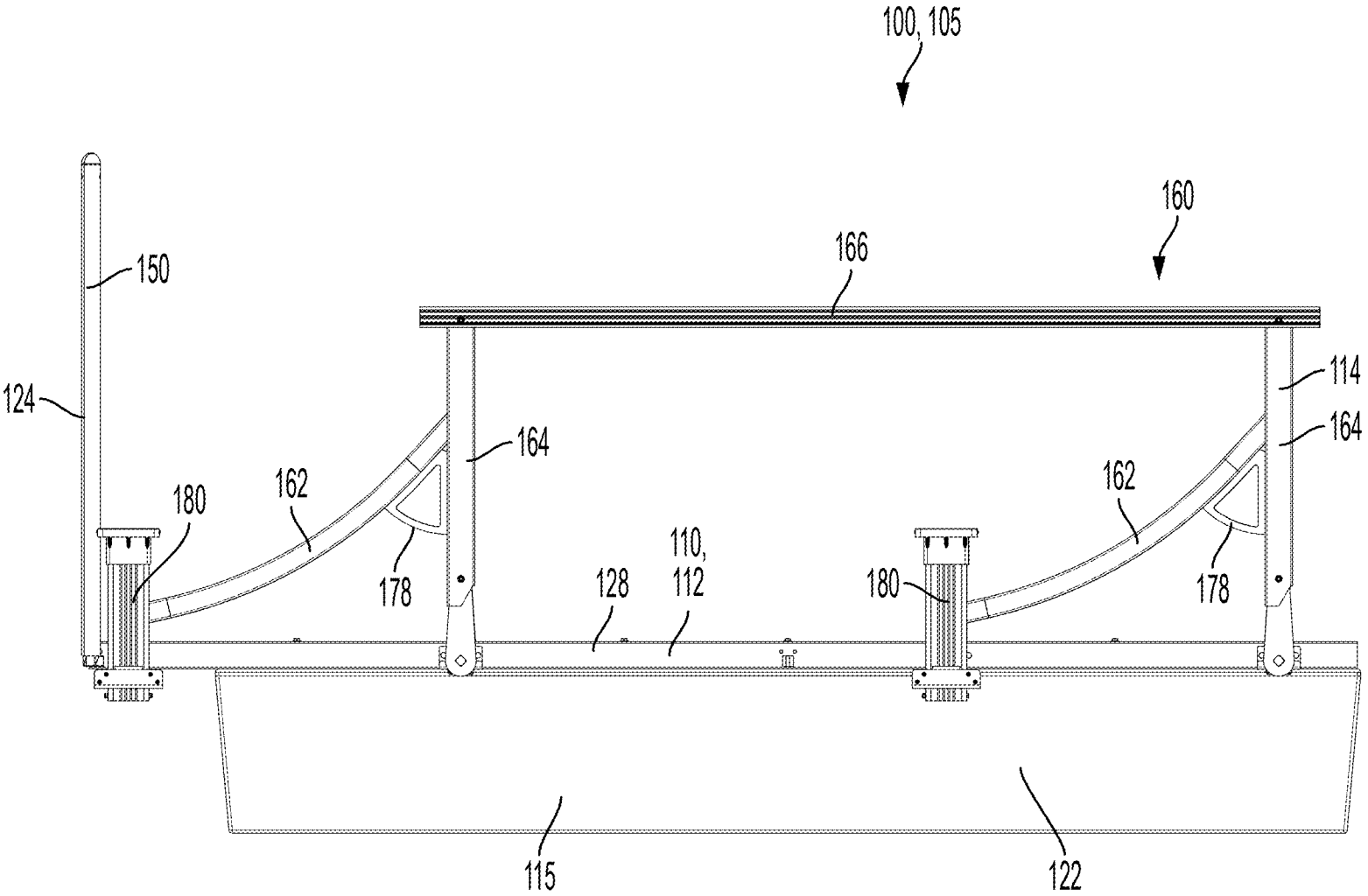
FIG. 3 is a right side view of the boat lift of FIG. 1.

FIGS. 1-3 illustrate is a front perspective, front, and right side views of a water vehicle lift 100, respectively, in accordance with one aspect of the present disclosure. The water vehicle lift 100 can be movably mounted to a dock for lifting and lowering a water vehicle, such as a boat, out of and in to a body of water. In the foregoing description, the water vehicle lift 100 is referred to as a "boat lift 105", but it will be understood by one of ordinary skill that the boat lift 105 can be configured for use with any other suitable water vehicle, including but not limited to, a kayak, canoe, jet ski, or the like. The dock can be a fixed dock, a floating dock, or any other suitable type of dock. Moreover, it will be understood that the boat lift 105 can be mounted to any other suitable structure within or adjacent to a body of water, such as a barge or other large water vessel, a seawall, or the like. The body of water can be a lake, river, ocean, or any other suitable body of water.

Example aspects of the boat lift 105 can comprise a lift frame 110 mounted to one or more lift floats 115. In the present aspect, the lift frame 110 can be mounted to a first side float 116 at a first lift side 120 of the boat lift 105 and a second side float 117 at a second lift side 122 of the boat lift 105. The lift floats 115 can allow the lift frame 110 to float on the body of water. Each of the lift floats 115 can comprise a float body 118 defining a hollow interior. Air can be let into and out of the hollow interiors of the lift floats 115 to increase or decrease the buoyancy of the lift floats 115. As the buoyancy of the lift floats 115 increases, the lift floats 115 can float upward, and as the buoyancy decreases, the lift floats 115 can sink downward into the body of water. For example, to facilitate driving a boat (or other water vehicle) on or off the lift frame 110 in the body of water, air can be let out of the lift floats 115 to sink the lift floats 115 and at least a base portion 112 of the lift frame 110 down into the body of water.

The lift frame 110 can comprise the base portion 112 and an upright portion 114 pivotably coupled to the base portion 112. The base portion 112 can be supported on and coupled to the lift floats 115, as shown. The base portion 112 can comprise a first side base member 126 extending substantially along the first lift side 120 of the boat lift 105 and a second side base member 128 parallel to the first side base member 126 and extending substantially along the second lift side 122 of the boat lift 105. The base portion 112 can further comprise one or more boat support members 130 extending transversely between the first side base member 126 and the second side base member 128. In the present aspect, the base portion 112 can comprise three of the boat support members 130. In example aspects, each of the boat support members 130 can comprise a V-shaped portion 132 oriented centrally between the first and second side base members 126,128 and extending downwardly between the lift floats 115. A bunk slick 134 can be mounted atop each V-shaped portion 132. The bunk slick 134 can comprise a substantially smooth, low-friction material to facilitate sliding a boat on and off of the boat support members 130. The boat support members 130 can be secured to the first and second side base members 126,128 by corresponding base brackets 136.

In some aspects, the base portion 112 can comprise additional base frame members, such as first and second front base members 140,142. In the present aspect, each of the first and second front base members 140,142 can be coupled to a forward-most one of the boat support members 130 and a corresponding one of the first side base member 126 or the second side base member 128, proximate to a front lift end 124 of the boat lift 105. Each of the first and second front base members 140,142 can define a substantially horizontal portion 144 and a substantially vertical portion 446 (shown in FIG. 4). A vertical boat guide 150 can be mounted to each of the substantially vertical portions 446 to facilitate guiding a front end of a boat onto the boat lift 105.

The upright portion 114 of the lift frame 110 can comprise an upright frame assembly 160 at each of the first lift side 120 and the second lift side 122. Each upright frame assembly 160 can comprise a pair of curved swing arms 162, a pair of substantially vertical swing rails 164, and an upper side rail 166 extending between the pair of vertical swing rails 164. Each of the curved swing arms 162 can be coupled to a corresponding one of the vertical swing rails 164 at an upper swing arm end 170 of the curved swing arm 162. For example, each of the curved swing arms 162 can be welded or otherwise attached to the corresponding vertical swing rail 164. The curved swing arm 162 can be coupled to the vertical swing rail 164 at any suitable location along the vertical swing rail 164 between an upper rail end 174 and a lower rail end 176 thereof. In some aspects, the curved swing arm 162 can be formed monolithically (i.e., formed a singular component that constitutes a single material without joints or seams) with the vertical swing rail 164. A swing arm gusset 178 can be arranged between each curved swing arm 162 and the corresponding vertical swing rail 164. While the swing arms 162 are shown and described as "curved" herein, the swings arms 162 can be substantially linear or otherwise non-curved in other aspects.

Figure 4:
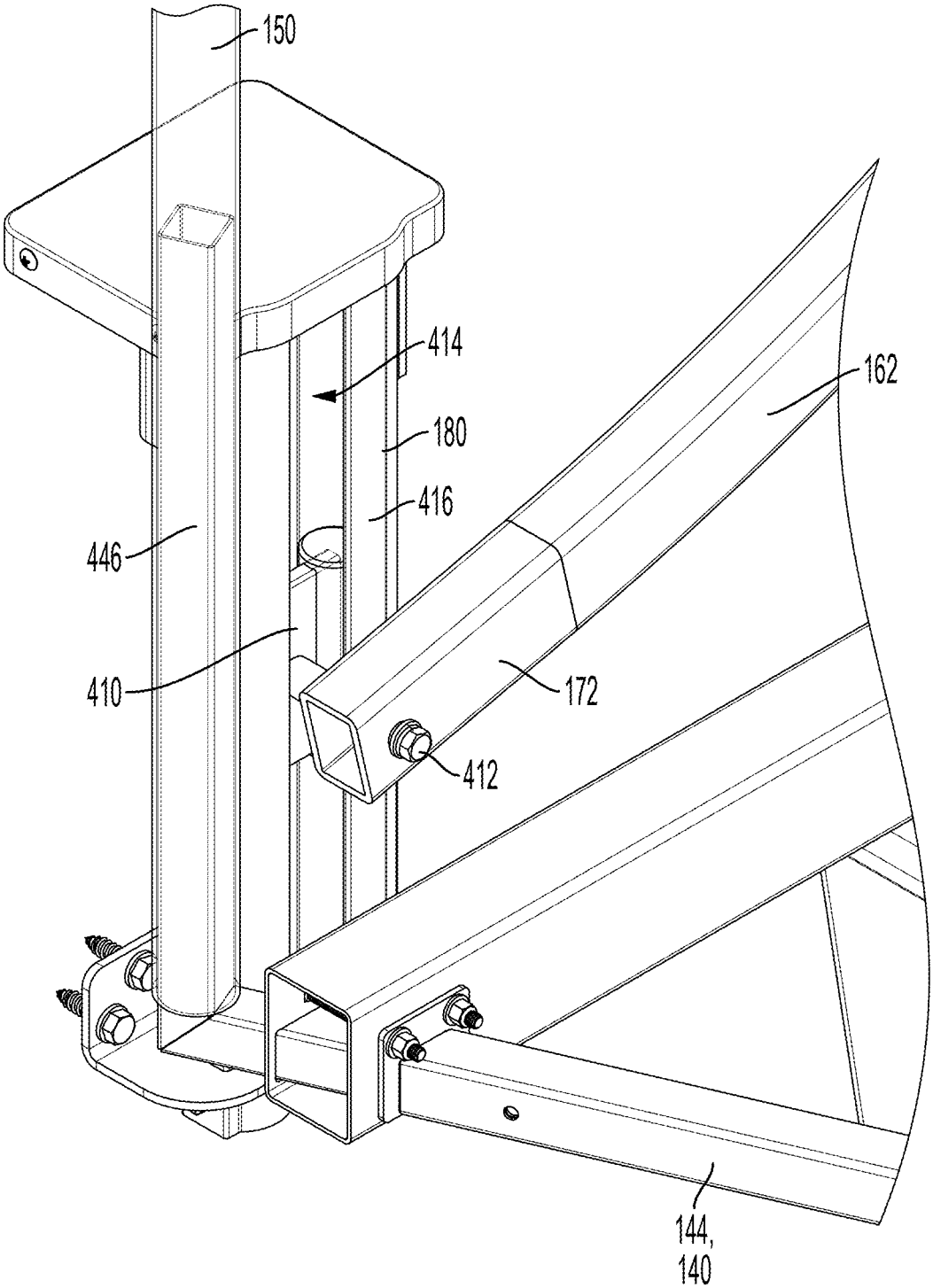
FIG. 4 is a right perspective view of a lift assembly of the boat lift of FIG. 1.
Figure 5:
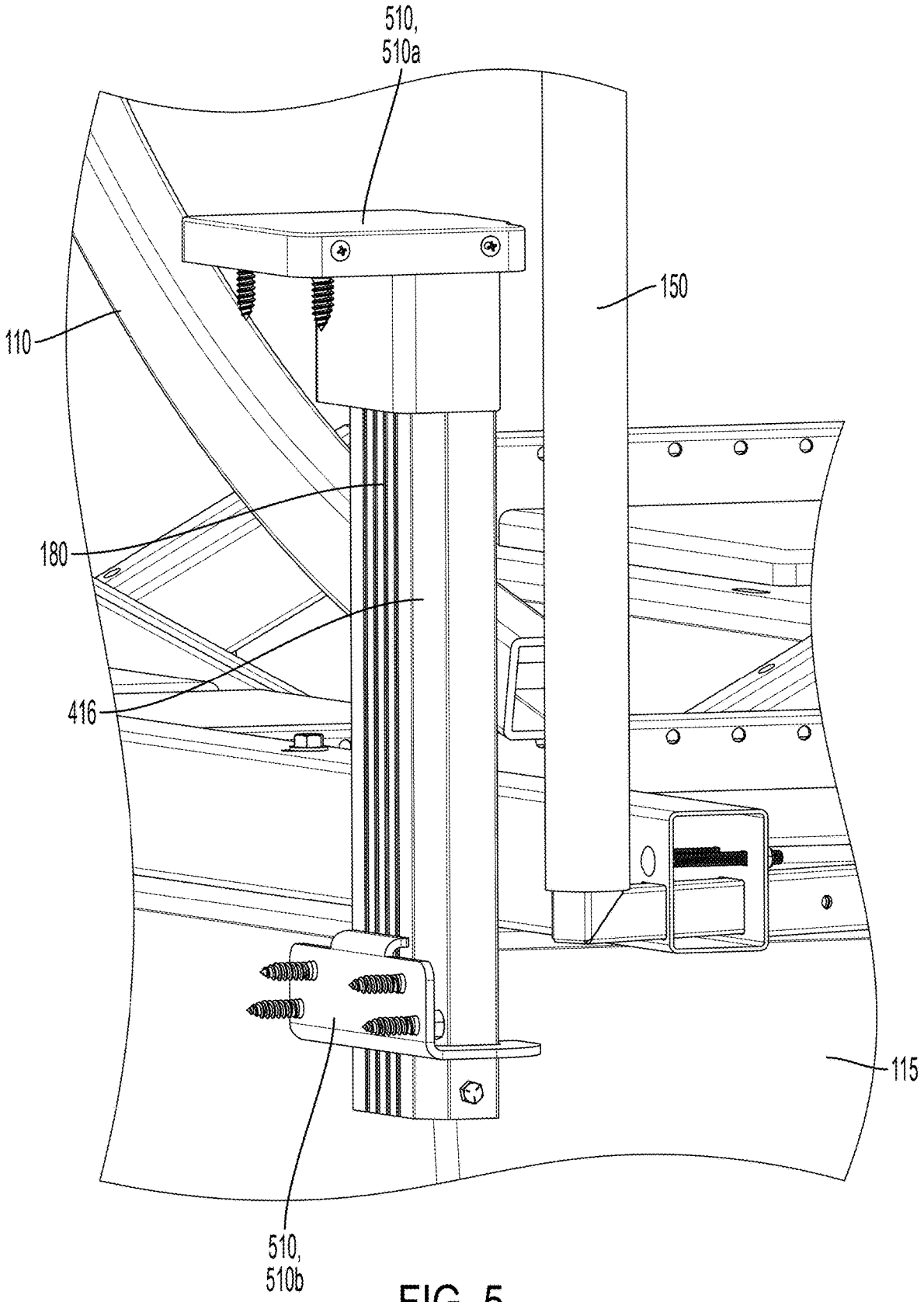
FIG. 5 is a left perspective view of the lift assembly of FIG. 4.
Figure 6:
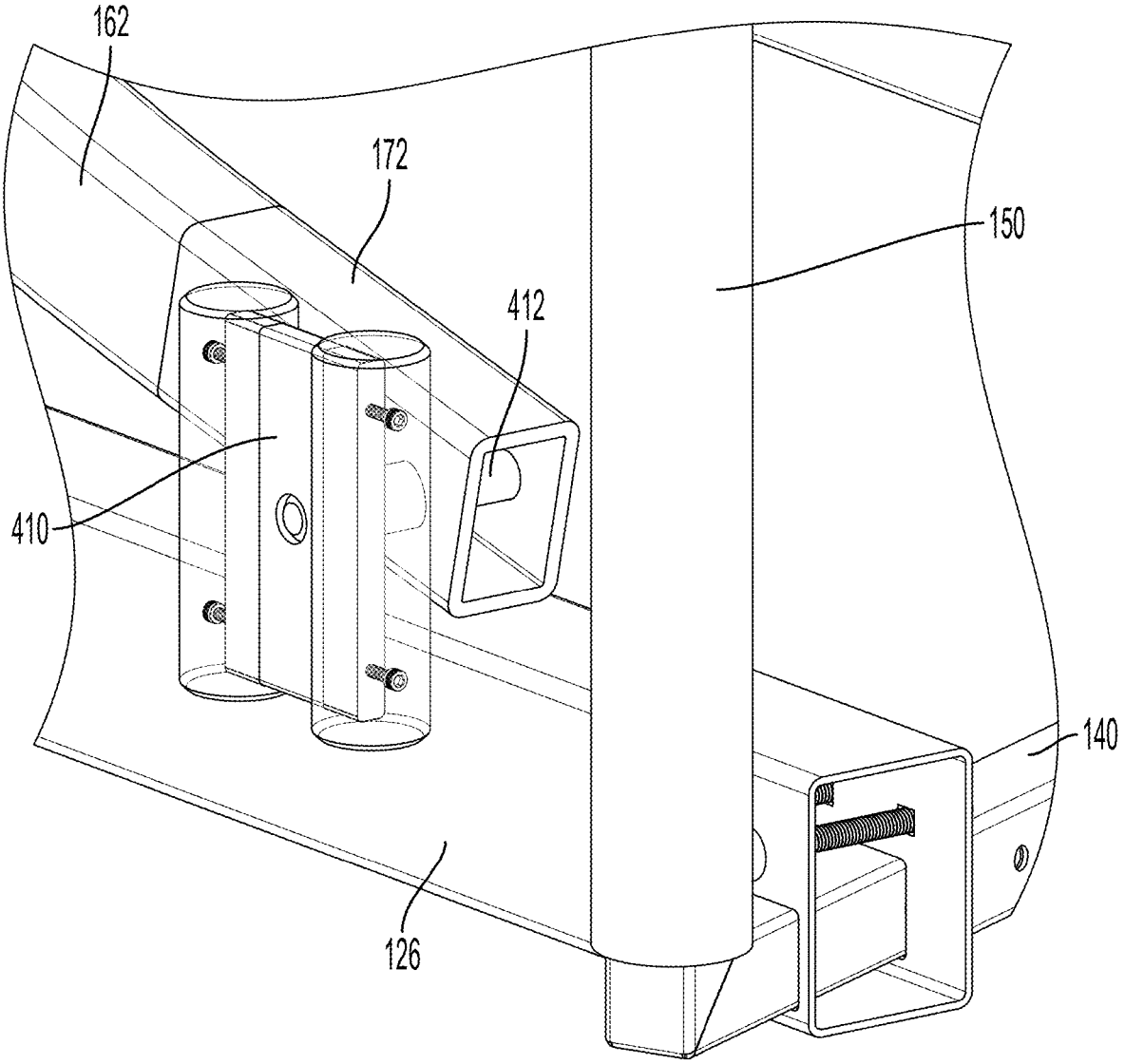
FIG. 6 is a left perspective view of a slide plate of the lift assembly of FIG. 4.
Figure 7:
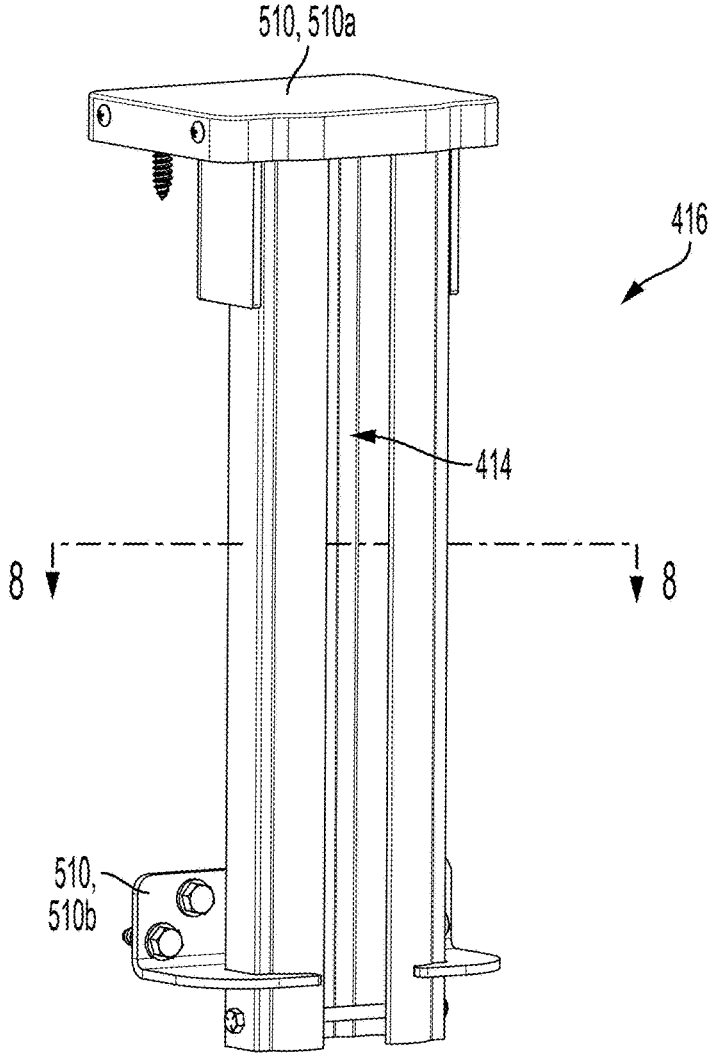
FIG. 7 is a right perspective view of a guide of the lift assembly of FIG. 4.
Figure 8:
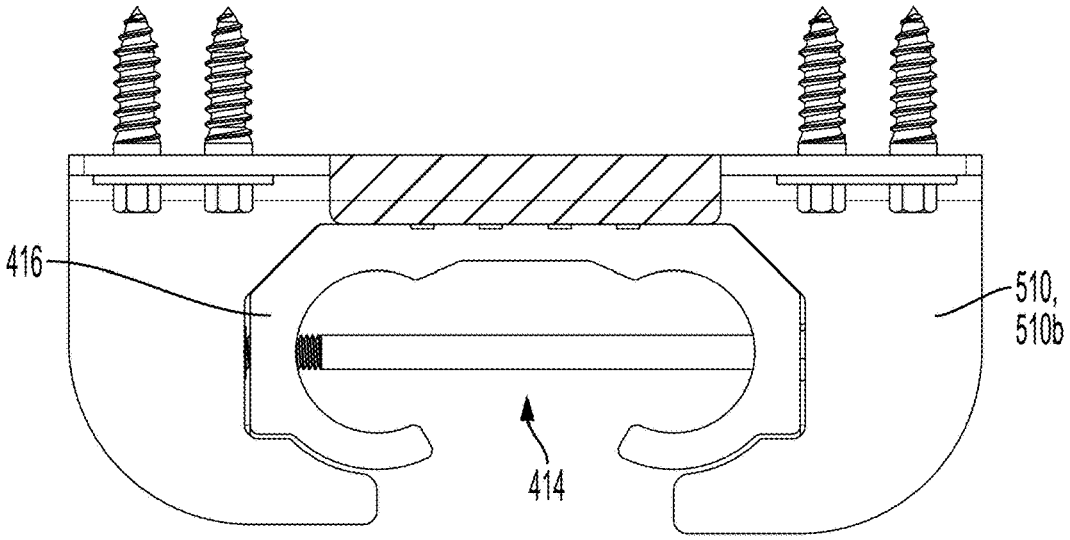
FIG. 8 is a cross-sectional view of the guide, taken along line 8-8 in FIG. 7.
Figure 9:
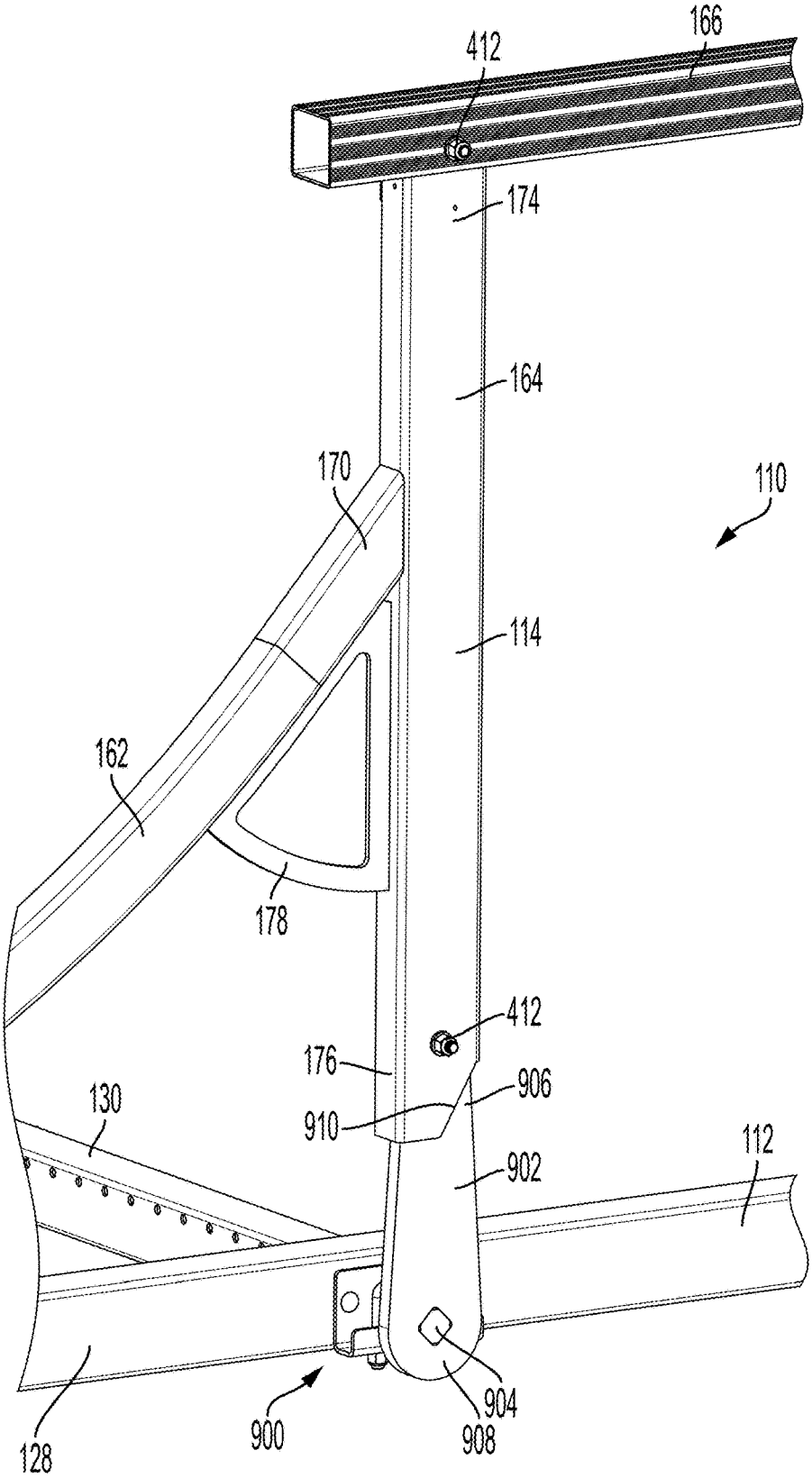
FIG. 9 is a right perspective view of a torsion assembly of the boat lift of FIG. 1.
Figure 11:
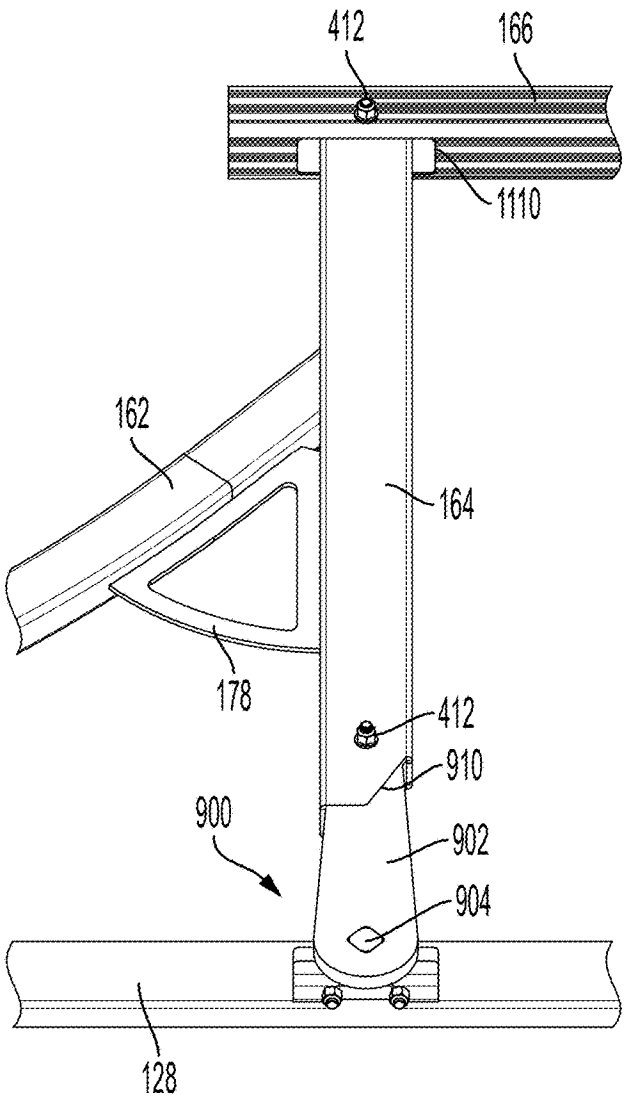
FIG. 11 is a right bottom perspective view of the torsion assembly of FIG. 9.
Figure 10:
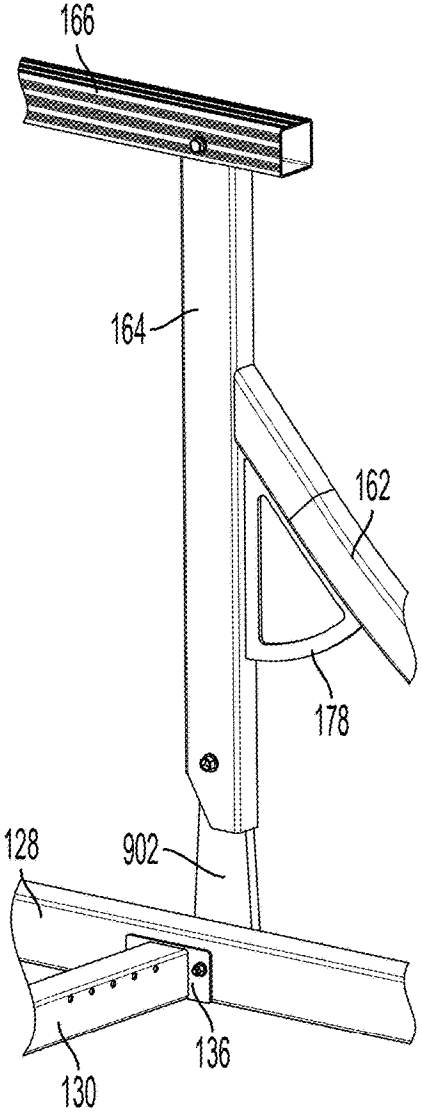
FIG. 10 is a left perspective view of the torsion assembly of FIG. 9.

A lower swing arm end 172 of each curved swing arm 162 can be pivotably coupled to a lift assembly 180 of the boat lift 105. FIGS. 4-8 illustrate the lift assembly 180 in further detail. Referring to FIGS. 4, the lower swing arm end 172 can be pivotably coupled to a slide plate 410 of the lift assembly 180 by a nut and bolt assembly 412 or other suitable fastener. The slide plate 410 can be configured to slide vertically within a guide channel 414 of a lift guide 416 of the lift assembly 180. Referring to FIG. 5, the lift guide 416 can be mounted to the dock or other structure by one or more mounting brackets 510, such as an upper mounting bracket 510*a* and a lower mounting bracket 510*b*. The lift frame 110 and lift float 115 can thereby be raised and lowered relative to the dock by the vertical sliding of the slide plate 410 (shown in FIG. 4) within the guide channel 414 (shown in FIG. 4).

Referring to FIGS. 9-12, the upper rail end 174 of each vertical swing rail 164 can be pivotably coupled to the corresponding upper side rail 166. In example aspects, the upper rail end 174 can extend through a pivot opening 1110 (shown in FIG. 11) formed in the upper side rail 166 and can be pivotably coupled to the upper side rail 166 by a nut and bolt assembly 412 or other suitable fastener. The pivot opening 1110 can be elongated at either side of the vertical swing rail 164 to provide a clearance between the upper side rail 166 and the vertical swing rail 164, thereby allowing the vertical swing rail 164 to pivot freely within the pivot opening 1110. Thus, while the swing rails 164 are shown and described as "substantially vertical" herein, it will be understood that the swing rails 164 can pivot between a variety of orientations, including but not limited to "substantially vertical".

Figure 12:
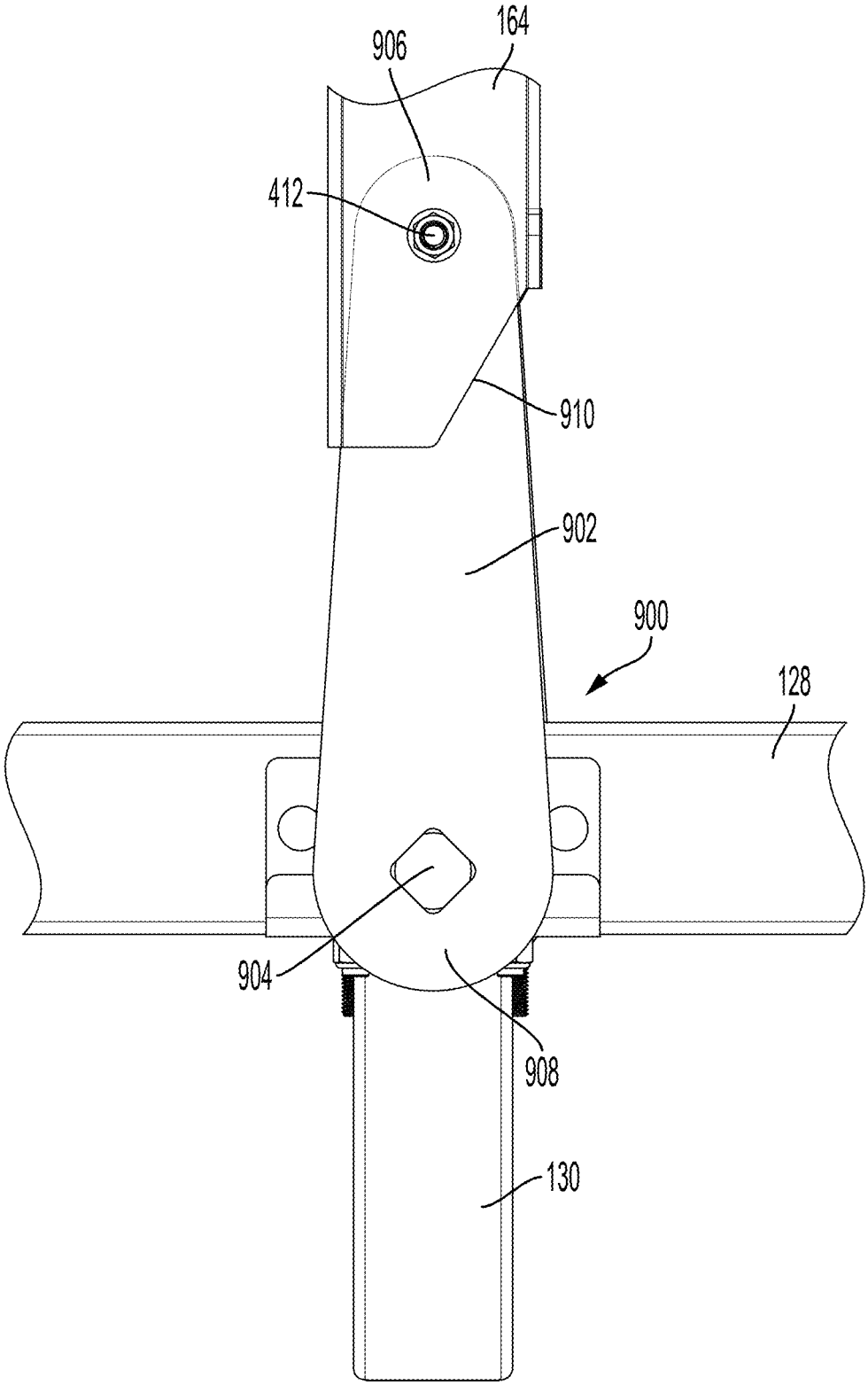
FIG. 12 is a detail right side view of the torsion assembly of FIG. 9.
Figure 13:
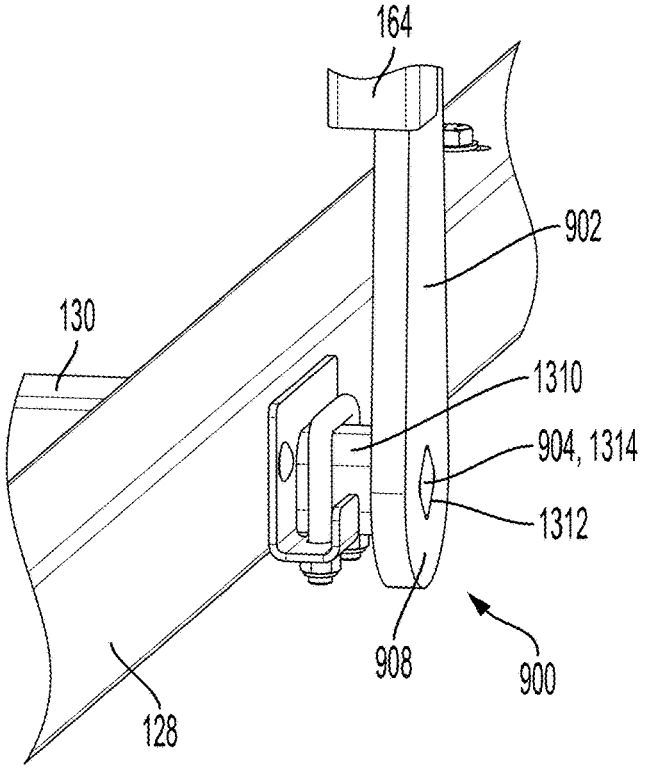
FIG. 13 is a detail right perspective view of the torsion assembly of FIG. 9.
Figure 14:
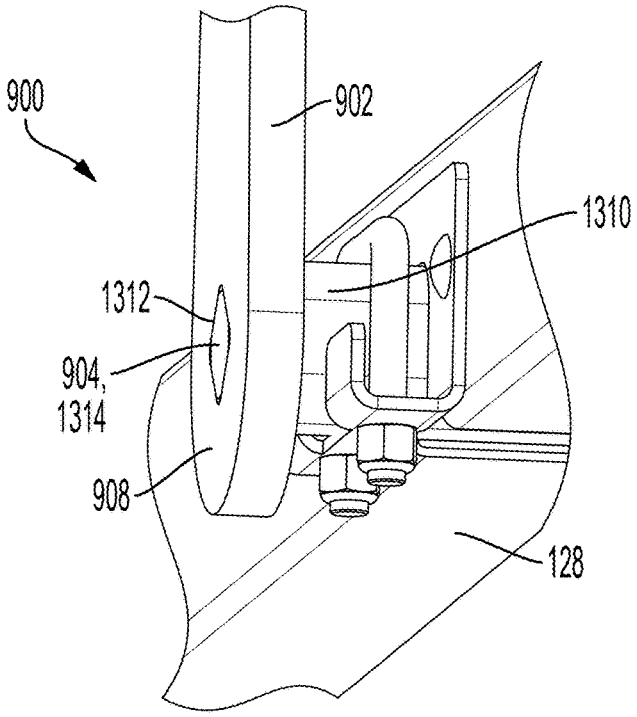
FIG. 14 is another detail right perspective view of the torsion assembly of FIG. 9.

The lower rail end 176 of each vertical swing rail 164 can be pivotably coupled to the base portion 112 of the lift frame 110 by a torsion assembly 900. Example aspects of the torsion assembly 900 can comprise a torsion arm 902, a torsion spindle 904, a torsion tube 1310 (shown in FIG. 13) and a plurality of resilient cords 1710 (shown in FIG. 17). With continuing reference to FIGS. 9-12, each torsion arm 902 can define an upper torsion arm end 906 and a lower torsion arm end 908. The upper torsion arm end 906 of each torsion arm 902 can be pivotably coupled to the lower rail end 176 of the corresponding vertical swing rail 164. For example, the upper torsion arm end 906 can extend into a hollow interior of the vertical swing arm 162 and can be pivotably coupled to the lower rail end 176 by a nut and bolt assembly 412 or other suitable fastener. In some aspects, a width of the torsion arm 902 can taper towards the upper torsion arm end 906, as best seen in FIG. 12. Moreover, in some aspects, the vertical swing rail 164 can define a pivot notch 910 at the lower rail end 176 that can allow for greater pivoting movement of the vertical swing rail 164 relative to the torsion arm 902.

Referring now to FIGS. 13-16, each torsion arm 902 can be mounted to the corresponding torsion spindle 904 at the lower torsion arm end 908 thereof. For example, the torsion arm 902 can define a spindle opening 1312 extending therethrough, within which a spindle end portion 1314 of the torsion spindle 904 can be received. The torsion spindle 904 can extend into a hollow interior of the torsion tube 1310. In example aspects, the torsion spindle 904 can be suspended within the hollow interior of the torsion tube 1310 by the corresponding resilient cords 1710, as described in further detail below with respect to FIGS. 17-19.

Figure 15:
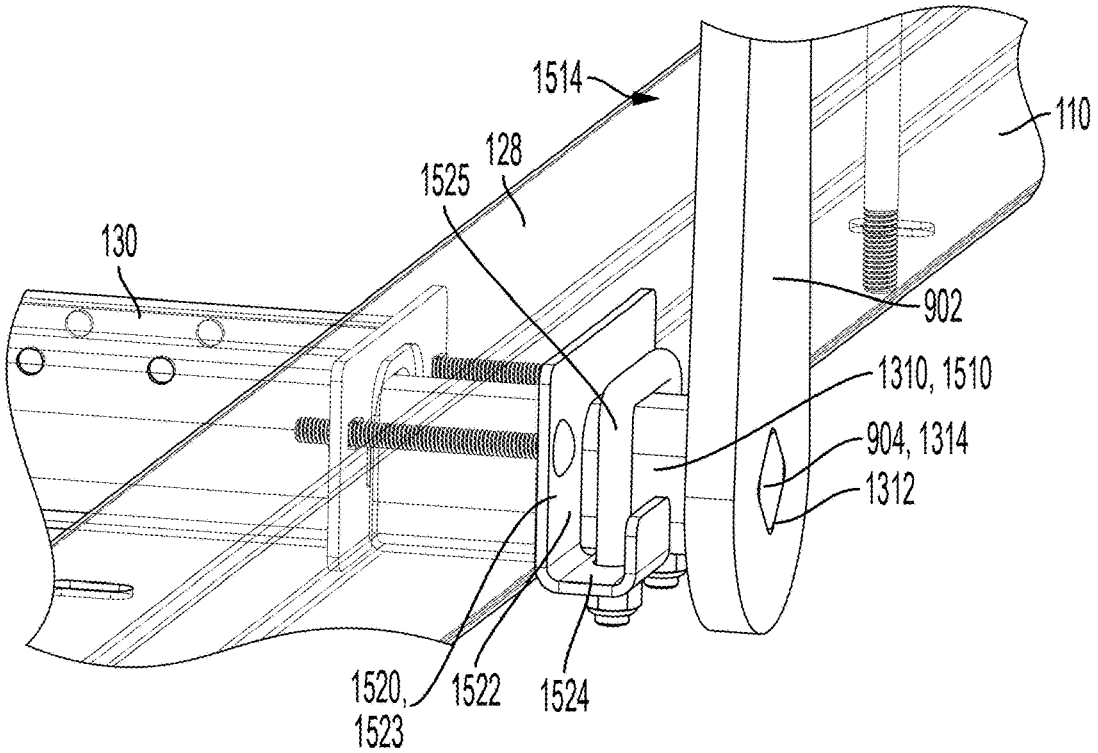
FIG. 15 is another detail right perspective view of the torsion assembly of FIG. 9.
Figure 16:
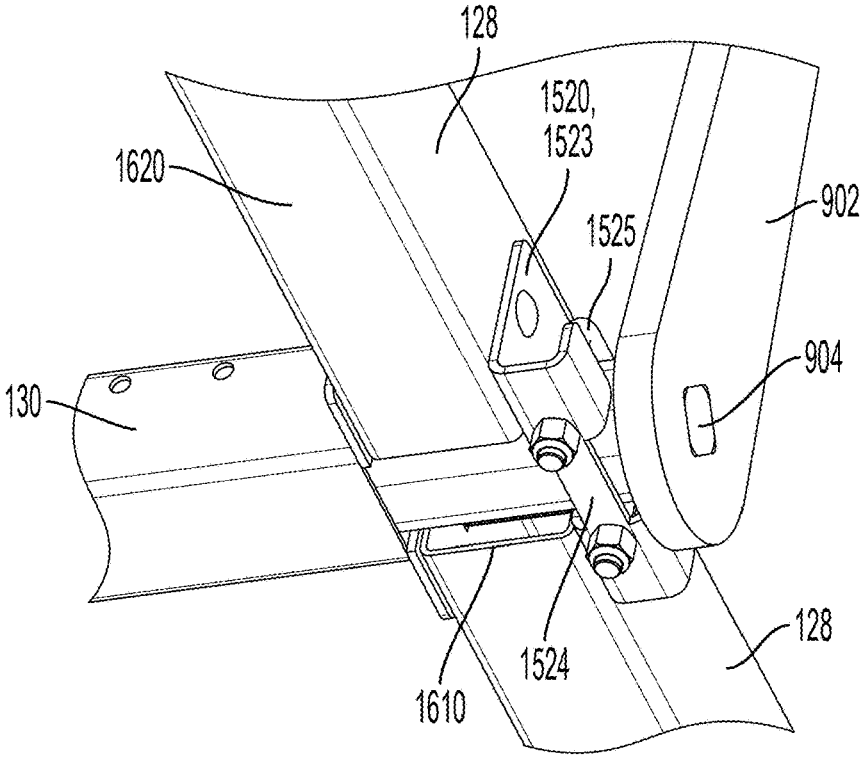
FIG. 16 is a detail bottom perspective view of the torsion assembly of FIG. 9.

The torsion tube 1310 can extend into a hollow interior of a corresponding one of the boat support members 130, as best seen in FIG. 15 wherein the boat support member 130 is illustrated as transparent. As shown in FIGS. 15 and 16, a tube end portion 1510 of the torsion tube 1310 can extend outward beyond the boat support member 130 and can traverse the corresponding first or second side base member 128,130 (second base member 130 shown in FIG. 1) within a tube notch 1610 (shown in FIG. 16) thereof. The tube notch 1610 can be formed in a bottom side 1620 (shown in FIG. 16) of the corresponding first or second side base member 128,130 in the present aspect. In the present aspect, a distal edge of the tube end portion 1510 can confront an inner arm surface 1514 of the torsion arm 902. The spindle end portion 1314 of the torsion spindle 904 can extend outward beyond the distal edge of the tube end portion 1510 to engage the spindle opening 1312 of the torsion arm 902.

Moreover, the tube end portion 1510 can be supported by a torsion bracket 1520 secured to the corresponding first or second side base member 128, opposite the corresponding boat support member 130. According to example aspects, the torsion bracket 1520 can define a tube opening 1522 formed in a tube portion 1523 thereof, through which the tube end portion 1510 can extend. The torsion bracket 1520 can further define a lower support portion 1524 on which the tube end portion 1510 can be supported, as shown. In some aspects, a U-bolt 1525, or other suitable fastener, can be provided for clamping the tube end portion 1510 against the lower support portion 1524 of the torsion bracket 1520.

In example aspects, various components of the of the lift frame 110 can be formed as substantially hollow tubes, including, for example and without limitation, the first and second side base members 126,128, the boat support members 130, the first and second front base members 140,142, the curved swing arms 162, the vertical swing rails 164, the upper side rails 166, and the torsion tubes 1310. In some aspects, the substantially hollow tubes can be formed as extruded metal tubes.

Figure 17:
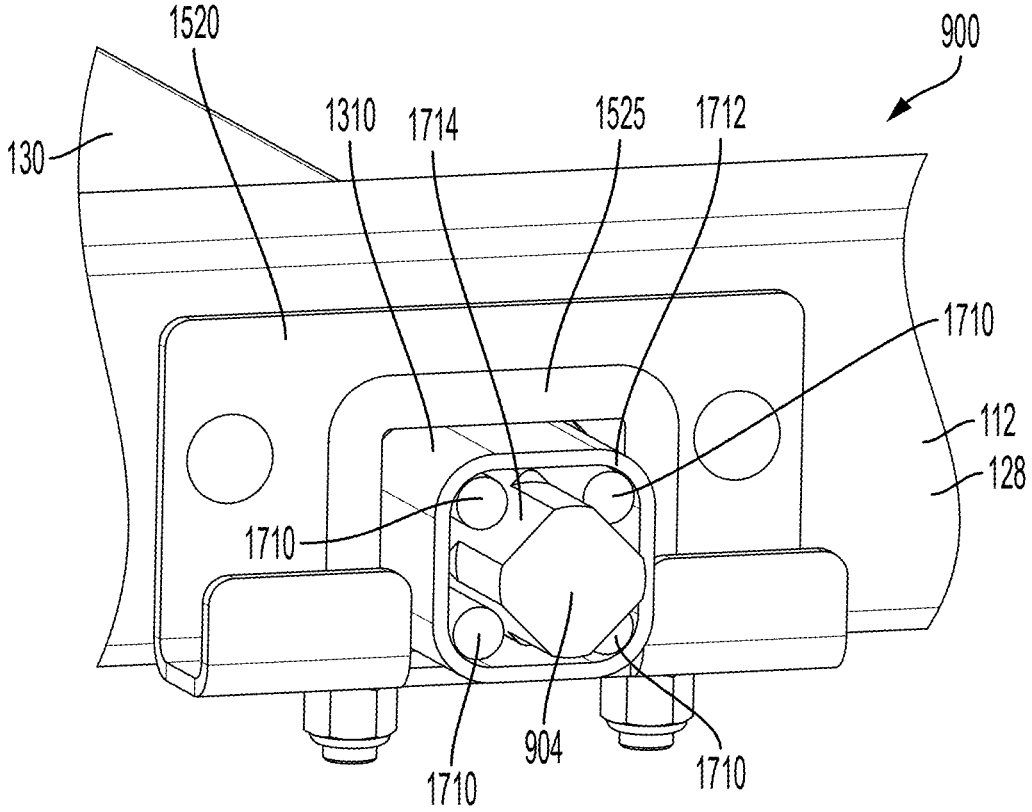
FIG. 17 is a detail right perspective view of a torsion spindle of the torsion assembly of FIG. 9.
Figure 18:
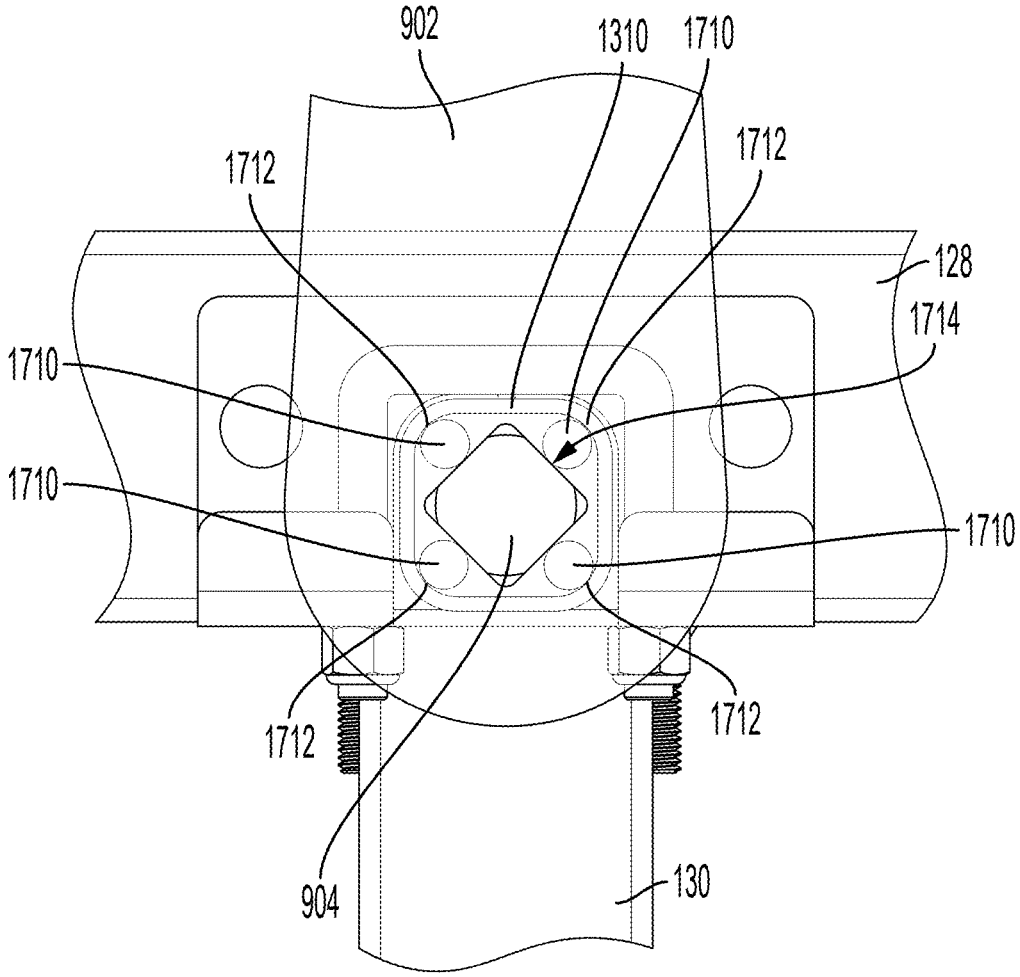
FIG. 18 is a detail right side view of the torsion assembly of FIG. 9.
Figure 19:
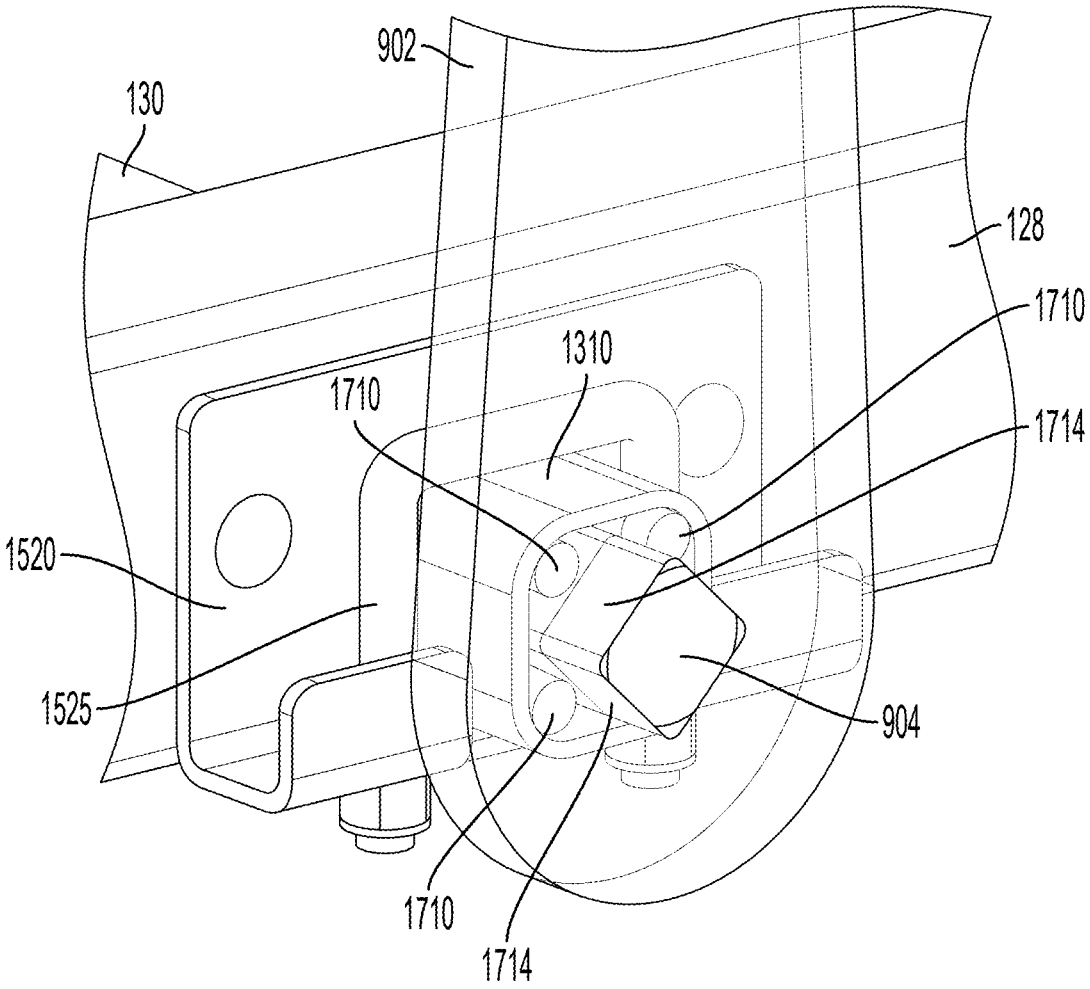
FIG. 19 is a detail right perspective view of the torsion assembly of FIG. 9.

Referring to FIGS. 17-19, the torsion spindle 904 can be suspended within the hollow interior of the torsion tube 1310 by the resilient cords 1710. In the present aspect, the torsion assembly 900 can define four of the resilient cords 1710, each arranged within a corresponding interior corner 1712 of the torsion tube 1310. Each of the resilient cords 1710 can abut a corresponding spindle face 1714 of the torsion spindle 904, as shown. The resilient cords 1710 can provide shock absorption as a boat is driven onto or off of the base portion 112 of the lift frame 110 and/or as the lift frame 110 is raised and lowered. According to example aspects, a length of the resilient cords 1710 can be selected to provide the desired level of shock absorption.

Figure 33:
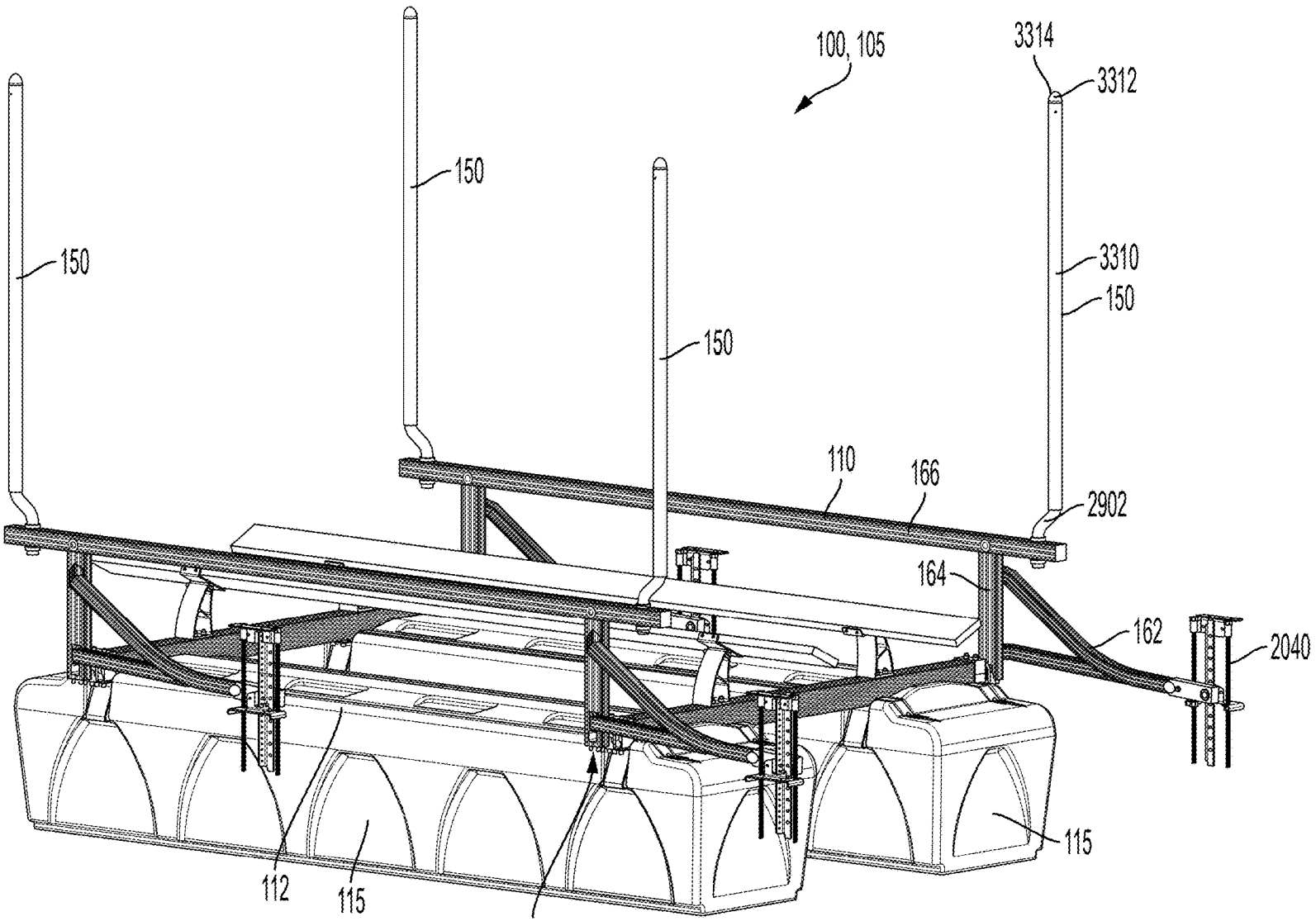
FIG. 33 illustrates the boat lift of FIG. 20, wherein the boat lift is configured in a raised position.
Figure 34:
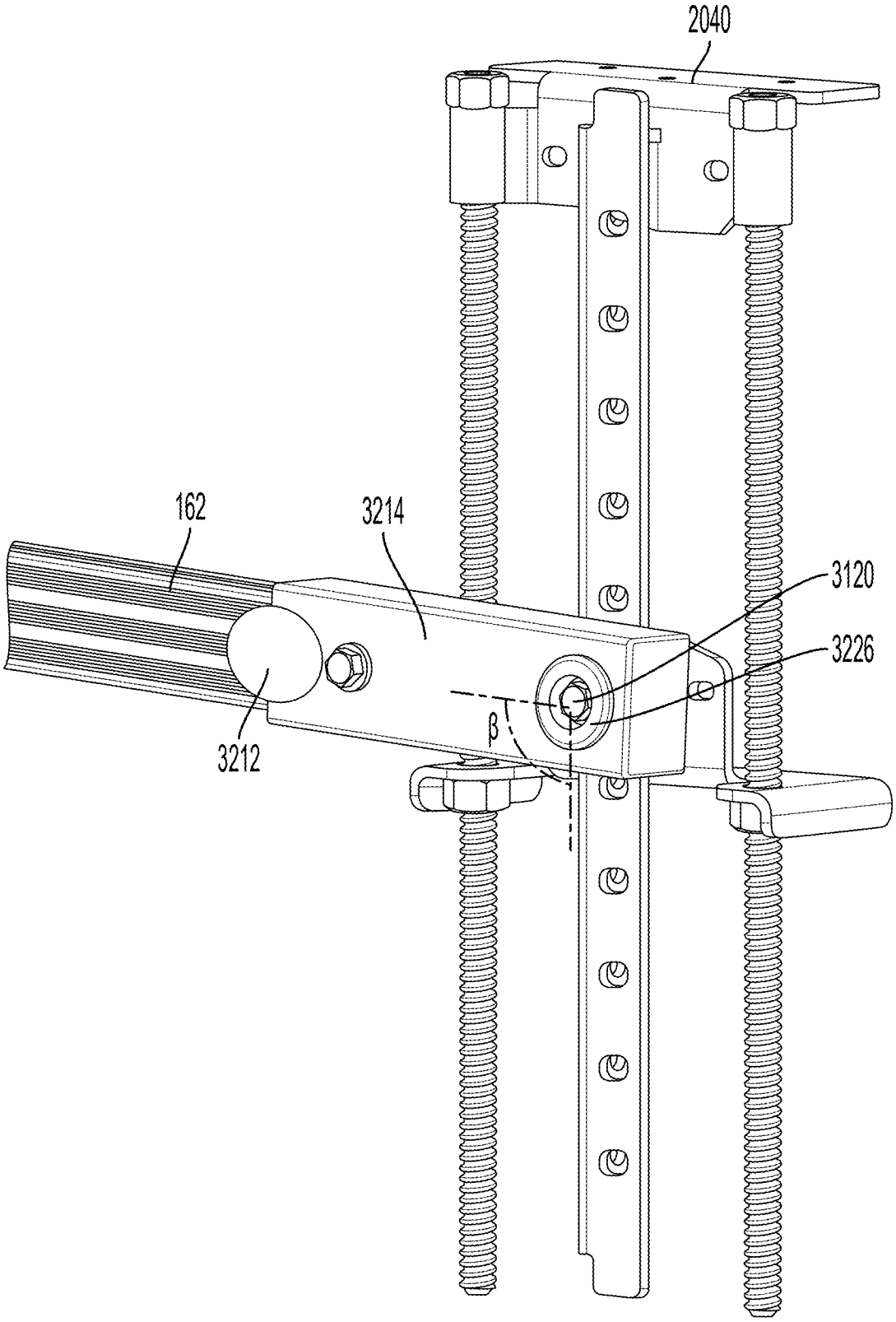
FIG. 34 illustrates the swing arm of the boat lift of FIG. 20, wherein the boat lift is configured in the raised position.
Figure 35:
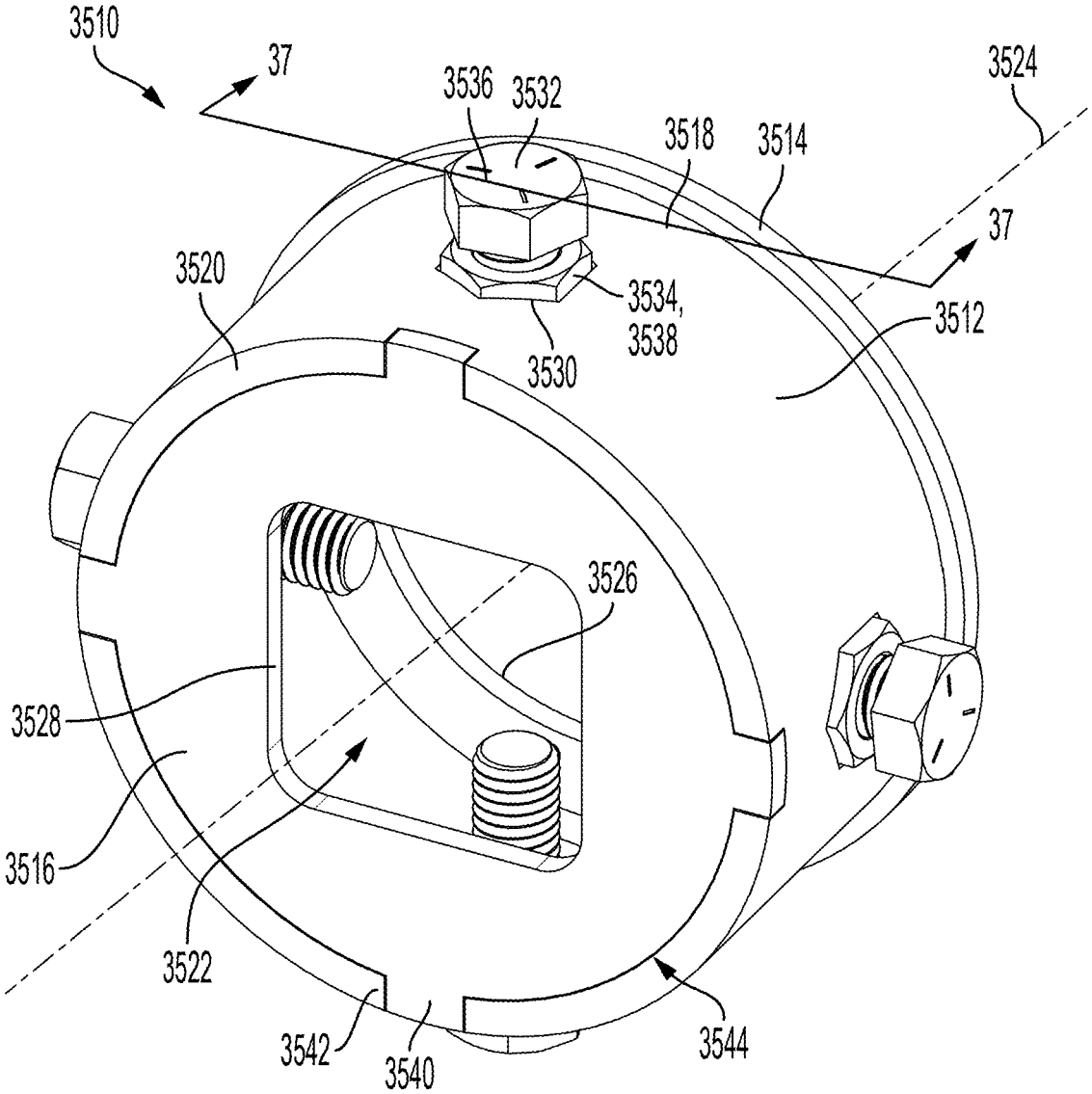
FIG. 35 illustrates a front top right perspective view of a cuff lock assembly, in accordance with another example aspect of the present disclosure.

FIGS. 20-34 illustrate the boat lift 105 in accordance with another example aspect of the present disclosure. Similar to the boat lift 105 previously described, the boat lift 105 can comprise the lift frame 110 mounted to the one or more lift floats 115. The lift frame 110 can comprise the base portion 112 and the substantially upright portion 114 pivotably coupled to the base portion 112. As previously described, to facilitate driving a boat (or other water vehicle) on or off the lift frame 110 in the body of water, air can be let out of the lift floats 115 to sink the lift floats 115 and at least the base portion 112 of the lift frame 110 down into the body of water. Similarly, air can be pumped into the lift floats 115 to raise the lift floats 115 up in the body of water. As such, the boat lift 105 can be oriented in the lowered position, as shown in FIGS. 20-32B, and the raised position, as shown in FIGS. 33 and 34.

The base portion 112 can comprise the substantially parallel first side base member 126 and second side base member 128. In the present aspect, the base portion 112 can also comprise substantially parallel first and second inward side base members 2010,2012 arranged inward from the corresponding first and second side base members 126,128. The first side base member 126 and the first inward side base member 2010 can be attached to the first side float 116, while the second side base member 128 and the second inward side base member 2012 can be attached to the second side float 117.

The base portion 112 can further comprise a pair of the boat support members 130 extending transversely between the first side base member 126 and the second side base member 128, such as a front boat support member 130*a* and a rear boat support member 130*b*. Each of the boat support members 130 can define a first member side 2018 extending outward beyond in the first side base member 126 and opposite second member side 2020 extending outward beyond the second side base member 128. In the present aspect, the boat support members 130 can be substantially linear. In other aspects, the boat support members 130 may not be substantially linear (for example, the boat support members 130 may define the V-shaped portion 132 shown in FIG. 1). Moreover, other aspects can comprise more or fewer boat support members 130.

A pair of first bunk brackets 2022*a* can be mounted to the front boat support member 130*a*, and a pair of second bunk bracket 2022*b* can be mounted to the rear boat support member 130*b*. In example aspects, each of the first and second bunk brackets 2022*a,b* can be slidably mounted to the corresponding front and rear boat support member 130*a,b*, as described in further detail below. The bunk brackets 2022 can support corresponding bunk boards 2026. A first bunk board 2026*a* can be mounted on and can extend between a corresponding pair of the first and second bunk brackets 2022*a,b*, and a second bunk board 2026*b* can be mounted on and extend between another corresponding pair of the first and second bunk brackets 2022*a,b*. The first and second bunk boards 2026*a*,2026*b* can extend about parallel to the first and second side base members 126,128 and about orthogonal to the boat support members 130. The first and second bunk boards 2026*a*,2026*b* can be angled inward towards each other, as shown. According to example aspects, the first and second bunk boards 2026*a*,2026*b* can be configured to support the boat (or other water vehicle) thereon.

The upright portion 114 of the lift frame 110 can be coupled to and can extend generally upward from the base portion 112 of the lift frame 110. More specifically, in the present aspect, the upright portion 114 can be coupled to and can extend generally upward from the front and rear boat support member 130*a,b*. The upright portion 114 can comprise one of the upright frame assemblies 160 at each of the first lift side 120 and the second lift side 122. In the present aspect, each upright frame assembly 160 can comprise a pair of the swing arms 162 (e.g., a front swing arm 162*a* and a rear swing arm 162*b*), a pair of the vertical swing rails 164 (e.g., a front vertical swing rail 164*a* and a rear vertical swing rail 164*b*), and the upper side rail 166 extending substantially horizontally between the pair of vertical swing rails 164. The pair of swing arms 162 can be curved in example aspects, as shown. In other aspects, the swing arms 162 may not be curved.

Each of the curved swing arms 162 can be coupled to a corresponding one of the vertical swing rails 164 at a first swing arm end 2034 of the curved swing arm 162. For example, each of the curved swing arms 162 can be welded or otherwise fixedly attached to the corresponding vertical swing rail 164. The curved swing arm 162 can be coupled to the vertical swing rail 164 at any suitable location along the vertical swing rail 164 between the upper rail end 174 and the lower rail end 176 thereof. A swing arm brace 2038 can extend between each curved swing arm 162 and the corresponding vertical swing rail 164.

A second swing arm end 2036 of each curved swing arm 162 can be pivotably coupled to a corresponding dock mounting assembly 2040 of the boat lift 105, as shown and described in further detail with respect to FIGS. 31A-32B. Each of the dock mounting assemblies 2040 can be mounted to the dock or other structure by one or more of the mounting brackets 510, such as the upper mounting bracket 510*a* and the lower mounting bracket 510*b*. The dock mounting assemblies 2040 can allow the lift frame 110 and the lift float 115 to be raised and lowered relative to the dock via the dock mounting assemblies 2040. As described in further detail below, the second swing arm end 2036 of each curved swing arm 162 can comprise a shock absorber 3230, which can be a bellows 3230 (shown in FIG. 32B), for example, or any other suitable spring-like or resilient mechanism, to provide shock absorption when a boat is driven onto or off of the base portion 112 of the lift frame 110, as the lift frame 110 raises and lowers, in response to waves, wind, and changing water levels, etc.

The upper rail end 174 of each vertical swing rail 164 can be pivotably coupled to the corresponding upper side rail 166 by a rail pivot bushing 2042 or any other suitable pivot mechanism. The lower rail end 176 of each vertical swing rail 164 can be pivotably coupled to the base portion 112 of the lift frame 110 by one of the torsion assemblies 2100 (shown in FIG. 21A). The torsion assemblies 2100 of the present aspect can differ from the torsion assemblies 900 previously described and are shown and described in further detail with reference to FIGS. 21A-25C.

Additionally, one or more of the vertical boat guides 150 can be mounted to each of the upper side rails 166 to facilitate guiding a front end of a boat onto the boat lift 105. Example aspects of the vertical boat guides 150 can be selectively moveable inward and outward to adjust a distance between the each of the vertical boat guides 150 at the first lift side 120 and a corresponding one of the vertical boat guides 150 at the second lift side 122. The adjustable distance between the vertical boat guides 150 at the first lift side 120 and the second lift side 122 can allow the boat lift 105 to accommodate boats of varying widths. That is, the vertical boat guides 150 at the first lift side 120 and/or the second lift side 122 can be adjusted inward to aid in guiding boats of a smaller width onto the boat lift 105 and can be adjusted outward to aid in guiding boats of a larger width onto the boat lift 105. The adjustable vertical boat guides 150 are shown and described in further detail with reference to FIGS. 29A-30B.

In example aspects, various components of the of the lift frame 110 can be formed as substantially hollow tubes, including, for example and without limitation, the side base members 126,128, the inward side base members 2010, 2012, the boat support members 130, the swing arms 162, the swing arm braces 2038, the vertical swing rails 164, the upper side rails 166, various components of a torsion assembly 2100, and various components of the vertical boat guides 150. In some aspects, the substantially hollow tubes can be formed as extruded metal tubes. In other aspects, any or all of the substantially hollow tubes can comprise any other suitable material and/or can be formed by any other suitable manufacturing method.

Figure 21A:
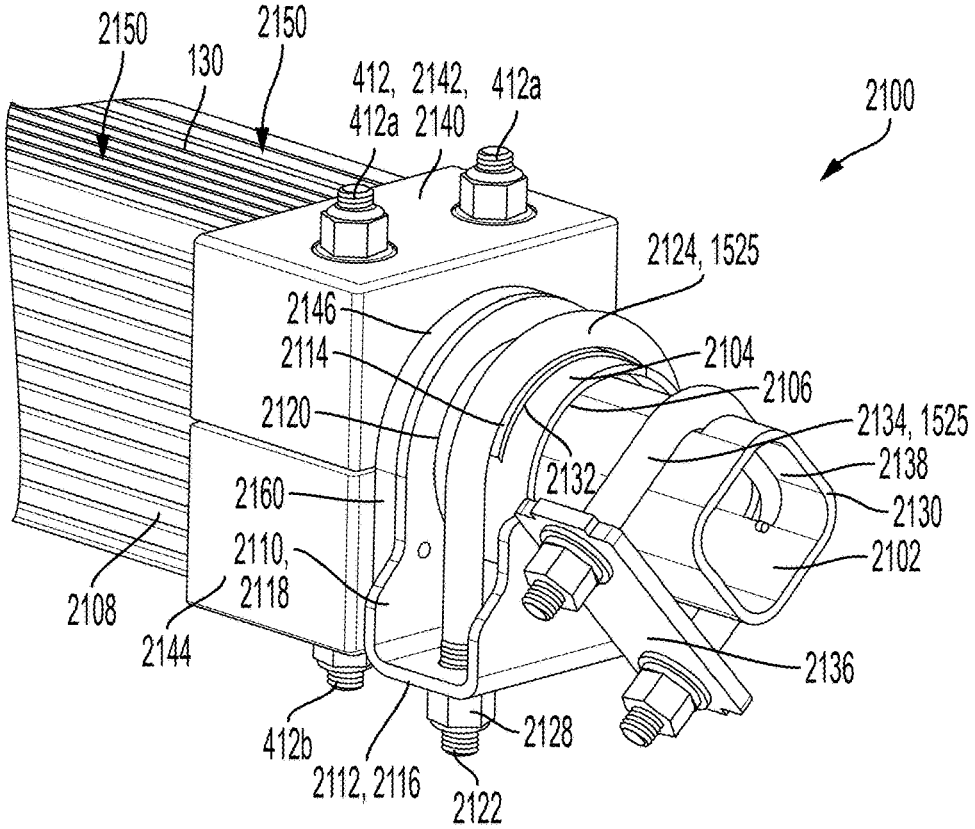
FIG. 21A is a detail right perspective view of one of the torsion assemblies of the boat lift of FIG. 20.
Figure 21B:
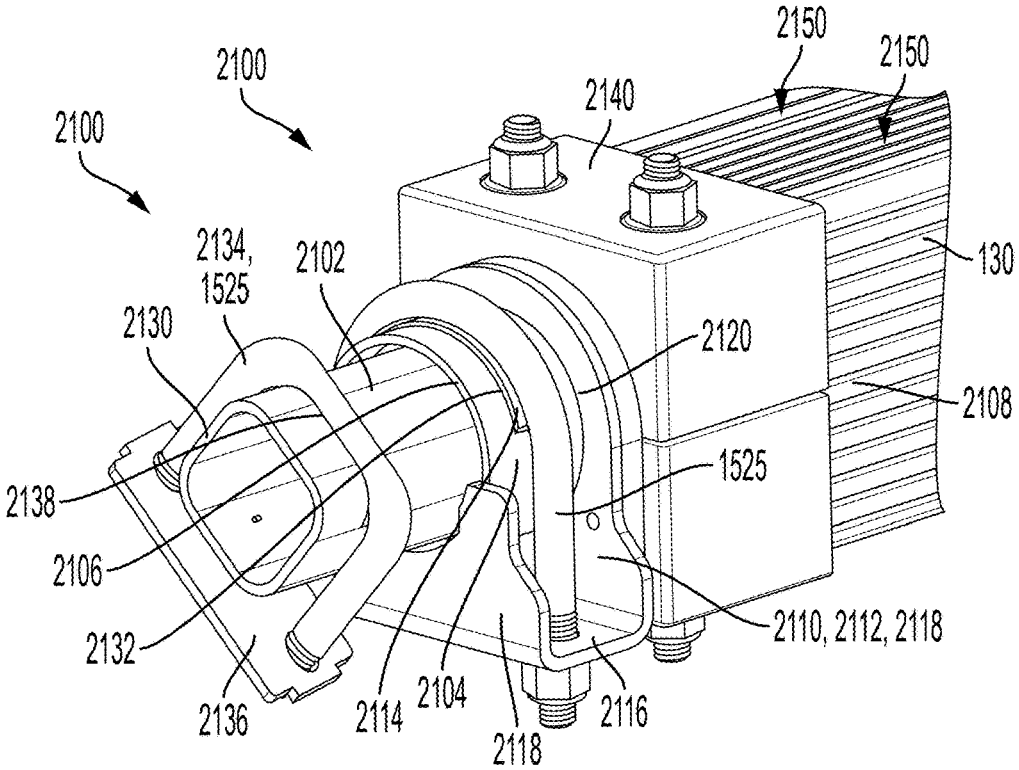
FIG. 21B is a detail left perspective view of the torsion assembly of FIG. 21A.

FIGS. 21A and 21B illustrate one of the torsion assemblies 2100 pivotably coupled to a corresponding one of the boat support members 130. According to example aspects, the torsion assembly 2100 can comprise a center torsion tube 2102 and a main axle 2104. The main axle 2104 can be formed as a substantially cylindrical tube, which can extend longitudinally through a hollow interior the boat support member 130. The main axle 2104 can be configured to rotate within the hollow interior of the boat support member 130. As shown, opposing axle ends 2106 of the main axle 2104 can extend outward beyond opposing support member ends 2108 of the boat support member 130. In example aspects, each main axle 2104 can service an opposing pair of the torsion assemblies 2100 (i.e., one of the torsion assemblies 2100 at each of the opposing axle ends 2106).

The center torsion tube 2102 can extend longitudinally into a hollow interior of the main axle 2104, at a corresponding one of the opposing axle ends 2106. In example aspects, the center torsion tube 2102 can extend only partially through the main axle 2104. Example aspects of the center torsion tube 2102 can define a substantially square cross-sectional shape. The center torsion tube 2102 can be secured to and substantially fixed relative to the main axle 2104 by a lock assembly 2110. The lock assembly 2110 can comprise an axle clamp 2112, a substantially U-shaped tube retainer 2114, and a clamp fastener, such as a U-bolt 1525 or any other suitable bolt or fastener. The axle clamp 2112 can define a base portion 2116 and a mount portion 2118. The mount portion 2118 can define an axle opening 2120 therethrough. The axle end 2106 of the main axle 2104 can extend through the axle opening 2120.

The axle end 2106 can further define a substantially U-shaped, circumferential axle slot 2132. The tube retainer 2114 can be positioned within the U-shaped axle slot 2132 and can engage the center torsion tube 2102 to hold the center torsion tube 2102 in position relative to the main axle 2104. The U-bolt 1525 can define a pair of free bolt ends 2122 and a closed bolt end 2124 opposite the pair of free bolt ends 2122. The U-bolt 1525 can partially surround a bolt channel. An outer tube end 2130 of the center torsion tube 2102 and the axle end 2106 of the main axle 2104 can extend transversely through the bolt channel.

The closed bolt end 2124 of the U-bolt 1525 can be aligned with the tube retainer 2114, and the free bolt ends 2122 can extend through the base portion 2116 of the axle clamp 2112. Nuts 2128 can be tightened on the free bolt ends 2122 of the U-bolt 1525 to clamp the closed bolt end 2124 of the U-bolt 1525 against the tube retainer 2114, which in turn can bias the substantially U-shaped tube retainer 2114 against the center torsion tube 2102. The center torsion tube 2102 can nest within the tube retainer 2114, and the position of the tube retainer 2114 within the axle slot 2132 can prohibit rotation of the center torsion tube 2102 relative to the main axle 2104.

The outer tube end 2130 of the torsion tube 2102 can extend outward beyond the corresponding axle end 2106 of the main axle 2104. The outer tube end 2130 can extend transversely into a rail opening 2032 (shown in FIG. 20) proximate the lower rail end 176 of the vertical swing rail 164 (shown in FIG. 20). The vertical swing rail 164 can be coupled to the outer tube end 2130 of the center torsion tube 2102 via a rail fastener assembly 2134. In the present example aspect, the rail fastener assembly 2134 can comprise another one of the U-bolts 1525 (or any other suitable bolt or fastener) and a rail cap 2136. The torsion tube 2102 can define a tube groove 2138 oriented within an interior of the vertical swing rail 164.

The U-bolt 1525 can define the pair of free bolt ends 2122 and the closed bolt end 2124 opposite the pair of free bolt ends 2122. The closed bolt end 2124 of the U-bolt 1525 can extend into the vertical swing rail 164 at the lower rail end 176. The U-bolt 1525 can partially surround the bolt channel. The center torsion tube 2102 can extend transversely through the bolt channel, as shown. The rail cap 2136 can be mounted to the U-bolt 1525 at the pair of free bolt ends 2122 and can be secured thereto by a pair of nuts 2128. The rail cap 2136 can cover an open bottom side of the vertical swing rail 164. The closed bolt end 2124 of the U-bolt 1525 can nest within a tube groove 2138 of the torsion tube 2102 to fixedly secure the vertical swing rail 164 to the torsion tube 2102.

The torsion assembly 2100, including the main axle 2104, the torsion tube 2102, the lock assembly 2110, and the rail fastener assembly 2134, can be configured to rotate relative to the boat support member 130. The vertical swing rail 164 can be fixedly secured to the torsion assembly 2100, and the vertical swing rail 164 can thereby be pivotably coupled to the boat support member 130.

According to example aspects, an end clamp 2140 can be fixedly mounted to the boat support member 130 at each of the support member ends 2108 thereof. Example aspects of the end clamp 2140 can comprise an upper clamp component 2142 and a lower clamp component 2144. Other aspects can comprise more or fewer clamp components. The upper clamp component 2142 can be secured to the boat support member 130 by a pair of upper nut and bolt assemblies 412*a*, while the lower clamp component 2144 can be secured to the boat support member 130 by a pair of lower nut and bolt assemblies 412*b*. The upper nut and bolt assemblies 412*a* and the lower nut and bolt assemblies 412*b* can be configured to engage corresponding longitudinal slots 2150 formed in the boat support member 130, as described in further detail below. The end clamp 2140 can define a clamp opening 2146 through which the main axle 2104 and the center torsion tube 2102 can extend into the hollow interior of the boat support member 130.

In some aspects, a wear plate 2160 can be arranged between the end clamp 2140 and the mounting portion of the axle clamp 2112. The main axle 2104 and the center torsion tube 2102 can extend through a plate opening in the wear plate 2160. The wear plate 2160 can provide a buffer between the end clamp 2140 and the axle clamp 2112 as the torsion assembly 2100 rotates relative to the boat support member 130. In some aspects, the wear plate 2160 is not affixed to either of the axle clamp 2112 or the end clamp 2140, and can rotate freely therebetween. In other aspects, the wear plate 2160 can be coupled to the axle clamp 2112 and can rotate along with the torsion assembly 2100. In other aspects, the wear plate 2160 can be coupled to the end clamp 2140 and can be fixed relative to the torsion assembly 2100.

Figure 22:
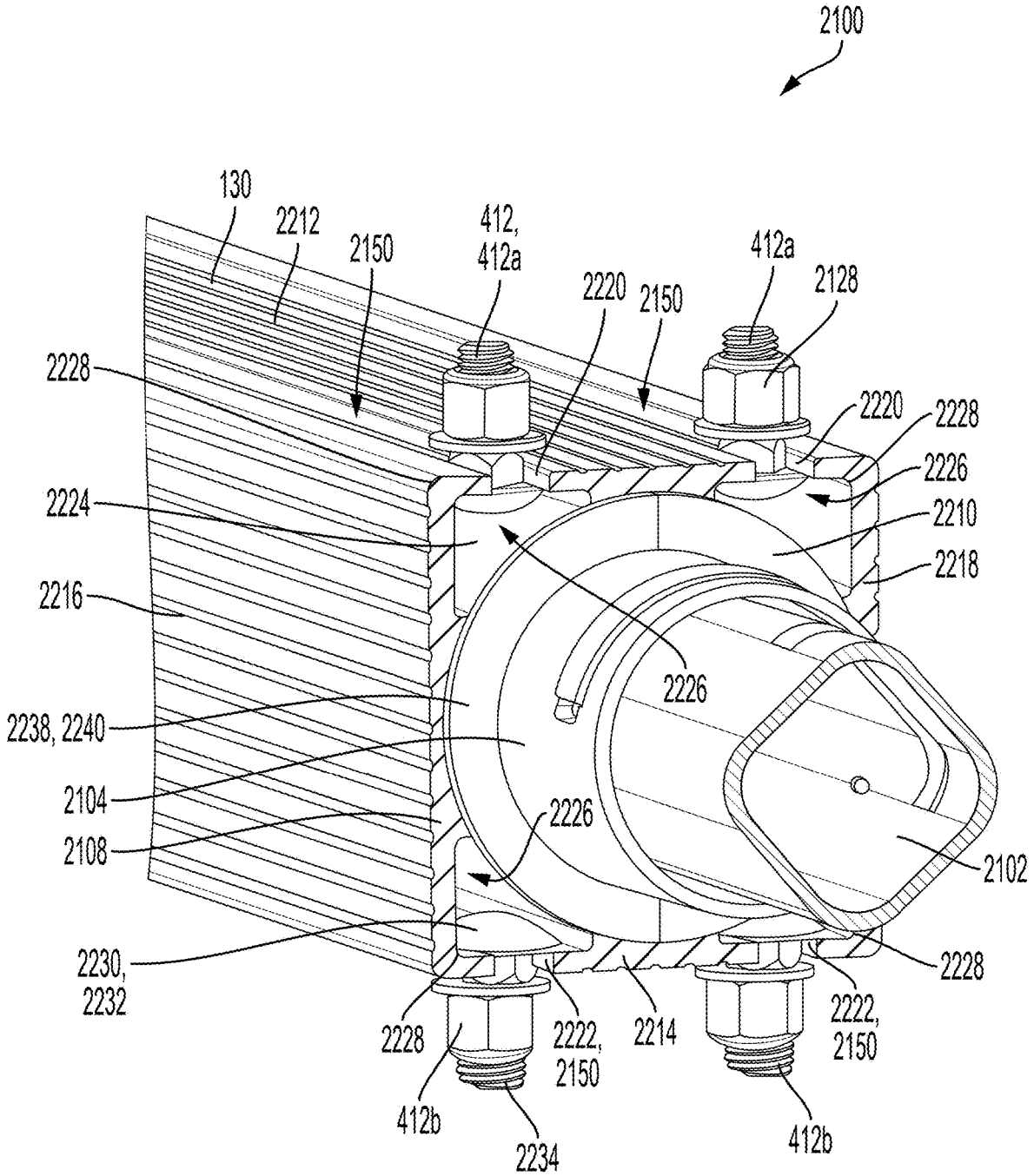
FIG. 22 is a detail right perspective view of the torsion assembly of FIG. 21A with various components removed for partial visibility of a torsion sleeve.
Figure 23:
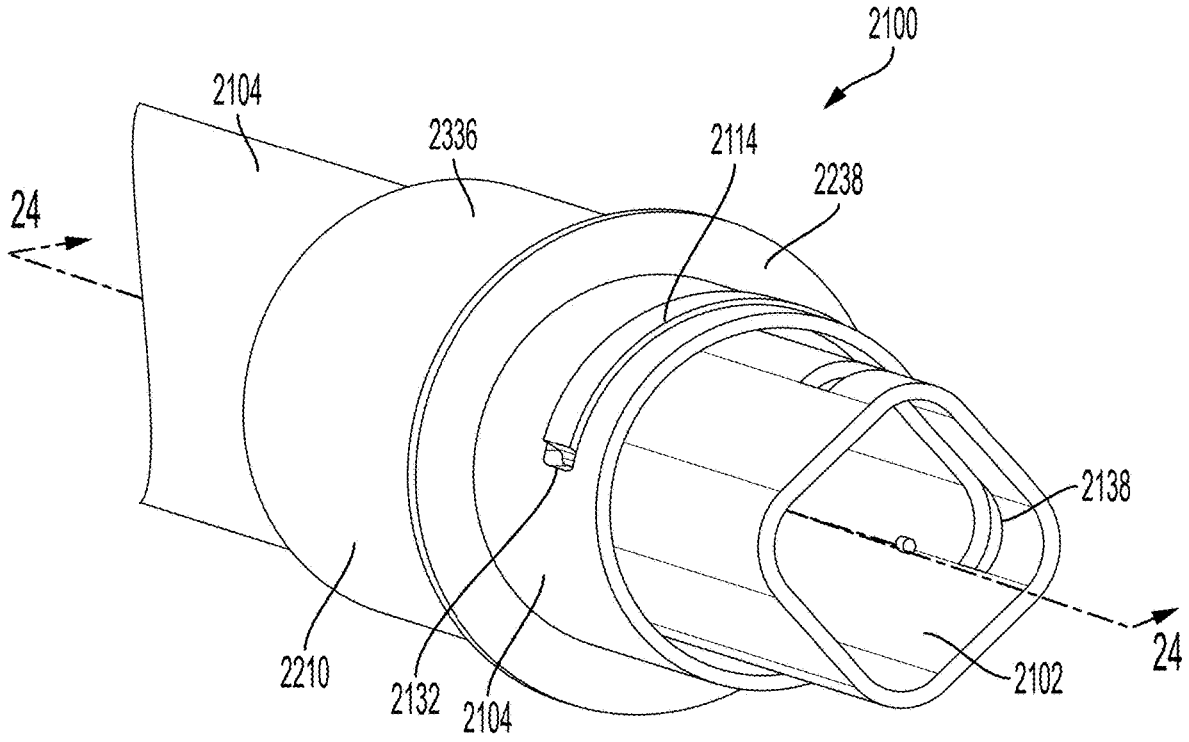
FIG. 23 is a detail right perspective view of the torsion assembly of FIG. 21A with various components removed for full visibility of the torsion sleeve.

FIG. 22 illustrates the torsion assembly 2100 and the boat support member 130 with various components removed for visibility of a torsion sleeve 2210 arranged at the corresponding support member end 2108 of the boat support member 130 and extending into the hollow interior thereof. FIG. 23 illustrates the torsion assembly 2100 with the boat support member 130 removed for further visibility of the torsion sleeve 2210.

According to example aspects, the boat support member 130 can define a substantially square or rectangular cross-sectional shape. Other aspects of the boat support member 130 can define any other suitable cross-sectional shape. The boat support member 130 can define an upper member wall 2212, a lower member wall 2214 opposite the upper member wall 2212, a first member sidewall 2216 and a second member sidewall 2218 opposite the first member sidewall 2216. In example aspects, one or more of the longitudinal slots 2150 can be formed through the upper member wall 2212, and one or more of the longitudinal slots 2150 can be formed through the lower member wall 2214. In the present aspect, the longitudinal slots 2150 can comprise a pair of parallel upper slots 2220 formed through the upper member wall 2212 and a pair of parallel lower slots 2222 formed through the lower member wall 2214. Each of the longitudinal slots 2150 can extend along the length of the boat support member 130. In other aspects, the longitudinal slots 2150 may not extend the full length of the boat support member 130.

In the present aspect, an interior framework 2224 can be formed within the hollow interior of the boat support member 130. The interior framework 2224 can define a substantially cylindrical channel 2610 (shown in FIG. 26) extending centrally through the hollow interior, along the length of the boat support member 130, which can be configured to receive the main axle 2104 and the center torsion tube 2102 therein. The interior framework 2224 can further define one or more longitudinal channels 2226 extending along the length of the boat support member 130. Each of the longitudinal channels 2226 can be aligned with a corresponding one of the longitudinal slots 2150, such that the longitudinal slot 2150 can allow access to the longitudinal channel 2226. In the present aspect, each of the longitudinal channels 2226 can be formed at an interior corner 2228 of the boat support member 130.

As shown, each of the upper nut and bolt assemblies 412*a* for coupling the upper clamp component 2142 (shown in FIG. 21A) to the boat support member 130 can extend through a corresponding one of the upper slots 2220 and can engage the corresponding longitudinal channel 2226. Similarly, each of the lower nut and bolt assemblies 412*b* for coupling the lower clamp component 2144 (shown in FIG. 21A) to the boat support member 130 can extend through a corresponding one of the lower slots 2222 and can engage the corresponding longitudinal channel 2226. More specifically, a head 2232 of a bolt 2230 of the corresponding upper or lower nut and bolt assembly 412*a,b* can be arranged in the corresponding longitudinal channel 2226, the size of which can prohibit the head 2232 from passing through the corresponding longitudinal slot 2150. A threaded shaft 2234 of the bolt 2230 can extend through the corresponding longitudinal slot 2150 and through an opening in the corresponding upper clamp component 2142 or lower clamp component 2144. A nut 2128 of the corresponding nut and bolt assembly 412 can be tightened on the threaded shaft 2234 to secure the corresponding upper clamp component 2142 or lower clamp component 2144 to the boat support member 130.

Each of the nut and bolt assemblies 412 can be mounted to the boat support member 130 by laterally aligning the head 2232 and the threaded shaft 2234 of the bolt 2230 with the corresponding longitudinal channel 2226 and longitudinal slot 2150, respectively, at the corresponding support member end 2108. The head 2232 and the threaded shaft 2234 can be slid into the longitudinal channel 2226 and the longitudinal slot 2150, respectively. In example aspects, additional nut and bolt assemblies 412 can be mounted to the boat support member 130 in the same manner and can be repositioned along the length of the boat support member 130. The position of each of the nut and bolt assemblies 412 can be adjusted by sliding the head 2232 and the threaded shaft 2234 of the bolt 2230 within the corresponding longitudinal channel 2226 and longitudinal slot 2150 to a desired location. For example, additional nut and bolt assemblies 412 may be provided for mounting the first and second bunk brackets 2022*a,b* (shown in FIG. 20) to the corresponding boat support member 130, as shown and described in further detail with reference to FIGS. 28A and 28B.

Example aspects of the torsion sleeve 2210 can comprise a substantially cylindrical sleeve body 2336 (shown in FIG. 23) and a substantially annular sleeve flange 2238 extending radially outward from the sleeve body 2336 at an outer sleeve end 2240 of the torsion sleeve 2210. The torsion sleeve 2210 can define a sleeve channel 2442 (shown in FIG. 24) through which the main axle 2104 and the center torsion tube 2102 can extend. The sleeve body 2336 can extend into the hollow interior of the boat support member 130 and the sleeve flange 2238 can abut the support member end 2108. The sleeve flange 2238 can thereby be disposed laterally between the end clamp 2140 (shown in FIG. 21) and the support member end 2108. The interior framework 2224 can define the substantially cylindrical channel 2610, and according to example aspects, the torsion sleeve 2210 can be press fit into the substantially cylindrical channel 2610, such that movement of the torsion sleeve 2210 within the substantially cylindrical channel 2610 can be prohibited.

One of the torsion sleeves 2210 can be arranged at each of the opposing support member ends 2108 of the boat support member 130. The main axle 2104 can extend along the length of the cylindrical channel 2610 and through each of the opposing torsion sleeves 2210. A thickness of the torsion sleeves 2210 can be such that the main axle 2104 can be suspended co-linearly within the cylindrical channel 2610 by the opposing torsion sleeves 2210 and does not contact the interior framework 2224 of the boat support member 130. The main axle 2104 can thereby contact and rotate against the torsion sleeves 2210 as the torsion assembly 2100 pivots relative to the boat support member 130.

Figure 24:
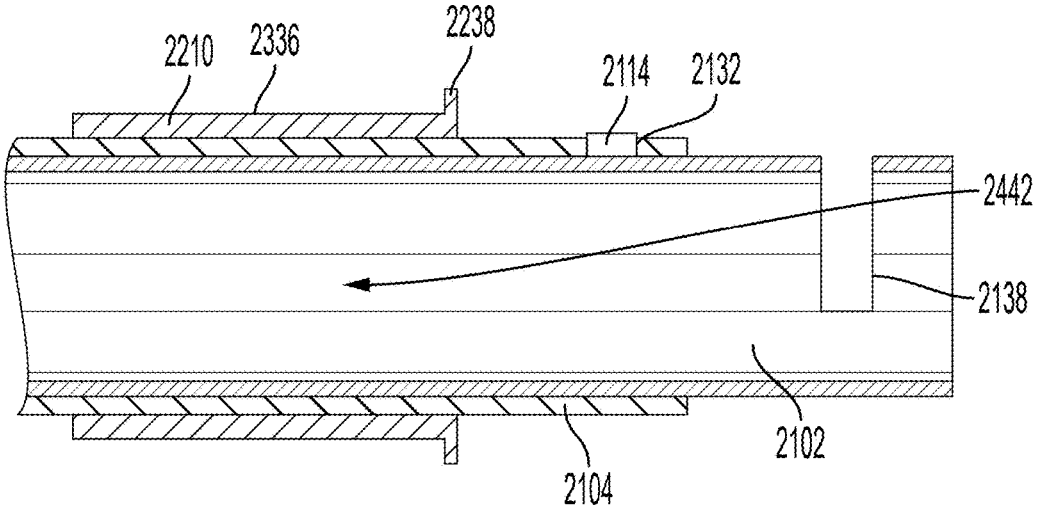
FIG. 24 is a cross-sectional view of the torsion assembly of FIG. 21A taken along line 24-24 in FIG. 23.

FIG. 24 illustrates a cross-sectional view of the center torsion tube 2102 and the main axle 2104 extending through the torsion sleeve 2210.

Figure 25A:
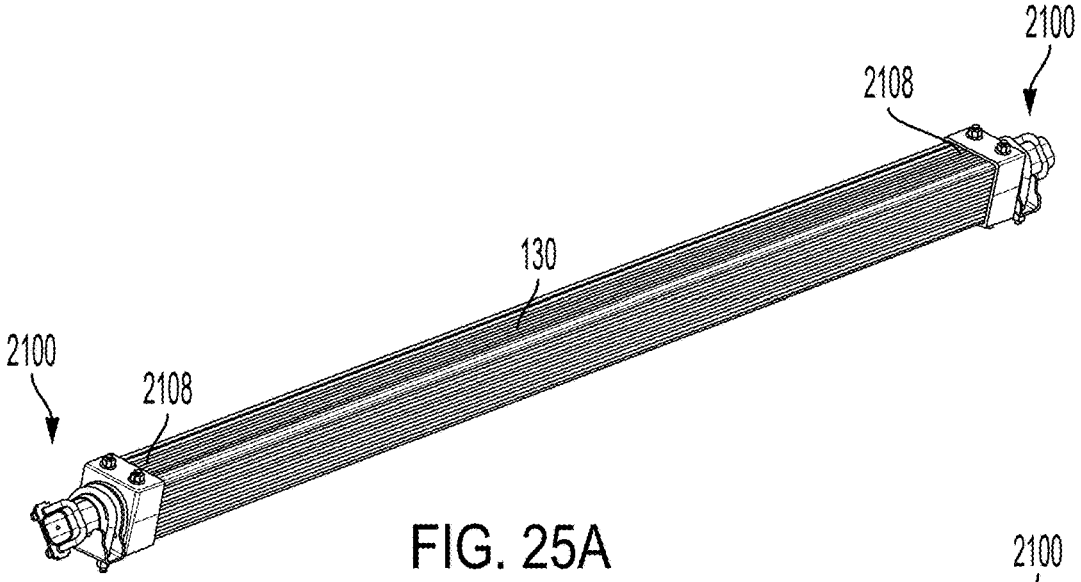
FIG. 25A illustrates a left perspective view of a pivot rail assembly of the boat lift of FIG. 20.
Figure 25B:
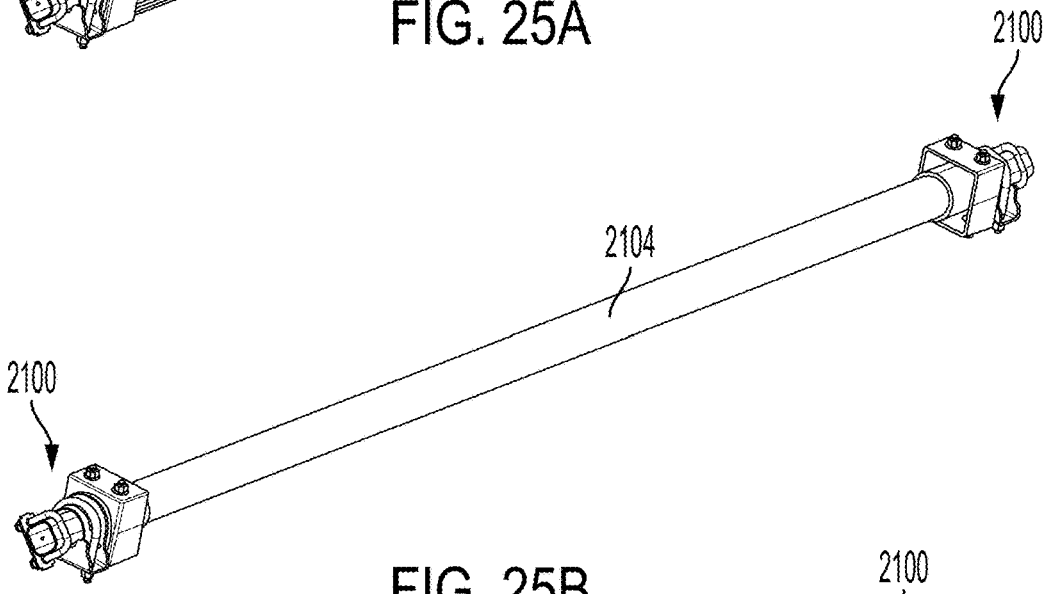
FIG. 25B illustrates a left perspective view of the pivot rail assembly of FIG. 25A with a pivot rail removed.
Figure 25C:
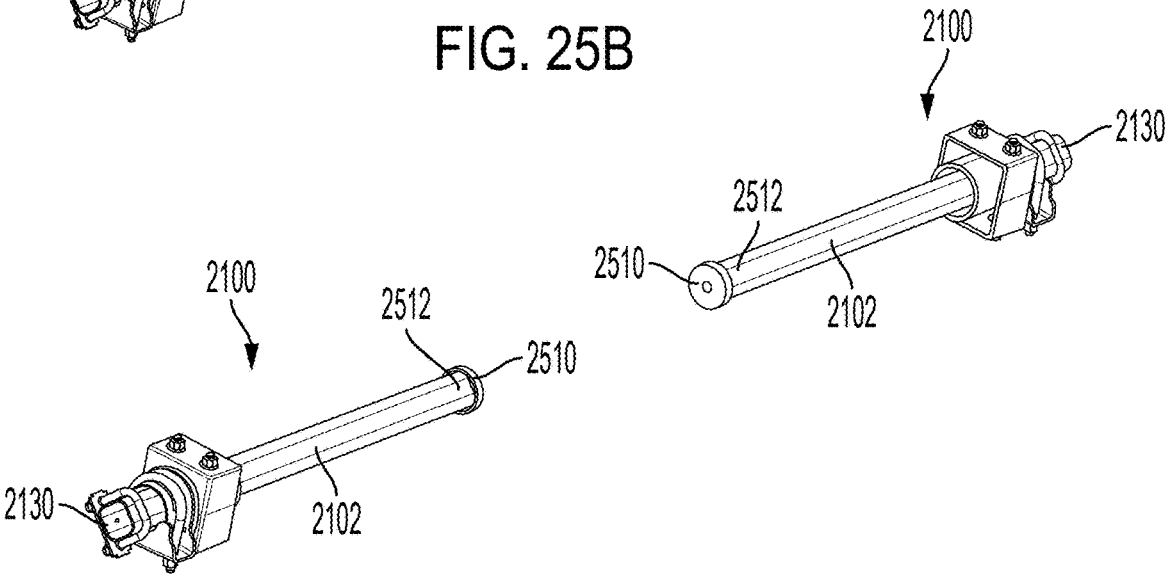
FIG. 25C illustrates a left perspective view of the pivot rail assembly of FIG. 25A with the pivot rail and a main axle removed.

FIG. 25A depicts a pair of the torsion assemblies 2100 arranged at opposing support member ends 2108 of the boat support member 130. FIG. 25B depicts the pair of the torsion assemblies 2100 with the boat support member 130 (shown in FIG. 25A) removed. As shown, a single one of the main axles 2104 can service both of the opposing torsion assemblies 2100. FIG. 25C depicts the pair of the torsion assemblies 2100 with the main axle 2104 (shown in FIG. 25B) removed. As shown, an annular spacer 2510 can be mounted to an inner tube end 2512 of each of the torsion tubes 2102, opposite the outer tube end 2130. The annular spacers 2510 can extend radially outward from the torsion tubes 2102 and can engage an inner surface of the main axle 2104 to maintain the torsion tubes 2102 in coaxial alignment with the main axle 2104.

Figure 26:
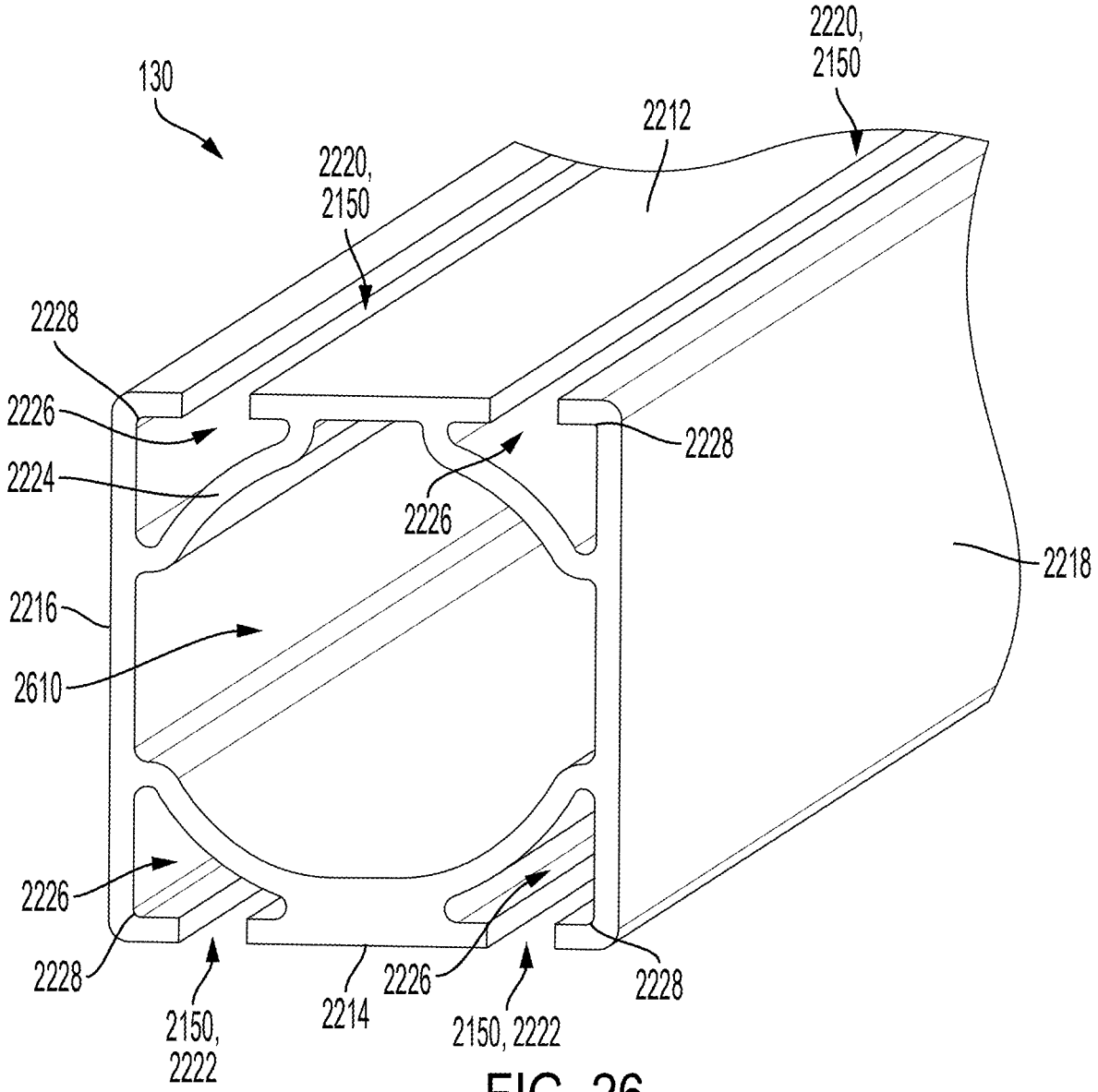
FIG. 26 illustrates a detail end perspective view of the pivot rail of the pivot rail assembly of FIG. 25A.

FIG. 26 illustrates a detail end perspective view of the boat support member 130, in accordance with example aspects. The boat support member 130 can define the substantially square or rectangular cross-sectional shape. Other aspects of the boat support member 130 can define any other suitable cross-sectional shape. The boat support member 130 can define the upper member wall 2212, the lower member wall 2214, the first member sidewall 2216, and the second member sidewall 2218. One or more of the longitudinal slots 2150 can be formed through the upper member wall 2212, and one or more of the longitudinal slots 2150 can be formed through the lower member wall 2214. In the present aspect, the longitudinal slots 2150 can comprise the pair of upper slots 2220 formed through the upper member wall 2212 and the pair of lower slots 2222 formed through the lower member wall 2214.

The interior framework 2224 of the boat support member 130 can be formed within the hollow interior of the boat support member 130. The interior framework 2224 can define the substantially cylindrical channel 2610 extending centrally through the hollow interior, along the length of the boat support member 130, which can be configured to receive the main axle 2104 (shown in FIG. 21A) and the center torsion tube 2102 (shown in FIG. 21A). The interior framework 2224 can further define the one or more longitudinal channels 2226 extending along the length of boat support members 130. Each of the longitudinal channels 2226 can be aligned with a corresponding one of the longitudinal slots 2150, such that the longitudinal slot 2150 can allow access to the longitudinal channel 2226. In the present aspect, each of the longitudinal channels 2226 can be formed proximate a corresponding one of the interior corners 2228 of the boat support member 130.

Figure 27:
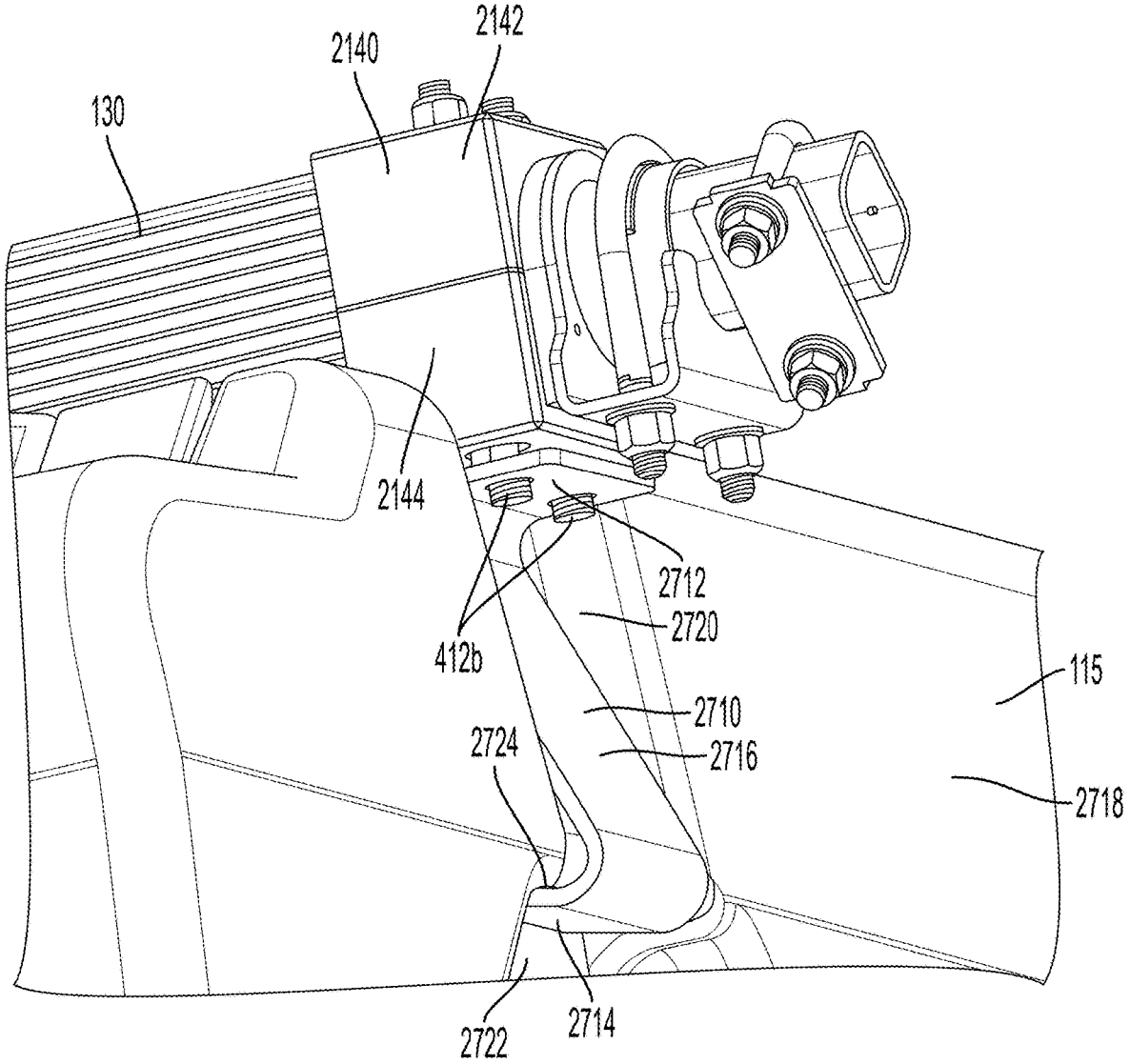
FIG. 27 illustrates a bottom perspective view of the pivot rail assembly of FIG. 25A attached to a float.

FIG. 27 illustrates a bottom perspective view of the boat support member 130 coupled to one of the lift floats 115 by a float bracket 2710. The float bracket 2710 can be substantially Z-shaped in the present aspect. The float bracket 2710 can define an upper shelf 2712, a lower shelf 2714, and a middle bracket portion 2716 extending between the upper shelf 2712 and the lower shelf 2714. The upper shelf 2712 can be coupled to the end clamp 2140 by the pair of lower nut and bolt assemblies 412*b*. The middle bracket portion 2716 can extend along a first float side 2718 of the lift float 115. In some aspects, the middle bracket portion 2716 can nest within a bracket groove 2720 of the lift float 115, as shown. The lower shelf 2714 can engage a bracket indentation 2722 formed in the lift float 115 and can hook underneath a bracket ledge 2724 defined by the bracket indentation 2722.

Figure 28A:
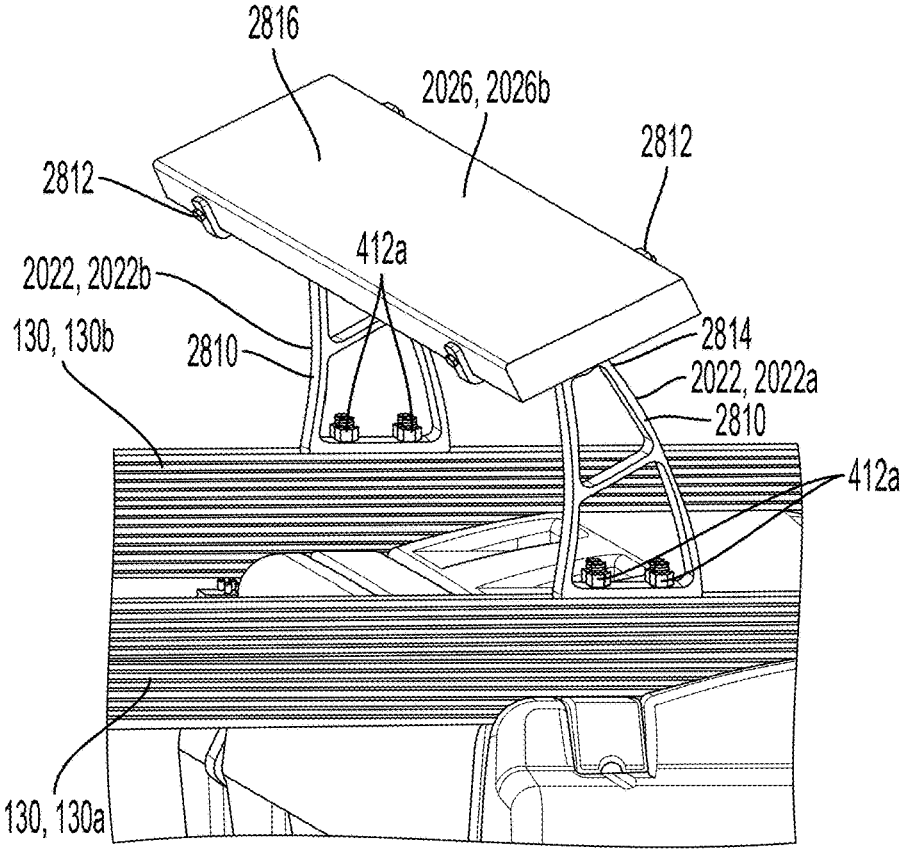
FIG. 28A illustrates a top perspective view of a bunk of the boat lift of FIG. 20 supported on a pair of bunk bracket.
Figure 28B:
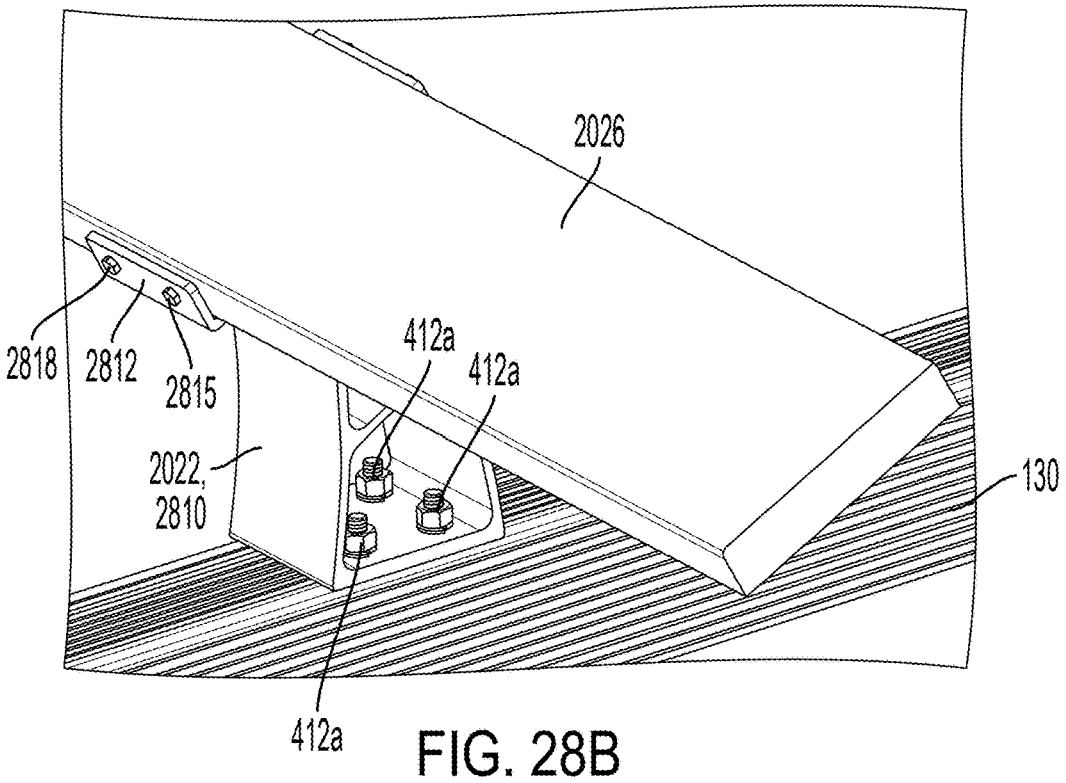
FIG. 28B is a detail top perspective view of the bunk and one of the bunk brackets of FIG. 28A.

FIGS. 28A and 28B illustrate perspective and detail perspective views, respectively, of one of the bunk boards 2026 (e.g., the second bunk board 2026*b*) mounted to the front boat support member 130*a* and the rear boat support member 130*b* by the corresponding first and second bunk brackets 2022*a,b*. Each of the bunk brackets 2022 can define a support portion 2810 and a bracket portion 2812. The support portion 2810 of each bunk bracket 2022 can be secured to the corresponding boat support member 130 by one or more of the upper nut and bolt assemblies 412*a*, or any other suitable fastener. In the present aspect, the support portion 2810 can be secured to corresponding boat support member 130 by four of the upper nut and bolt assemblies 412*a*. A first pair of the four upper nut and bolt assemblies 412*a* can engage and slide within a first one of the upper slots 2220 (shown in FIG. 22) of the boat support member 130, and a second pair of the four upper nut and bolt assemblies 412*a* can engage and slide within a second one of the upper slots 2220 of the boat support member 130. The sliding engagement of the upper nut and bolt assemblies 412*a* with the corresponding boat support member 130 can allow the bunk brackets 2022 and corresponding bunk boards 2026 to be selectively repositioned along the length of the boat support member 130 to accommodate boats of varying sizes.

The bracket portion 2812 can be formed at a distal support end 2814 of the support portion 2810, distal to the boat support member 130. The support portion 2810 can therefore elevate the bracket portion 2812 over the corresponding boat support member 130. The bracket portion 2812 can be secured to the corresponding bunk board 2026 to couple the bunk bracket 2022 to the bunk board 2026 and to mount the bunk board 2026 above the boat support member 130. In example aspects, the bracket portion 2812 can be substantially U-shaped, and the bunk board 2026 can be configured to nest therein. Fasteners 2818 (shown in FIG. 28B), such as screws, bolts, rivets, or any other suitable fasteners, can be provided for securing the bunk board 2026 to the bracket portion 2812. The U-shaped bracket portion 2812 can be angled inward relative to the support portion 2810, such that the bunk board 2026 supported thereon can be angled inward, as shown. That is, an upper support surface 2816 of the first bunk board 2026*a* (shown in FIG. 20) can be angled towards the second bunk board 2026*b*, and the upper support surface 2816 of the second bunk board 2026*b* can be angled towards the first bunk board 2026*a*.

FIGS. 29A-30B illustrates various view and components of a boat guide assembly 2900 comprising one of the vertical boat guides 150. The vertical boat guide 150 can be rotationally coupled to a corresponding one of the upper side rails 166. In the present aspect, a first pair of the vertical boat guides 150 can be coupled to the upper side rail 166 arranged at the first lift side 120 (shown in FIG. 20), and a second pair of the vertical boat guides 150 can be coupled to the upper side rail 166 arranged at the second lift side 122 (shown in FIG. 20).

Figure 29A:
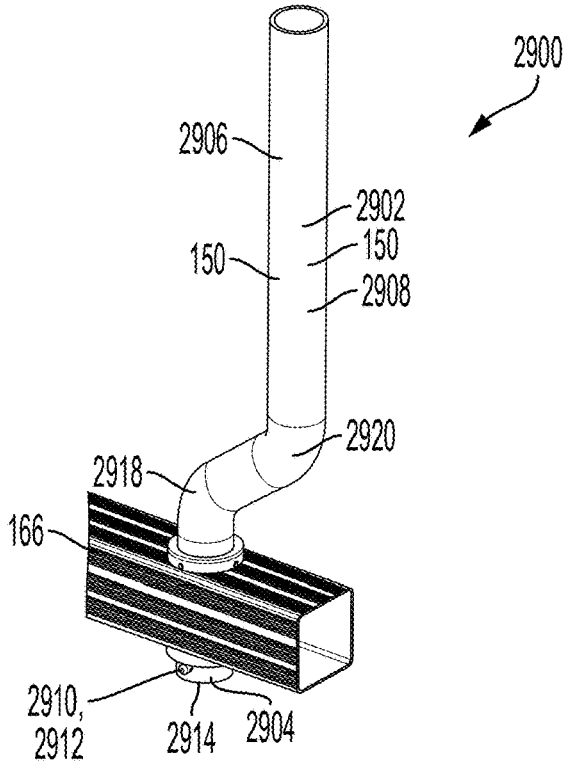
FIG. 29A is a perspective view of an adjustable guide-on assembly of the boat lift of FIG. 20.
Figure 29B:
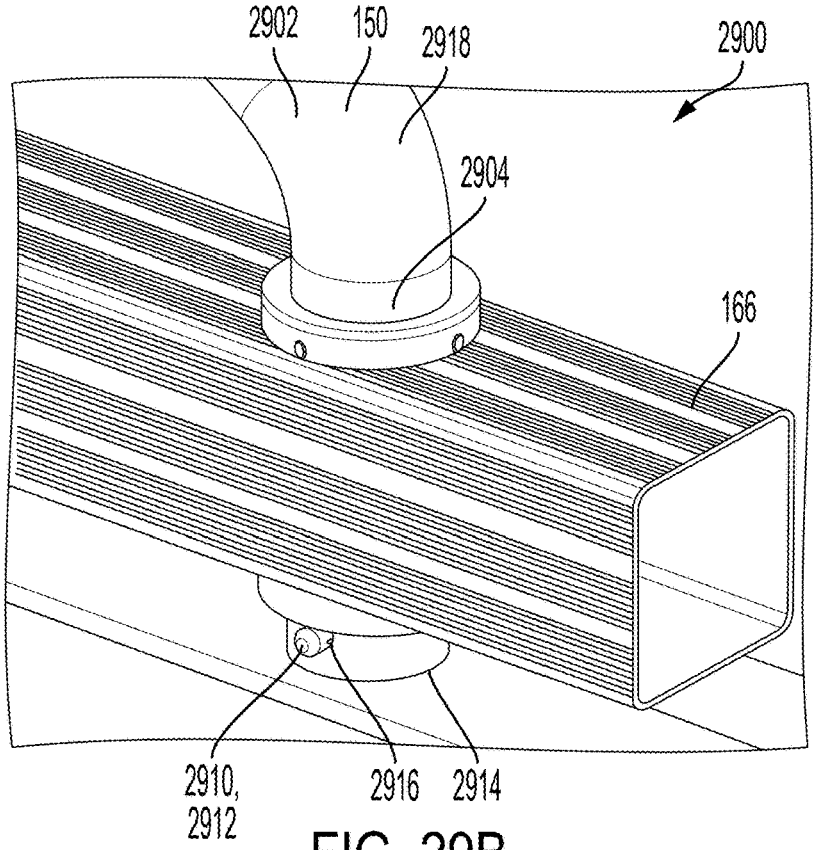
FIG. 29B is a detail perspective view of the adjustable guide-on assembly of FIG. 29A.

Referring to FIGS. 29A and 29B, the vertical boat guide 150 can comprise a substantially Z-shaped guide tube 2902. The guide tube 2902 can define a substantially vertical lower tube section 2904, a substantially vertical upper tube section 2906, and an angled middle tube section 2908. In some aspects, the vertical boat guide 150 can further comprise a guide sleeve 3310 (shown in FIG. 33) mounted over the upper tube section 2906 of the guide tube 2902. The lower tube section 2904 can extend through and be rotationally coupled to the upper side rail 166. In some aspects, the lower tube section 2904 can be provided with one or more spring button clips 2910 proximate a bottom tube end 2914 of the guide tube 2902. A button 2912 of the spring button clip 2910 can extend outward through a button opening 2916 (best seen in FIG. 29B) in the lower tube section 2904 to prevent the lower tube section 2904 from disengaging the upper side rail 166.

The middle tube section 2908 can be connected to the lower tube section 2904 by a lower bend 2918 and to the upper tube section 2906 by an upper bend 2920. The upper tube section 2906 can thereby be laterally offset from the lower tube section 2904, as shown. Thus, as the vertical boat guide 150 is rotated relative to the upper side rail 166, the upper tube section 2906 can be shifted inward (towards the opposing first lift side 120 or second lift side 122) and outward (away from the opposing first lift side 120 or second lift side 122), as desired. The upper tube sections 2906 of the vertical boat guides 150 can be shifted inward to accommodate boats having a smaller width, and the upper tube sections 2906 can be shifted outward to accommodate boats having a larger width.

Figure 29C:
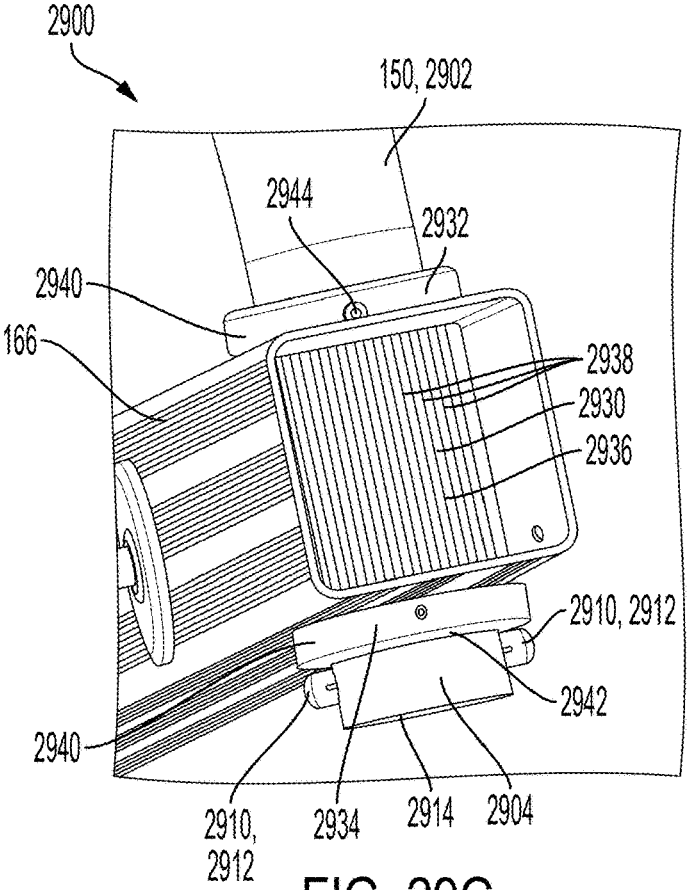
FIG. 29C is a detail end perspective view of the adjustable guide-on assembly of FIG. 29A.
Figure 29D:
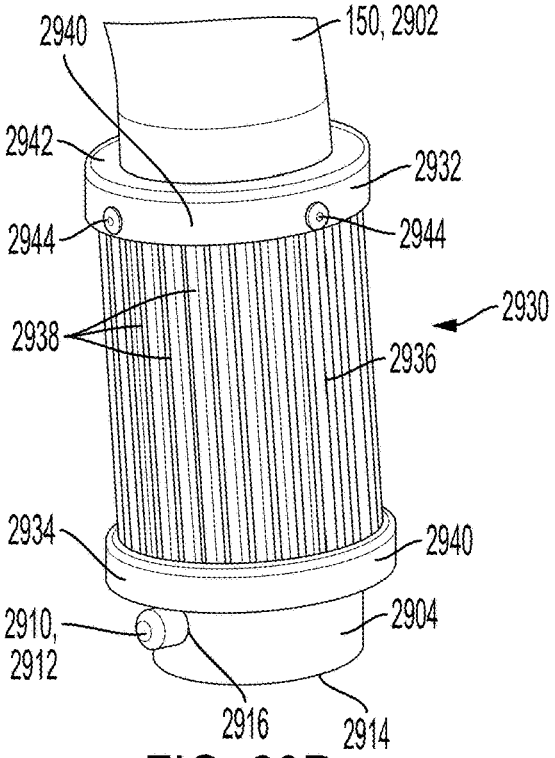
FIG. 29D is a detail perspective view of a toothed adjuster gear of the adjustable guide-on assembly of FIG. 29A.

Referring now to FIGS. 29C and 29D, an adjustment assembly 2930 can be mounted to the lower tube section 2904 of the guide tube 2902. The adjustment assembly 2930 can comprise an upper adjuster ring 2932, a lower adjuster ring 2934, and an adjuster gear 2936. The adjuster gear 2936 can be mounted between the upper adjuster ring 2932 and the lower adjuster ring 2934. The adjuster gear 2936 can define a plurality of longitudinal teeth 2938 extending along a length thereof. Example aspects of the adjuster gear 2936 can be formed from aluminum or another suitable metal. In the present aspects, the aluminum material can be extruded to form the adjuster gear 2936; however, in other aspects, the adjuster gear 2936 can be formed by any other suitable manufacturing method and/or can comprise any other suitable material. The upper adjuster ring 2932 and the lower adjuster ring 2934 can each define an annular shape and can be configured to cap opposing ends of the adjuster gear 2936.

In some example aspects, one or both of the upper and lower adjuster rings 2932,2934 can define a ring body 2940 and a ring flange 2942 extending radially inward from the ring body 2940. The opposing ends of the adjuster gear 2936 can extend into the corresponding ring body 2940 and can confront an inner flange surface of the ring flange 2942, which can prohibit the adjuster gear 2936 from passing through the upper adjuster ring 2932 or lower adjuster ring 2934. In example aspects, an inner ring surface of one or both of the upper and lower adjuster rings 2932,2934 can define mating ring teeth configured to mate with the longitudinal teeth 2938 of the adjuster gear 2936 to prevent rotation of the adjuster gear 2936 relative to the upper adjuster ring 2932 or lower adjuster ring 2934. In some example aspects, the upper adjuster ring 2932 can be coupled to the adjuster gear 2936 by any suitable fastener or fastening technique. In the present aspect, the upper adjuster ring 2932 can be coupled to the adjuster gear 2936 by a plurality of rivets 2944. The rivets 2944 can further engage the lower tube section 2904 to couple the upper adjuster ring 2932 and the adjuster gear 2936 to the guide tube 2902. The lower adjuster ring 2934 is not coupled to the adjuster gear 2936 or the lower tube section 2904 in the present aspect, which can allow the lower adjuster ring 2934 to be easily removed from the lower tube section 2904 for reasons described below. In some aspects, the lower adjuster ring 2934 may contact and/or may be supported on the button(s) 2912 of the one or more spring button clips 2910. In other aspects, the lower adjuster ring 2934 can be spaced from the button(s) 2912.

Figure 30A:
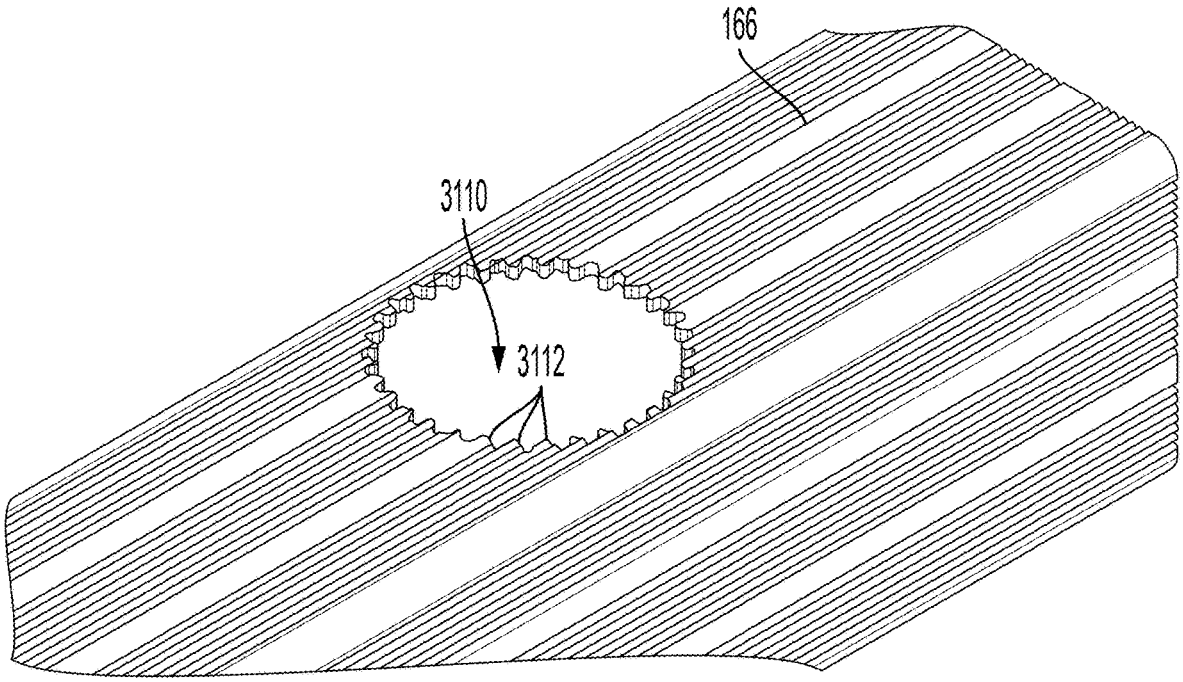
FIG. 30A is a perspective view of a toothed guide opening of the adjustable guide-on assembly of FIG. 29A.
Figure 30B:
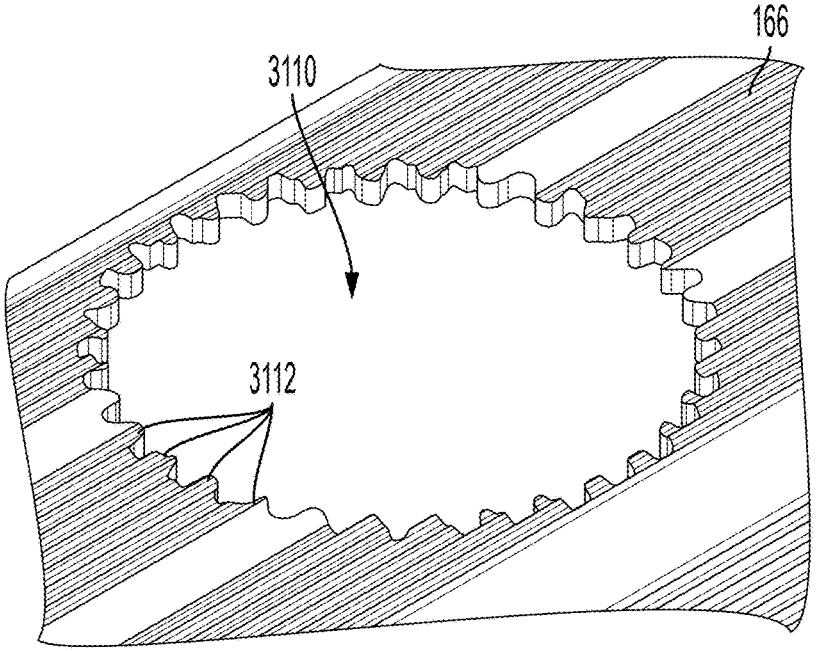
FIG. 30B is a detail perspective view of the toothed guide opening of FIG. 30A.

FIGS. 30A and 30B illustrate perspective and detail perspective views of a guide opening 3110 formed through the upper side rail 166. The guide opening 3110 can be configured to receive the lower tube section 2904 of the guide tube 2902 therethrough (2902,2904 shown in FIG. 29A). Additionally, the adjustment assembly 2930 (shown in FIG. 29C) mounted to the lower tube section 2904 can be received through the guide opening 3110. According to example aspects, the guide opening 3110 can define a plurality of opening teeth 3112 configured to mate with the longitudinal teeth 2938 of the adjuster gear 2936 in a locked position of the vertical boat guide 150 (150, 2936, and 2938 shown in FIG. 29C).

Referring to FIGS. 29A-30B, in the locked position, the vertical boat guide 150 can be prevented from rotating relative to the upper side rail 166. In an unlocked position of the vertical boat guide 150, the vertical boat guide 150 can be permitted to rotate relative to the upper side rail 166 to shift the upper tube section 2906 inward and outward as desired. To re-orient the vertical boat guide 150 from the locked position to the unlocked position, the buttons 2912 of the spring button clips 2910 can be depressed (such as by inward manual force, for example) into the lower tube section 2904. The lower adjuster ring 2934 can be slid downward on the lower tube section 2904 past the depressed button(s) 2912 and over the bottom tube end 2914. In other aspects, the lower adjuster ring 2934 can be slid downward on the lower tube section 2904, but may not be removed from the guide tube 2902.

With the lower adjuster ring 2934 removed or slid downward to a lower position on the lower tube section 2904, the guide tube 2902 can be raised upward through the guide opening 3110 of the upper side rail 166. As the guide tube 2902 is raised upward, the toothed adjuster gear 2936 attached thereto can be raised upward to disengage from the toothed guide opening 3110. The guide tube 2902 can then be rotated relative to the upper side rail 166, and the upper tube section 2906 can be shifted inward or outward to a desired position. In some aspects, the guide tube 2902 can be completely disengaged from the upper side rail 166 in the unlocked position, while in other aspects, the bottom tube end 2914 may remain engaged with the guide opening 3110 in the unlocked position.

Once the guide tube 2902 is oriented in the desired position, the lower tube section 2904 of the guide tube 2902 can then be slid back downward through the guide opening 3110 to engage the adjuster gear 2936 with the guide opening 3110. The longitudinal teeth 2938 of the adjuster gear 2936 can mate with the mating opening teeth 3112 of the guide opening 3110 to lock the guide tube 2902 in the desired position. The lower adjuster ring 2934 can be slid back onto the lower tube section 2904 over the bottom tube end 2914 and past the buttons 2912 of the spring button clips 2910. The inward force applied to the buttons 2912 can be released, allowing the spring button clips 2910 to bias the buttons 2912 outward through the corresponding button openings 2916 in the lower tube section 2904.

Figure 31A:
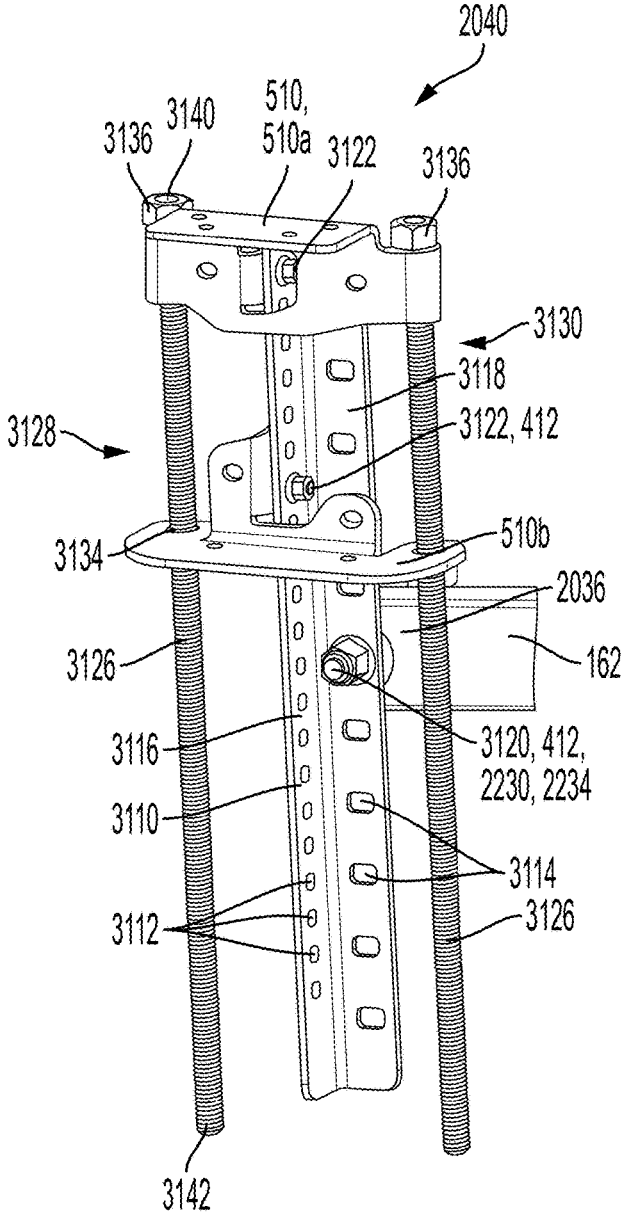
FIGS. 31A, 31B, and 31C illustrate varying perspective views of an attachment assembly of the boat lift of FIG. 20.
Figure 31B:
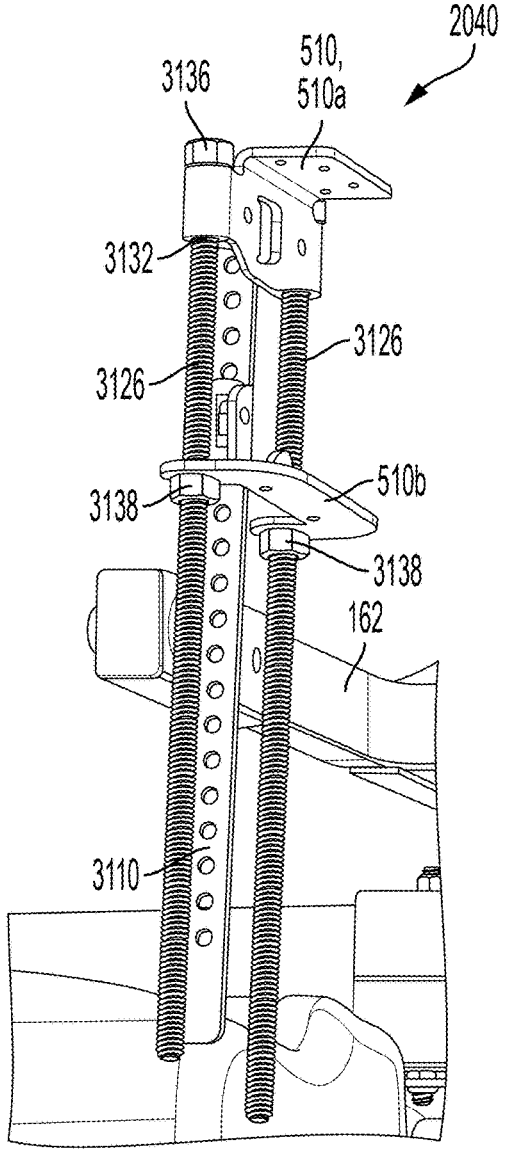
Figure 31C:
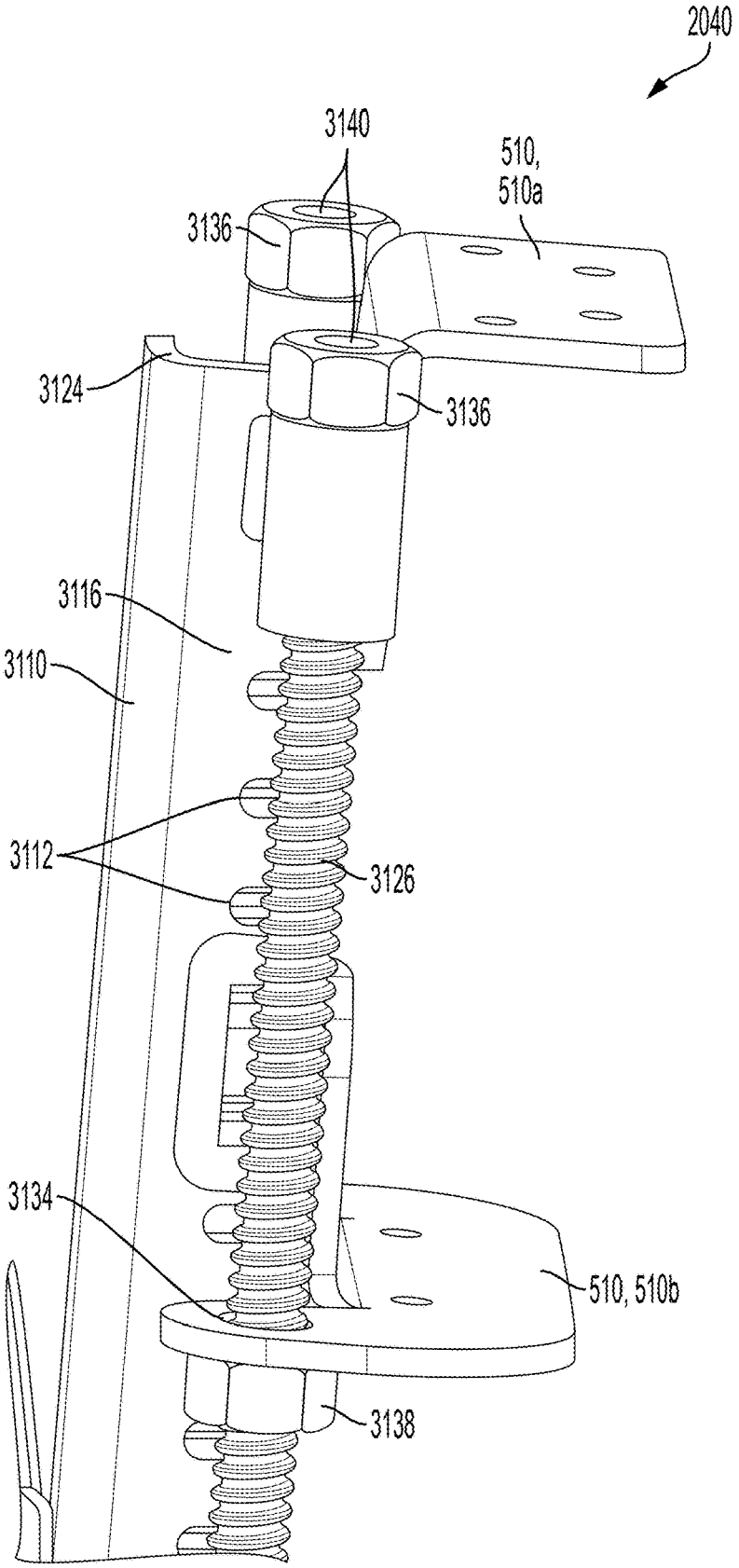

FIGS. 31A-31C illustrate varying perspective views of one of the dock mounting assemblies 2040 comprising the upper mounting bracket 510*a* and the lower mounting bracket 510*b*. The dock mounting assemblies 2040 can couple the boat lift 105 (shown in FIG. 20) to a dock or other structure. Example aspects of the dock mounting assembly 2040 can comprise a substantially vertical positioner plate 3110. The positioner plate 3110 can define a plurality of longitudinally arranged bracket positioner holes 3112 and a plurality of longitudinally arranged arm positioner holes 3114. In some aspects, the positioner plate 3110 can define a bracket plate portion 3116 defining the bracket positioner holes 3112 and an arm plate portion 3118 defining the arm positioner holes 3114. In the present aspect, the bracket plate portion 3116 can be bent relative to the arm plate portion 3118, as shown.

The second swing arm end 2036 of each swing arm 162 can be pivotably coupled to a corresponding one of the dock mounting assemblies 2040. More specifically, the swing arm 162 can be coupled to the arm plate portion 3118 by a pivot fastener 3120 at a desired one of the arm positioner holes 3114. The pivot fastener 3120 can be another one of the nut and bolt assemblies 412, for example and without limitation, wherein the swing arm 162 can pivot about the corresponding bolt 2230. The longitudinal positioning of the swing arm 162 relative to the dock mounting assemblies 2040 can be selectively adjusted by repositioning the pivot fastener 3120 through a different one of the arm positioner holes 3114.

Each of the upper mounting bracket 510*a* and the lower mounting bracket 510*b* can be coupled to the bracket plate portion 3116 by a bracket fastener 3122 at a desired one of the bracket positioner holes 3112. The bracket fasteners 3122 can be additional nut and bolt assemblies 412, for example and without limitation. The longitudinal positioning of each of the upper mounting bracket 510*a* and the lower mounting bracket 510*b* relative to the positioner plate 3110 can be selectively adjusted by repositioning the corresponding bracket fastener 3122 through a different one of the bracket positioner holes 3112. In example aspects, the upper mounting bracket 510*a* may be coupled to the positioner plate 3110 at or near a top plate end 3124 (shown in FIG. 31C) of the positioner plate 3110, and the lower mounting bracket 510*b* can be repositioned along the length of the positioner plate 3110 to increase or decrease the distance between the upper mounting bracket 510*a* and the lower mounting bracket 510*b*. The dock mounting assembly 2040 can thereby be reconfigured to accommodate docks (or other structures) of varying thickness.

In some aspects, the dock mounting assembly 2040 can be provided with a pair of threaded adjustment rods 3126. One of the threaded adjustment rods 3126 can be positioned at a first assembly side 3128 of the dock mounting assembly 2040 and the other one of the threaded adjustment rods 3126 can be positioned at a second assembly side 3130 of the dock mounting assembly 2040, opposite the first assembly side 3128. The threaded adjustment rods 3126 can extend through corresponding upper rod openings 3132 (shown in FIG. 31B) formed in the upper mounting bracket 510*a* and corresponding lower rod openings 3134 formed in the lower mounting bracket 510*b*. The upper rod openings 3132 and the lower rod openings 3134 can be non-threaded.

According to example aspects, a pair of threaded upper nuts 3136 can be threaded onto the threaded adjustment rods 3126 at upper rod ends 3140 thereof and tightened downward to confront the upper mounting bracket 510*a*. A pair of threaded lower nuts 3138 (shown in FIG. 31B) can be threaded onto the threaded adjustment rods 3126 at lower rod ends 3142 thereof and tightened upward to confront the lower mounting bracket 510*b*.

To reposition the lower mounting bracket 510*b* towards the upper mounting bracket 510*a*, the bracket fastener 3122 securing the lower mounting bracket 510*b* to the positioner plate 3110 can first be removed. The threaded lower nuts 3138 can then be tightened upward (i.e., towards the upper rod end 3140) along the threaded adjustment rods 3126 to push the lower mounting bracket 510*b* upward. Once the lower mounting bracket 510*b* is oriented in the desired position, the corresponding bracket fastener 3122 can recouple the lower mounting bracket 510*b* to the positioner plate 3110 by engaging the bracket fastener 3122 with the appropriate bracket positioner hole 3112.

To reposition the lower mounting bracket 510*b* further away from the upper mounting bracket 510*a*, the corresponding bracket fastener 3122 can first be removed. The threaded lower nuts 3138 can then be untightened downward (i.e., towards the lower rod end 3142) along the threaded adjustment rods 3126 to allow the lower mounting bracket 510*b* to slide downward on the threaded adjustment rods 3126. Once the lower mounting bracket 510*b* is oriented in the desired position, the corresponding bracket fastener 3122 can recouple the lower mounting bracket 510*b* to the positioner plate 3110 by engaging the bracket fastener 3122 with the appropriate bracket positioner hole 3112.

The upper mounting bracket 510*a* can be repositioned closer to or further away from the lower mounting bracket 510*b* in substantially the same manner.

Figure 32A:
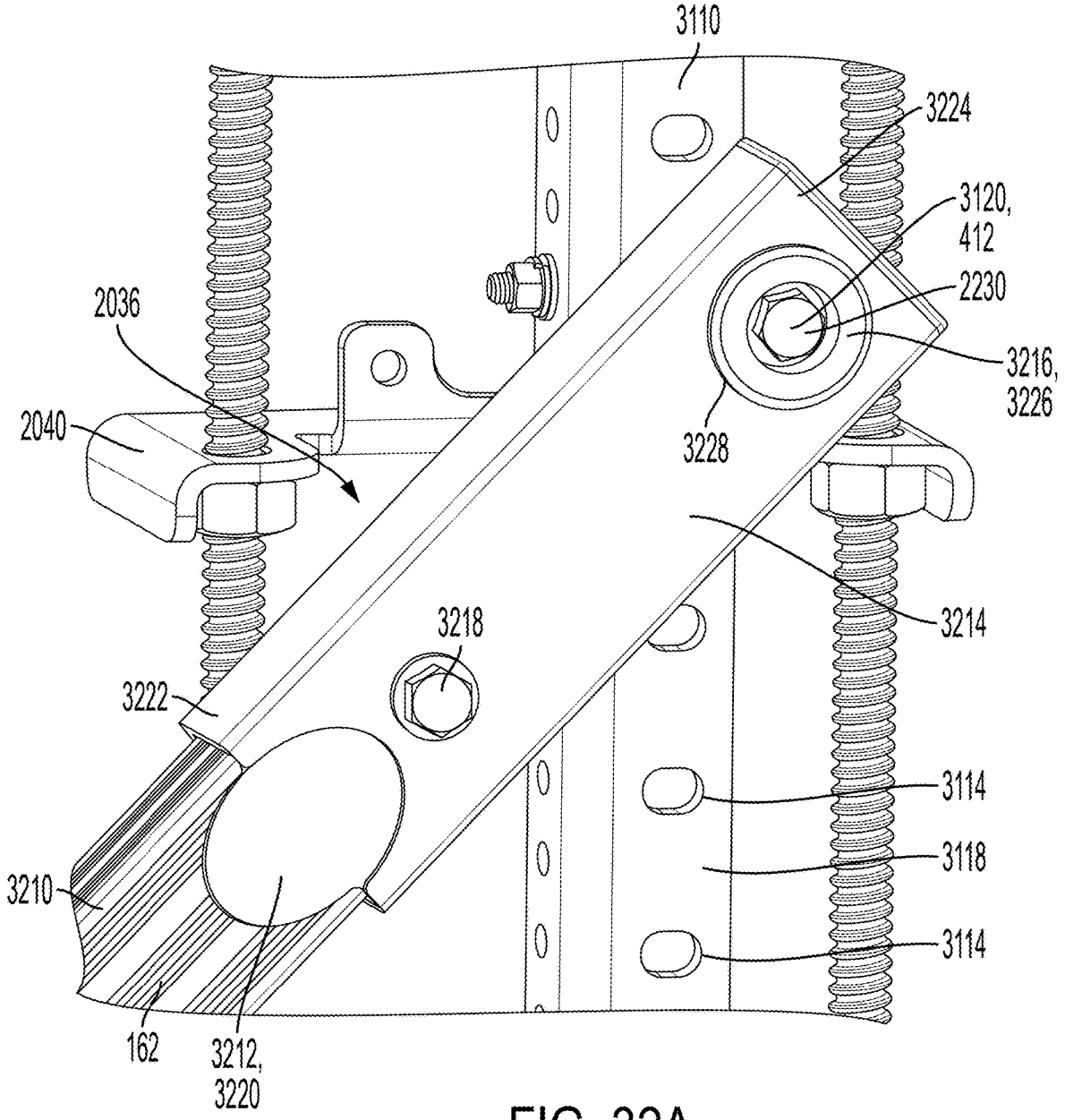
FIG. 32A illustrates a detail perspective view of a swing arm of the boat lift of FIG. 20.
Figure 32B:
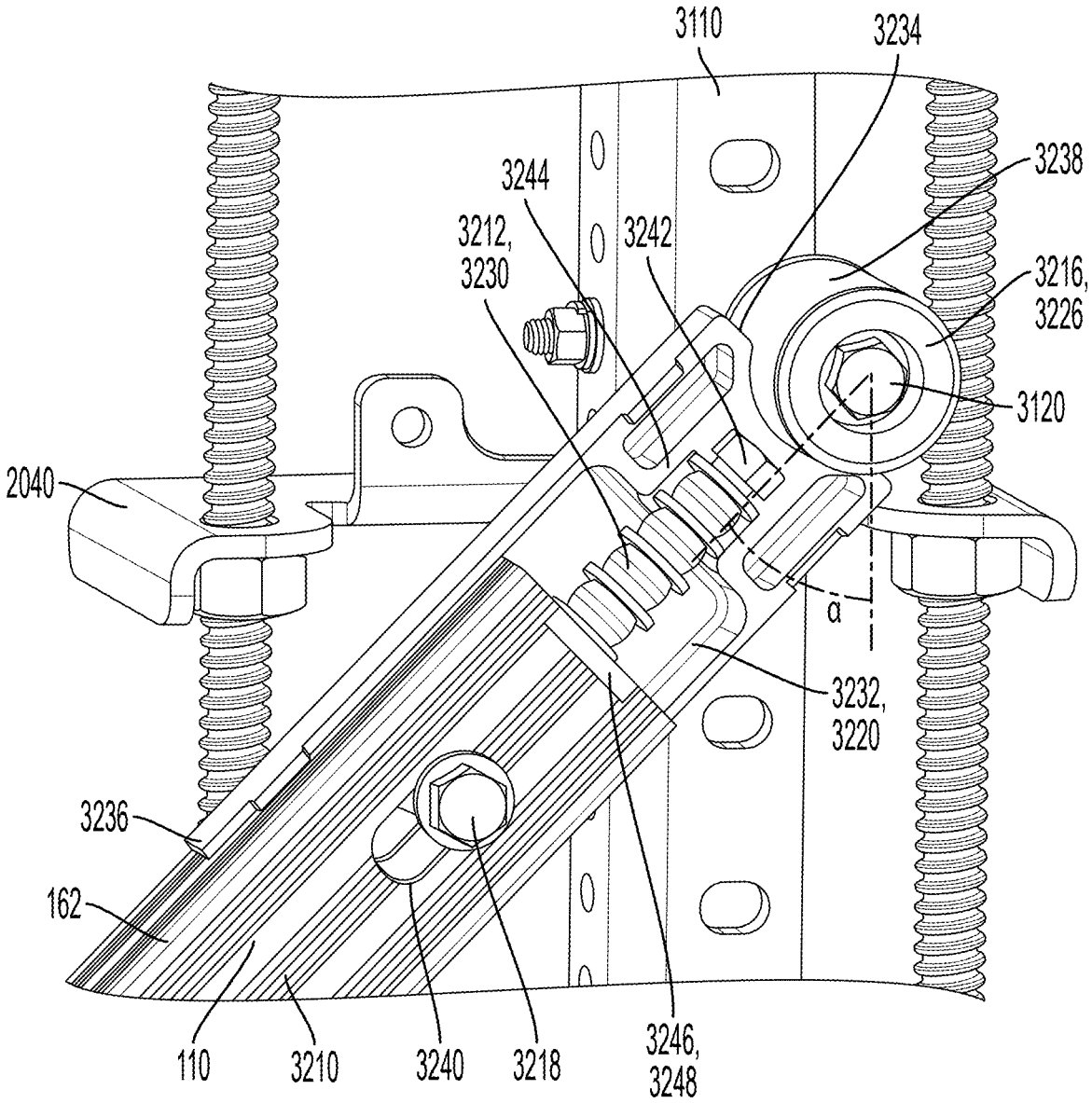
FIG. 32B illustrates a detail perspective view of the swing arm of FIG. 32A with an end cap of the swing arm removed.

FIGS. 32A and 32B illustrate perspective views of the second swing arm end 2036 of each swing arm 162 pivotably coupled to the corresponding dock mounting assembly 2040. With reference to FIG. 32A, the swing arm 162 can comprise an arm body 3210, a shock absorption assembly 3212, an end sleeve 3214, and an arm pivot 3216. Example aspects of the arm body 3210 can be formed as a substantially hollow, extruded metal tube. Other aspects of the arm body 3210 can comprise any suitable material and can be formed by any suitable manufacturing method. The shock absorption assembly 3212 can be movably coupled to the arm body 3210 at the second swing arm end 2036 by a shock fastener 3218, as described in further detail below. Example aspects of the shock absorption assembly 3212 can comprise the shock fastener 3218, a shock housing 3220, and the bellows 3230. The arm end sleeve 3214 can at least partially cover the shock absorption assembly 3212, as shown. The arm end sleeve 3214 can be fixedly attached to the shock absorption assembly 3212 by the shock fastener 3218 near a proximal sleeve end 3222 of the arm end sleeve 3214. The arm pivot 3216 can be coupled to the arm end sleeve 3214 near a distal sleeve end 3224 of the arm end sleeve 3214, opposite the proximal sleeve end 3222.

The arm pivot 3216 can comprise a pivot bushing 3226 and the pivot fastener 3120. In the present aspect, the pivot fastener 3120 can be one of the nut and bolt assemblies 412. A bushing opening 3228 can be formed transversely through the arm end sleeve 3214, and the pivot bushing 3226 can be mounted within the bushing opening 3228. The threaded shaft 2234 (shown in FIG. 31A) of the bolt 2230 of the pivot fastener 3120 can extend through pivot bushing 3226, and the pivot bushing 3226 can be configured to rotate relative to the pivot fastener 3120.

Referring now to FIG. 32B, the swing arm 162 is shown with the arm end sleeve 3214 (shown in FIG. 32A) removed for improved visibility of the shock absorption assembly 3212 and the pivot bushing 3226. Example aspects of the shock absorption assembly 3212 can comprise the shock housing 3220, the shock absorber 3230 (such as the bellows 3230, for example) and the shock fastener 3218. The shock housing 3220 can comprise a pair of housing components 3232 that can be coupled together to form the shock housing 3220. One of the housing components 3232 is removed in the present view for visibility of the bellows 3230, but is visible in the previous FIG. 32A. The housing components 3232 can be identical in the present aspect.

A distal housing end 3234 of the shock housing 3220 can be arranged at or near the arm pivot 3216. In example aspects, the arm pivot 3216 can comprise a bushing tube 3238 encircling the pivot bushing 3226, and the distal housing end 3234 of the shock housing 3220 can be coupled to the bushing tube 3238. In some aspects, the pivot bushing 3226 can be press fit into the bushing tube 3238. A first body end 3211 of the arm body 3210 of the swing arm 162 can extend into a housing interior of the shock housing 3220 at a proximal housing end 3236, opposite the distal housing end 3234. The shock fastener 3218 can extend through each of the arm body 3210 and the shock housing 3220 to couple the arm body 3210 to the shock housing 3220. According to example aspects, the arm body 3210 can define an elongated fastener slot 3240 through which the shock fastener 3218 can extend. The shock fastener 3218 can be configured to slide within the elongated fastener slot 3240, which can allow the arm body 3210 to slide within the housing interior of the shock housing 3220.

The bellows 3230 can be positioned within the housing interior of the shock housing 3220. The bellows 3230 can define opposing bellows ends 3242. A first one of the bellows ends 3242 can be arranged proximate to the distal housing end 3234 and can be retained within a bellows notch 3244 of the shock housing 3220. The bellows 3230 can extend in a direction towards the arm body 3210 and the proximal housing end 3236. The bellows 3230 can be coupled to the arm body 3210 by a bellows fastener 3246. In the present aspect, the bellows fastener 3246 can be a fastener plate 3248. The bellows 3230 can expand and compress between the arm body 3210 and the shock housing 3220, and the shock fastener 3218 can slide within the elongated fastener slot 3240 of the arm body 3210, to provide shock absorption in response to movement of the lift frame 110. For example, the lift frame 110 may move as a boat is driven onto or off of the lift frame 110, as air is pumped into or released from the lift floats 115 (shown in FIG. 20), in response to waves, wind, and/or changing water levels, and in a number of other circumstances.

Figure 20:
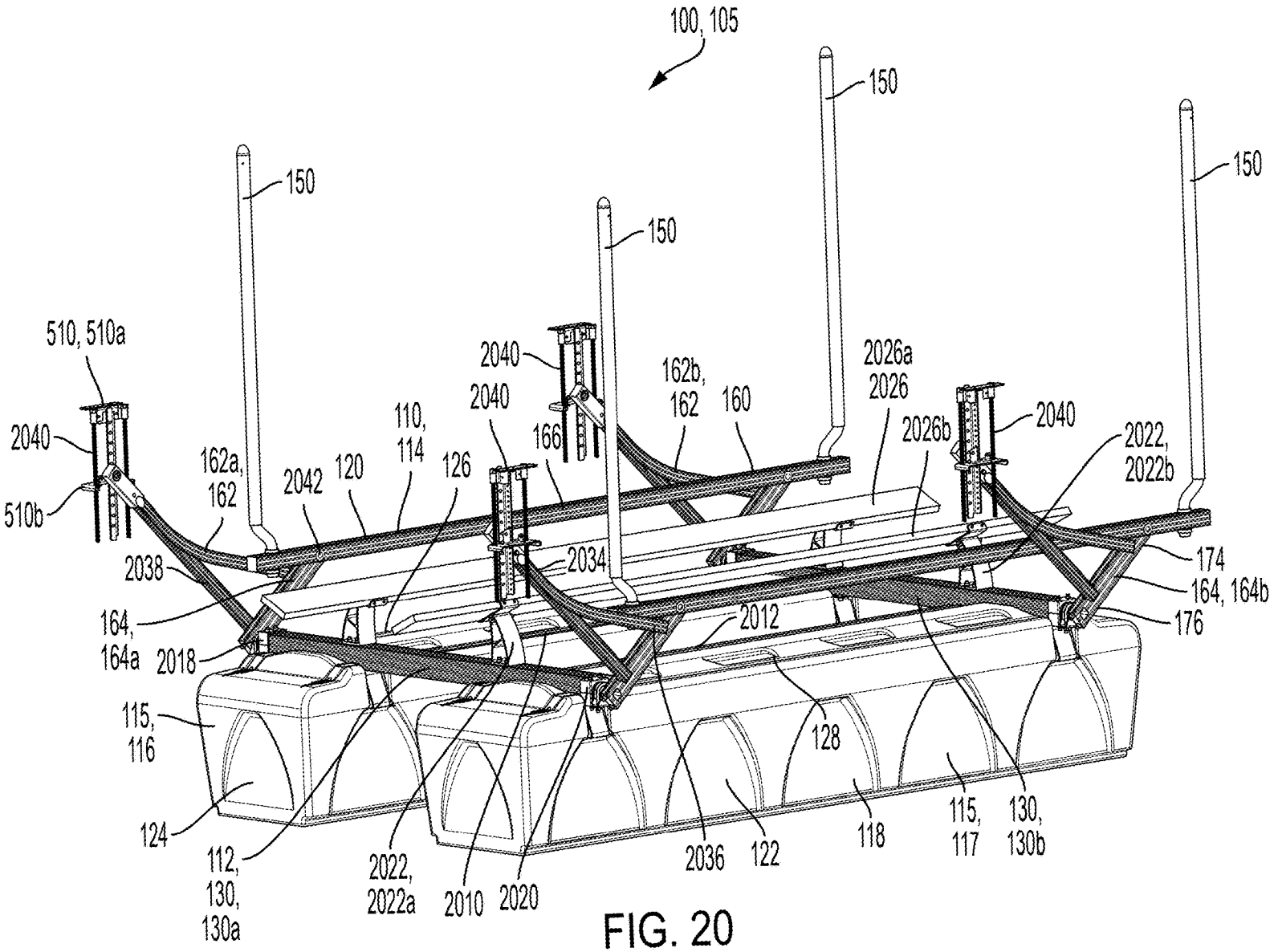
FIG. 20 is perspective view of the boat lift, in accordance with another example aspect of present disclosure, wherein the boat lift is configured in a lowered position.

In FIGS. 20, 32A, and 32B, the boat lift 105 (shown in FIG. 20) is oriented in the lowered position. With continued reference to FIG. 32B, in the lowered position, the swing arms 162 can be oriented at a lowered angle α relative to vertical. In the present aspect, the lowered angle α can be about 45° relative to vertical. The boat lift 105 can be arranged in the lowered position by letting air out of the lift floats 115, which can sink the lift floats 115 and the base portion 112 (shown in FIG. 20) of the lift frame 110 down into the water to facilitate driving a boat onto or off of the lift frame 110. The boat lift 105 may also be arranged in the lowered position when the water level is low, which can lower the lift frame 110 relative to the dock.

FIG. 33 illustrates the boat lift 105 in the raised position. The boat lift 105 can be arranged in the raised position by pumping air into the lift floats 115, which can increase the buoyancy of the lift floats 115 to raise the base portion 112 of the lift frame 110 (and a boat supported thereon) out of the water. The boat may also be arranged in the raised position when the water level high, lifting the lift frame 110 relative to the dock.

The rotational connection of the swing arms 162 to the dock mounting assemblies 2040 can allow the lift frame 110 to pivot relative to the stationary dock mounting assembly 2040 as the boat lift 105 is raised and lowered, as a water vehicle is guided on and off the boat lift 105, in response to waves and changing water levels, etc. Moreover, the rotational connection of each vertical swing rail 164 to corresponding upper side rail 166 and to the base portion 112 (via the torsion assembly 2100) can allow the base portion 112 and the upper side rails 166 to maintain a substantially horizontal orientation as the boat lift 105 moves between the raised and lowered positions.

FIG. 33 also illustrates the guide sleeves 3310 mounted on the upper tube sections 2906 (shown in FIG. 29A) of the guide tubes 2902. In some aspects, the guide sleeves 3310 can be elongated to increase a height of each of the vertical boat guides 150. Moreover, in some aspects, a guide visual indicator 3312 can be arranged at a top guide end 3314 of each guide sleeve 3310. The guide visual indicator 3312 can be easily visible to a boat operator, so as to aid the boat operator in properly aligning the boat with the boat lift 105. In some aspects, the guide visual indicator 3312 can comprise a bright or easily noticeable color, such as a red, orange, or yellow, for example and without limitation. In some aspects, the guide visual indicator 3312 can be a reflector or a light. In other aspects, the guide visual indicator 3312 can be any other suitable indicator that improves the visibility of the vertical boat guide 150.

In some aspects, the guide visual indicator 3312 can be formed as a separate guide cap mounted to the guide sleeve 3310. In other aspects, the guide visual indicator 3312 can monolithically formed with the guide sleeve 3310. In aspects wherein the guide visual indicator 3312 comprises a bright or easily noticeable color, the color can be painted on, applied via a sticker or wrap, dyed into the material of the guide sleeve 3310, or applied by any other suitable method.

As shown in FIG. 34, in the raised position, the swing arms 162 can be oriented at a raised angle β relative to vertical. The raised angle β can be greater than the lowered angle α (shown in FIG. 32B). In the present aspect, the raised angle β can be about 90° relative to vertical. In other aspects, the lowered angle α can be greater or less than 45°, and the raised angle R can be greater or less than 90°.

FIGS. 35-38 illustrates a cuff lock assembly 3510 for mounting to the center torsion tube 2102 (shown in FIG. 39), in accordance with an example aspect of the present disclosure. In some aspects, the cuff lock assembly 3510 can replace the lock assembly 2110 previously described. The cuff lock assembly 3510 can comprise a substantially cylindrical cuff body 3512 defining an inner end 3518 and outer end 3520. An inner plate 3514 can be arranged at the inner end 3518 of the cuff body 3512, and an outer plate 3516 can be arranged at the outer end 3520 of the cuff body 3512. The substantially cylindrical cuff body 3512 can define a cuff void 3522 extending from the inner end 3518 to the outer end 3520, and a cuff axis 3524 can extend centrally through the cuff void 3522.

An inner opening 3526 can be defined through the inner plate 3514 and can allow access to the cuff void 3522 through the inner plate 3514. An outer opening 3528 can be defined through the outer plate 3516 and can allow access to the cuff void 3522 through the outer plate 3516. In example aspects, the center torsion tube 2102 can be configured to extend through inner opening 3526, the cuff void 3522, and the outer opening 3528, substantially along the cuff axis 3524.

In example aspects, the inner opening 3526 of the inner plate 3514 can be substantially circular. In addition to the center torsion tube 2102, the main axle 2104 (shown in FIG. 40) can extend through the inner opening 3526 and into the cuff void 3522. Moreover, in example aspects, the outer opening 3528 of the outer plate 3516 can be substantially square. For example, the substantially square shape of the outer opening 3528 may be sized and/or shaped to substantially match the geometry of the center torsion tube 2102 received therethrough, to prohibit rotation of the center torsion tube 2102 relative to the cuff lock assembly 3510.

One or more fastener openings 3530 can extend radially through the cuff body 3512, relative to the cuff axis 3524. In the present aspect, four of the fastener openings 3530 can be spaced circumferentially about the cuff body 3512. A corresponding cuff fastener 3532 can engage each of the fastener openings 3530 and can extend into the cuff void 3522 to engage the center torsion tube 2102, as described in further detail below. In example aspects, each cuff fastener 3532 can comprise a cuff nut 3534 mounted within the fastener opening 3530 and a threaded bolt 3536 configured to threadedly engage the cuff nut 3534. In the present aspect, each cuff nut 3534 can be a flanged hex nut 3538, and each fastener opening 3530 can be hexagonal in shape. The flanged hex nut 3538 can be received within the hexagonal fastener opening 3530 to prevent rotation of the flanged hex nut 3538 as the threaded bolt 3536 is tightened/loosened relative thereto.

Each of the outer plate 3516 and the inner plate 3514 can be substantially circular in shape. In some aspects, the outer plate 3516 can define one or more plate tabs 3540 extending radially outward, relative to the cuff axis 3524, from a substantially circular outer edge 3544 of the outer plate 3516. In the present aspect, the outer plate 3516 can define four of the plate tabs 3540 spaced circumferentially around the outer edge 3544. The cuff body 3512 can define corresponding body notches 3542 formed radially therethrough at the outer end 3520 thereof. In example aspects, the outer plate 3516 can substantially nest within the cuff void 3522 of the cuff body 3512 at the outer end 3520 thereof, and each of the plate tabs 3540 can engage a corresponding one of the body notches 3542.

Figure 36:
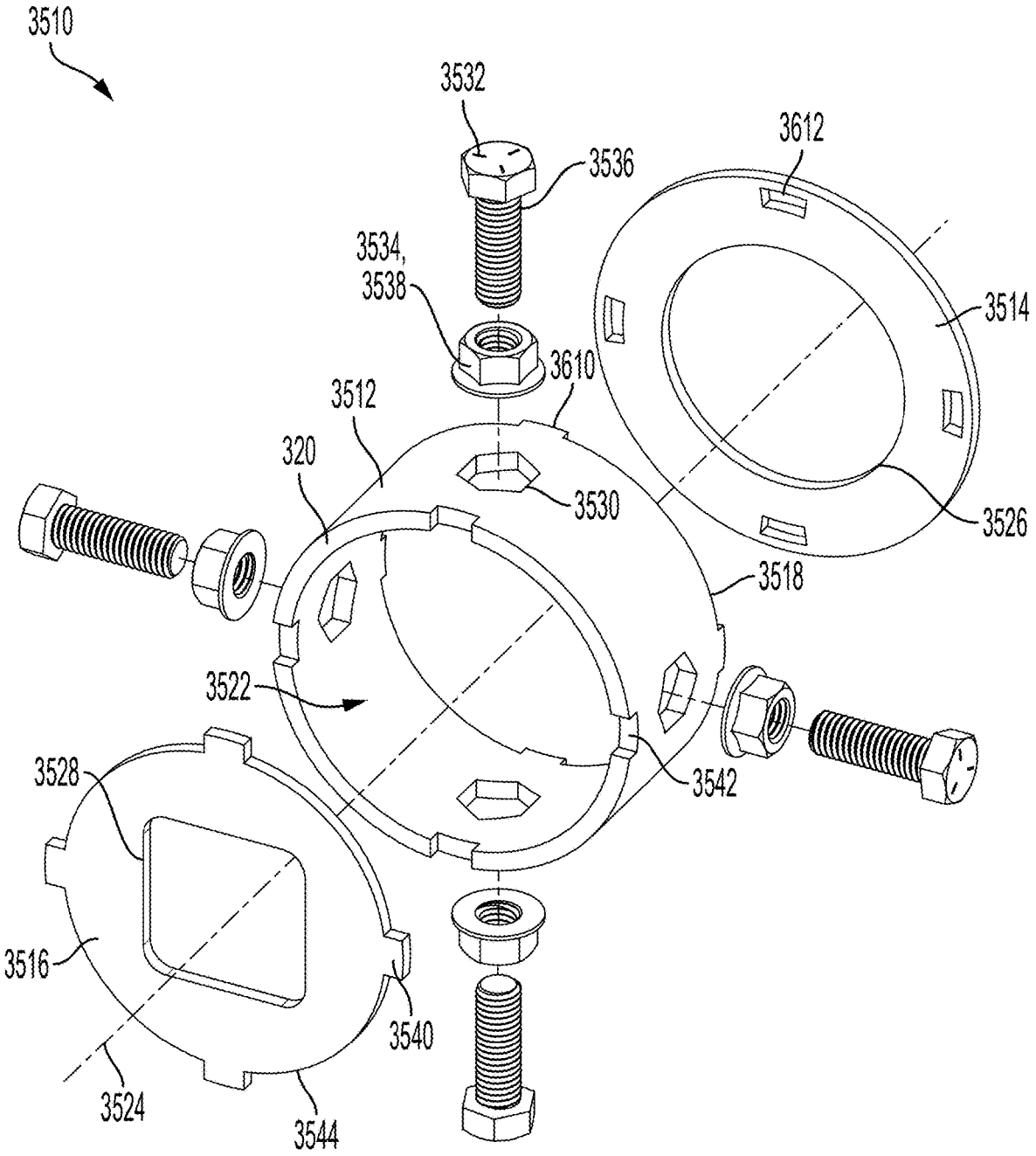
FIG. 36 illustrates an exploded view of the cuff lock assembly of FIG. 35.

As shown in FIG. 36, in example aspects, one or more body tabs 3610 can extend axially outward, relative to the cuff axis 3524, from the cuff body 3512 at the inner end 3518 thereof. In the present aspect, the cuff body 3512 can define four of the body tabs 3610 spaced circumferentially around the inner end 3518. The inner plate 3514 can define corresponding plate notches 3612 formed axially therethrough. Each of the body tabs 3610 can extend a corresponding one of the plate notches 3612, as best seen in FIG. 38.

Figure 37:
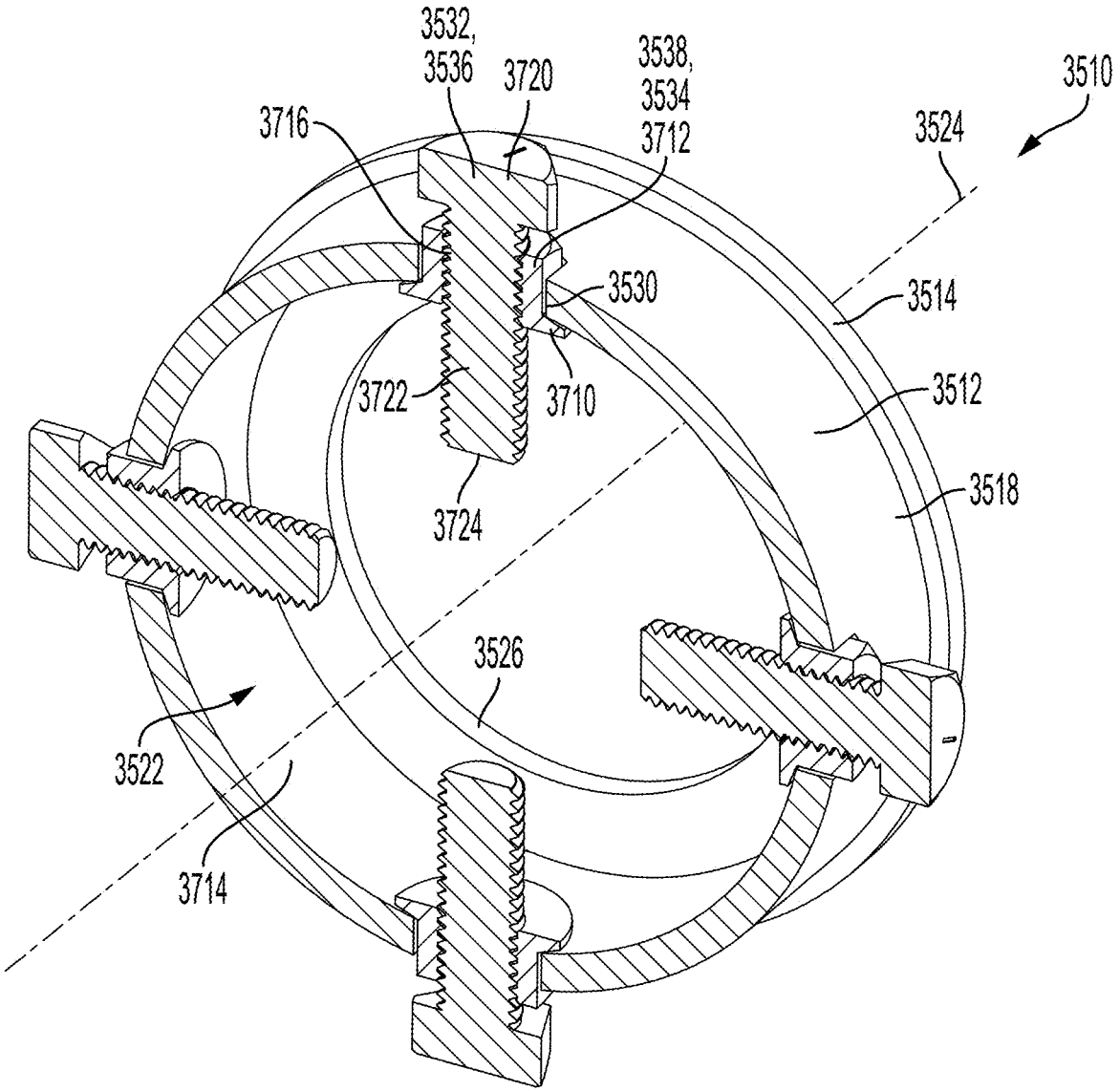
FIG. 37 illustrates a cross-sectional view of the cuff lock assembly, taken along line 37-37 in FIG. 35.

Referring to FIG. 37, which illustrates a cross-sectional view of the cuff lock assembly 3510, each of the flanged hex nuts 3538 can define a substantially annular flange portion 3710 and a hexagonal nut portion 3712 extending outward from the annular flange portion 3710, relative to the orientation shown. The annular flange portion 3710 can be arranged within the cuff void 3522, and in some aspects, may abut an inner body surface 3714 of the cuff body 3512. The hexagonal nut portion 3712 can be received through the corresponding fastener opening 3530 in the cuff body 3512. Each of the threaded bolts 3536 can define a bolt head 3720 and a threaded shaft 3722 extending inward from the bolt head 3720, relative to the orientation shown. The threaded shaft 3722 can define a distal shaft end 3724 distal to the bolt head 3720. The threaded shaft 3722 of each threaded bolt 3536 can threaded engage a threaded nut bore 3716 formed through the corresponding flanged hex nut 3538.

Figure 38:
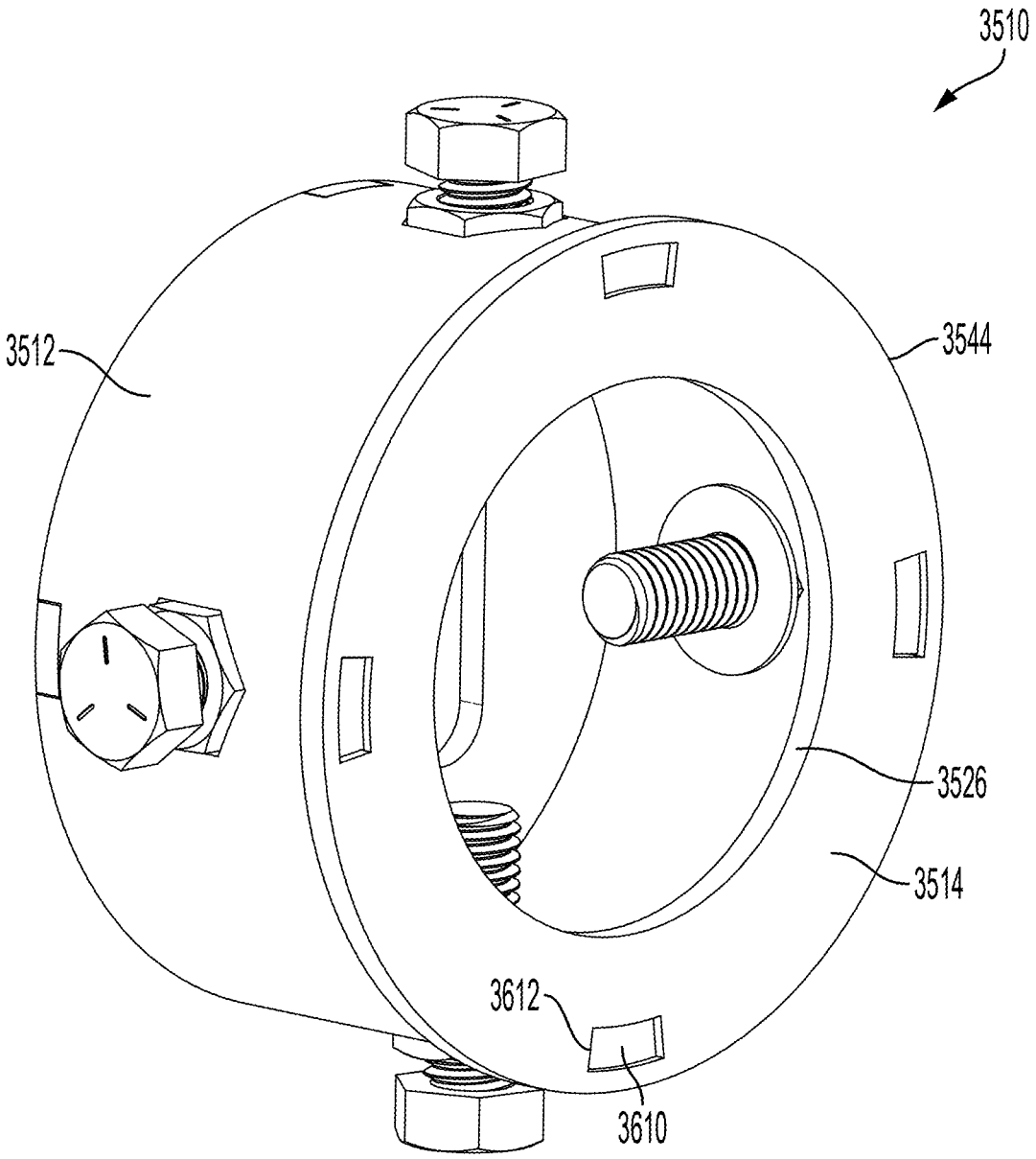
FIG. 38 illustrates a rear top right perspective view of the cuff lock assembly of FIG. 35.

With reference to FIG. 38, the inner plate 3514 can define the inner opening 3526 formed therethrough. In example aspects, the inner opening 3526 of the inner plate 3514 can be substantially circular. The substantially circular inner opening 3526 may be sized and/or shaped to substantially match the geometry of the main axle 2104 (shown in FIG. 40) received therethrough. The inner plate 3514 can further define the substantially circular outer edge 3544. In some example aspects, a diameter of outer edge 3544 of the inner plate 3514 can be greater than an outer diameter of the cuff body 3512, and a diameter of the inner opening 3526 of the inner plate 3514 can be less than an inner diameter of the cuff body 3512.

Figure 39:
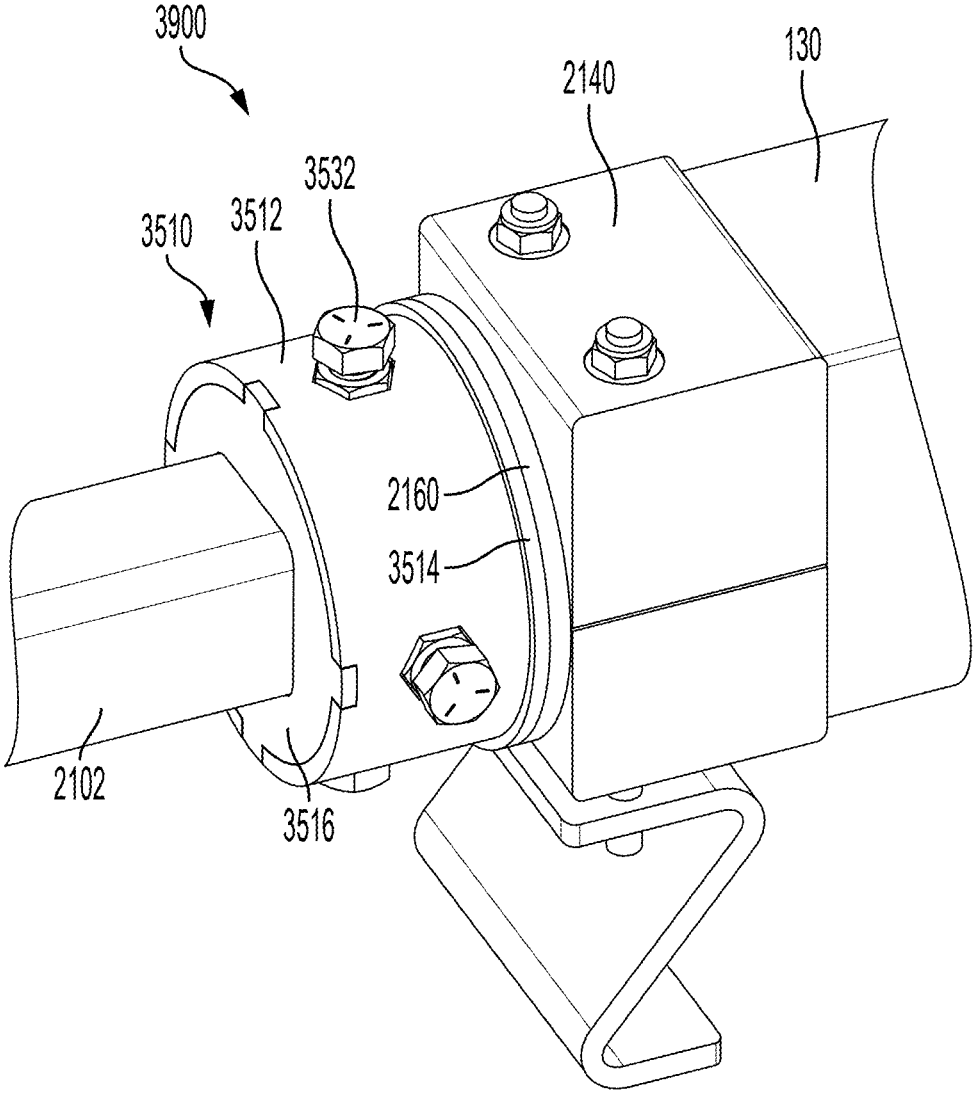
FIG. 39 illustrates a top right front perspective view of the torsion assembly comprising the cuff lock assembly of FIG. 35, in accordance with another example aspect of the present disclosure.

FIG. 39 illustrates another example aspect of a torsion assembly 3900 comprising the cuff lock assembly 3510 of FIGS. 35-38. The center torsion tube 2102 can be secured to and substantially fixed relative to the main axle 2104 (shown in FIG. 40) by the cuff lock assembly 3510. As previously described, in example aspects, the wear plate 2160 can be arranged between the end clamp 2140 and cuff lock assembly 3510. Each of the center torsion tube 2102 and the main axle 2104 (shown in FIG. 40) can extend through the wear plate 2160.

Figure 40:
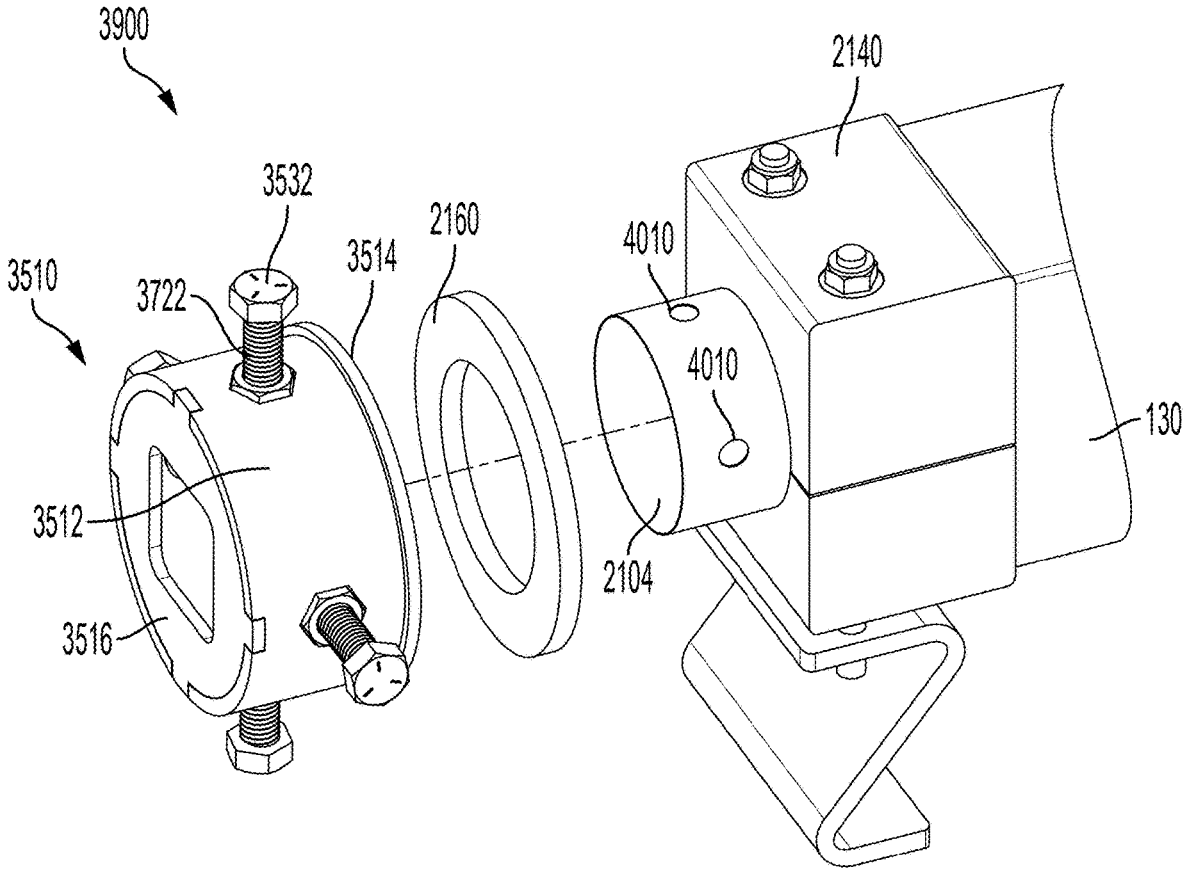
FIG. 40 illustrates an exploded view of the torsion assembly of FIG. 39.

FIG. 40 illustrates an exploded view of the torsion assembly 3900, with the center torsion tube 2102 (shown in FIG. 39) removed. In example aspects, as shown, the main axle 2104 can define one or more axle openings 4010 formed therethrough. Each of the axle openings 4010 can be configured to receive the threaded shaft 3722 of a corresponding one of the cuff fasteners 3532. The threaded shaft 3722 can extend through the axle opening 4010, and the distal shaft end 3724 of each of the cuff fasteners 3532 can be tightened against the center torsion tube 2104 to clamp the center torsion tube 2104 between the corresponding distal shaft ends 3724.

Figure 41:
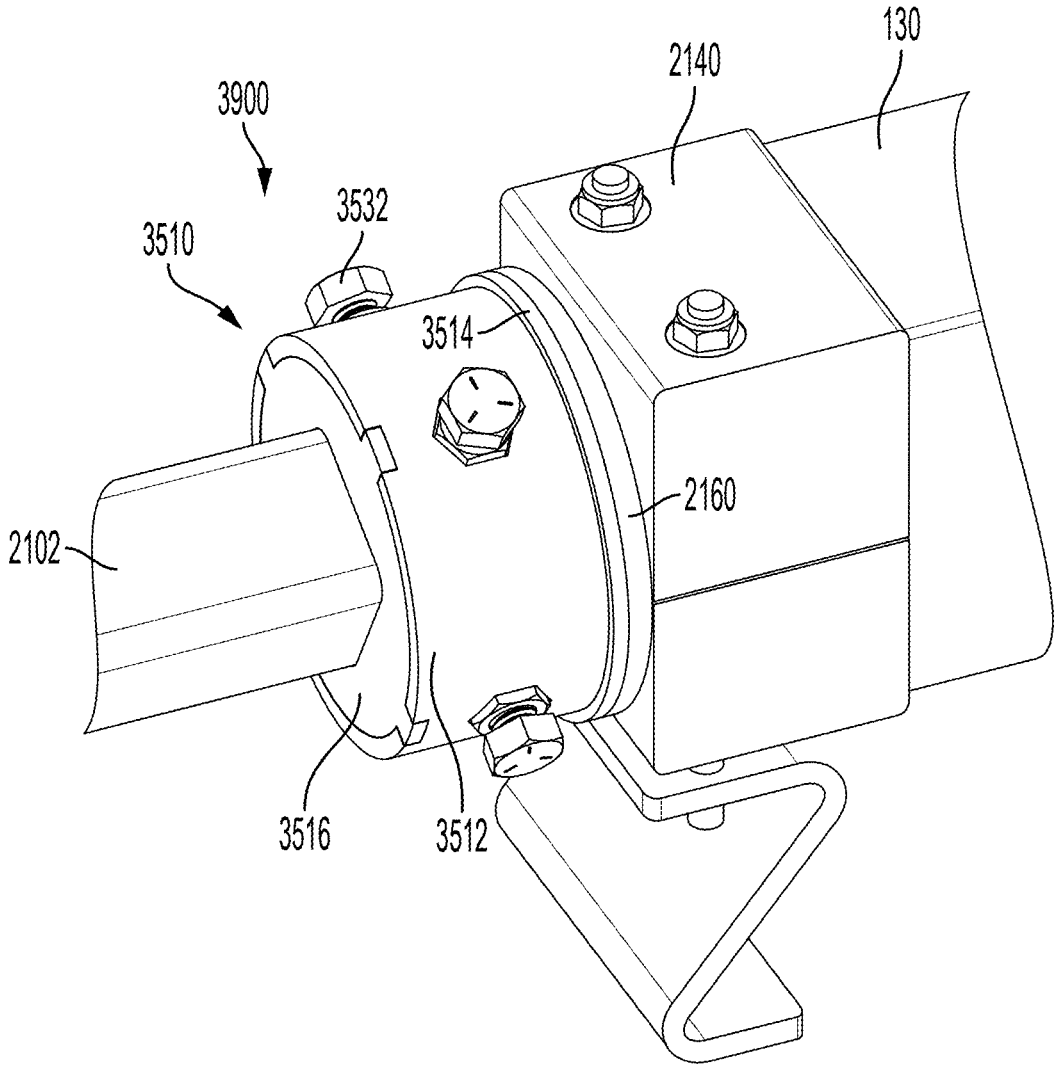
FIG. 41 illustrates of a top right front perspective view of the torsion assembly of FIG. 39 rotated relative to a corresponding boat support member.

As shown in FIG. 41, and as previously described, the torsion assembly 3900, including the main axle 2104 (shown in FIG. 40), the torsion tube 2102, and the cuff lock assembly 3510, can be configured to rotate relative to the boat support member 130. For example, FIG. 41 illustrates the torsion assembly 3900 rotated 45° relative to the boat support member 130, in comparison to the configuration shown in FIG. 39.

Figure 42:
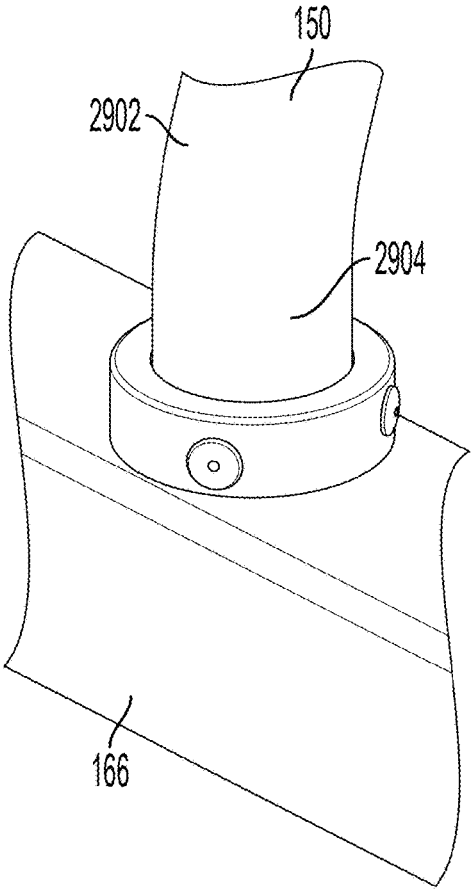
FIG. 42 illustrates the adjustable guide-on assembly of the boat lift in a locked position, in accordance with another example aspect of the present disclosure.
Figure 43:
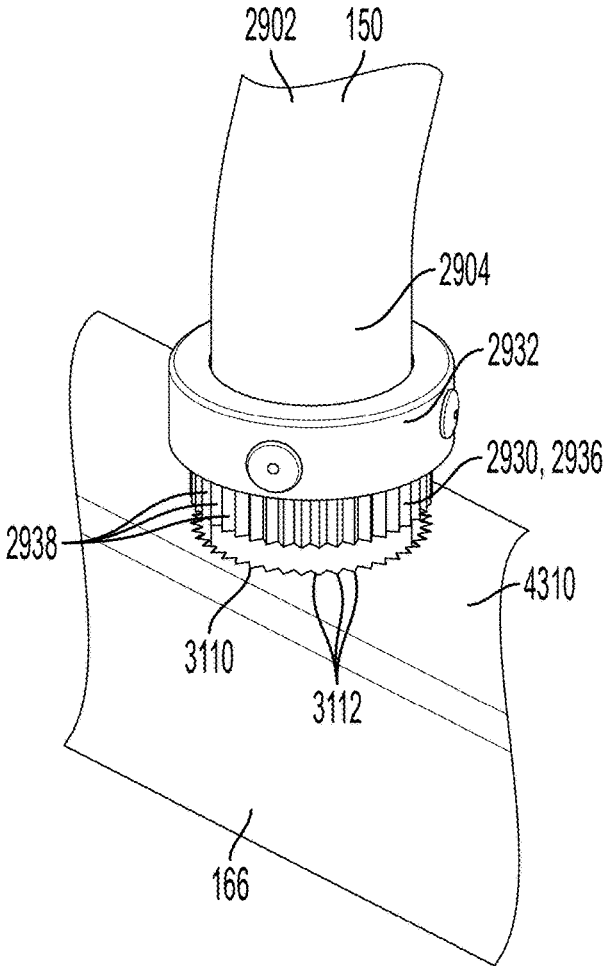
FIG. 43 illustrates the adjustable guide-on assembly of FIG. 42 in an unlocked position.

FIGS. 42 and 43 illustrate one of the vertical boat guides 150, in accordance to another example aspect of the present disclosure. The vertical boat guide 150 can be rotationally coupled to a corresponding one of the upper side rails 166. The vertical boat guide 150 can comprise the guide tube 2902, which can define the lower tube section 2904. The lower tube section 2904 can extend through and be rotationally coupled to the upper side rail 166.

As shown in FIG. 43, the vertical boat guide 150 can comprise the adjustment assembly 2930 mounted to the lower tube section 2904 of the guide tube 2902. The adjustment assembly 2930 can comprise the upper adjuster ring 2932 and the adjuster gear 2936. The adjuster gear 2936 can define a plurality of the longitudinal teeth 2938 extending along a length thereof, as previously described. The upper adjuster ring 2932 can be configured to cap an upper end of the adjuster gear 2936. In the present aspect, the adjustment assembly 2930 does not comprise the lower adjuster ring 2934 (shown in FIG. 29C).

The guide opening 3110 can be formed through the upper side rail 166. In some aspects, the guide opening 3110 may be formed through a top rail wall 4310 only of the upper side rail 166. In other aspects, the guide opening 3110 may further extend through an opposing bottom rail wall of the upper side rail 166. The guide opening 3110 can be configured to receive the lower tube section 2904 of the guide tube 2902 therethrough. Additionally, the adjustment assembly 2930 mounted to the lower tube section 2904 can be received through the guide opening 3110.

According to example aspects, the guide opening 3110 can define the plurality of opening teeth 3112 configured to mate with the longitudinal teeth 2938 of the adjuster gear 2936 in a locked position (shown in FIG. 42) of the vertical boat guide 150. In the locked position, the vertical boat guide 150 can be prevented from rotating relative to the upper side rail 166.

In an unlocked position (shown in FIG. 43) of the vertical boat guide 150, the vertical boat guide 150 can be permitted to rotate relative to the upper side rail 166 to shift the upper tube section 2906 (shown in FIG. 29A) inward and outward as desired. To re-orient the vertical boat guide 150 from the locked position to the unlocked position, the guide tube 2902 can be raised upward through the guide opening 3110 of the upper side rail 166. As the guide tube 2902 is raised upward, the toothed adjuster gear 2936 attached thereto can be raised upward to disengage from the toothed guide opening 3110. The guide tube 2902 can then be rotated relative to the upper side rail 166, and the upper tube section 2906 can be shifted inward or outward to a desired position.

Once the guide tube 2902 is oriented in the desired position, the adjuster gear 2936 can be slid back downward through the guide opening 3110 to engage the adjuster gear 2936 with the guide opening 3110. The longitudinal teeth 2938 of the adjuster gear 2936 can mate with the mating opening teeth 3112 of the guide opening 3110 to lock the guide tube 2902 in the desired position.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A boat lift comprising:

a base frame portion for supporting a boat;

an upright frame portion extending substantially upright from the base frame portion, the upright frame portion comprising a swing arm, the swing arm comprising:

a shock absorption assembly comprising a resilient shock absorber;

an arm body slidably coupled to the shock absorption assembly proximate a first swing arm end of the swing arm; and a swing pivot proximate the first swing arm end; and a dock mounting assembly configured to mount the boat lift frame to a dock, the swing arm pivotably coupled to the dock mounting assembly by the swing pivot.

2. The boat lift of claim 1, wherein:

the shock absorption assembly further comprises a shock housing;

the resilient shock absorber is arranged within the shock housing; and a first body end of the arm body extends into and slides within a housing interior of the shock housing.

3. The boat lift of claim 2, wherein:

the arm body is slidably coupled to the shock housing by a shock fastener;

the arm body defines an elongated fastener slot; and the shock fastener is configured to slide within the elongated fastener slot.

4. The boat lift of claim 3, wherein the resilient shock absorber is a bellows.

5. The boat lift of claim 3, wherein:

the swing arm further comprising an end sleeve:

the end sleeve is fixedly coupled to the shock housing at the first swing arm end by the shock fastener; and the resilient shock absorber and the elongated fastener slot are arranged within the end sleeve.

6. The boat lift of claim 5, wherein the swing pivot is mounted to the end sleeve.

7. The boat lift of claim 1, wherein:

the swing pivot comprises a pivot bushing and a pivot fastener;

the pivot fastener couples the swing arm to the dock mounting assembly; and the pivot bushing pivots about the pivot fastener.

8. The boat lift of claim 7, wherein:

the dock mounting assembly comprises a positioner plate;

the positioner plate defines a plurality of arm positioner holes;

the pivot fastener engages a corresponding one of the arm positioner holes to couple the swing arm to the dock mounting assembly; and the pivot fastener is selectively adjustable between the plurality of arm positioner holes to adjust a longitudinal position of the swing arm relative to the positioner plate.

9. The boat lift of claim 8, wherein the dock mounting assembly further comprises an upper mounting bracket and a lower mounting bracket for coupling the dock mounting assembly to the dock.

10. The boat lift of claim 9, wherein:

the positioner plate further comprises a plurality of bracket positioner holes;

a bracket fastener engages a corresponding one the bracket positioner holes to couple the lower mounting bracket to the positioner plate; and the bracket fastener is selectively adjustable between the plurality of bracket positioner holes to adjust a longitudinal position of the lower mounting bracket relative to the positioner plate.

11. The boat lift of claim 10, wherein:

the dock mounting assembly further comprises a threaded rod defining an upper rod end and a lower rod end opposite the upper rod end;

the threaded rod extends through a lower rod opening formed through the lower mounting bracket;

a threaded nut is mounted on the threaded rod between the lower mounting bracket and the lower rod end;

the threaded nut is configured to be selectively:

tightened towards the upper rod end to bias the lower mounting bracket upward along the threaded rod towards the upper rod end; and loosened towards the lower rod end to permit the lower mounting bracket to slide downward along the threaded rod towards the lower rod end.

12. The boat lift of claim 1, wherein:

the boat lift further comprises a vertical boat guide defining lower section and an adjuster gear mounted to the lower section;

the upright portion defines a guide opening;

the adjuster gear engages the guide opening in a locked position and disengages the guide opening in an unlocked position;

in the locked position, the vertical boat guide is prohibited from rotating relative to the upright portion, and in the unlocked position, the vertical boat guide is permitted to rotate relative to the upright portion.

13. A boat lift comprising:

a base frame portion for supporting a boat, the base frame portion comprising a boat support member extending laterally between a first lift side of the boat and a second lift side of the boat lift;

an upright frame portion extending substantially upright from the base frame portion, the upright frame portion comprising a swing rail at the first lift side; and a torsion assembly pivotably coupling the swing rail to the boat support member, the torsion assembly comprising:

a main axle extending laterally through an interior of the boat support member and rotatably relative to the boat support member; and a torsion tube fixedly coupled to each of the swing rail and the main axle.

14. The boat lift of claim 13, wherein:

the boat support member comprises an interior framework formed within the interior thereof;

the interior framework defining a substantially cylindrical channel along a length of the boat support member; and the main axle is received through the substantially cylindrical channel.

15. The boat lift of claim 14, wherein:

the boat support member defines a first member end and a second member end opposite the first member end;

the boat lift further comprises a torsion sleeve comprising a substantially cylindrical sleeve body;

the substantially cylindrical sleeve body extends into the substantially cylindrical channel at the first member end; and the main axle extends through the substantially cylindrical sleeve body.

16. The boat lift of claim 15, wherein:

the torsion tube extends into a hollow interior of the main axle;

the torsion tube defines an inner tube end arranged within the hollow interior of the main axle and an outer tube end arranged external to the hollow interior of the main axle;

a spacer is mounted to the torsion tube at the inner tube end to maintain the torsion tube in coaxial alignment with the main axle.

17. The boat lift of claim 13, wherein:

the torsion tube extends into a hollow interior of the main axle;

the torsion tube defines an inner tube end arranged within the hollow interior of the main axle and an outer tube end arranged external to the hollow interior of the main axle; and the torsion tube is fixed in position relative to the main axle by a lock assembly.

18. The boat lift of claim 17, wherein:

the main axle defines a circumferential axle slot;

the lock assembly comprises a tube retainer is mounted within the circumferential axle slot; and the tube retainer engages the torsion tube to prohibit rotations of the tube retainer relative to the main axle.

19. The boat lift of claim 18, wherein:

the lock assembly further comprises an axle clamp and a clamp fastener;

the main axle extends through an axle opening of the axle clamp; and the clamp fastener is coupled to the axle clamp and biases the tube retainer against the torsion tube.

20. The boat lift of claim 17, wherein:

the outer tube end of the torsion tube extends transversely into a rail opening formed proximate a lower rail end the swing rail;

the torsion tube defines a fastener groove formed proximate the outer tube end;

the fastener groove is oriented within an interior of the swing rail; and a rail fastener engages the fastener groove to couple the torsion tube to the swing rail.

21. The boat lift of claim 17, wherein:

the lock assembly is a cuff lock assembly comprising a cuff body and at least one cuff fastener;

the cuff body defines a cuff void defining a cuff axis; and the at least one cuff fastener extends radially through the cuff body and into the cuff void to engage each of the main axle and the torsion tube.

22. The boat lift of claim 21, wherein:

the cuff lock assembly further comprises an inner plate arranged at an inner end of the cuff body and an outer plate arranged at an outer end of the cuff body;

the main axle extends through an inner opening of the inner plate and into the cuff void; and the torsion tube extends through the inner opening of the inner plate, the cuff void, and an outer opening of the outer plate.

23. A boat lift comprising:

a base frame portion for supporting a boat, the base frame portion comprising a boat support member extending laterally between a first lift side of the boat and a second lift side of the boat lift, the boat support member defining a longitudinal slot formed in a top wall of the boat support member and extending along a length of the boat support member;

an upright frame portion extending substantially upright from the base frame portion; and a bunk bracket slidably mounted to the boat support member by a bracket fastener, wherein the bracket fastener engages and slides within the longitudinal slot to reposition the bunk bracket along the length of the boat support member.

24. The boat lift of claim 23, wherein:

the boat support member further defines a longitudinal channel extending along a length of the boat support member;

the longitudinal slot allows access to the longitudinal channel; and a portion of the bracket fastener engages and slides within the longitudinal channel.

25. The boat lift of claim 24, wherein:

the bracket fastener is a nut and bolt assembly comprising a bolt and a threaded nut;

the bolt defines a head arranged within the longitudinal channel and a threaded shaft extending from the head and through the longitudinal slot;

the size of the head prohibits the head from passing through the longitudinal slot;

the threaded shaft engages the bunk bracket; and the nut is tightened onto a distal end of the threaded shaft, opposite the head.

26. The boat lift of claim 24, wherein an interior framework formed within an interior of the boat support member defines the longitudinal channel.

27. The boat lift of claim 23, wherein:

the bunk bracket comprises a support portion and a bracket portion;

the bracket portion is slidably mounted to the boat support member by the bracket fastener;

the bracket portion is formed at a distal support end of the support portion, distal to the boat support member;

a bunk board is mounted on the bracket portion.

* * * * *